US006454186B2

(12) United States Patent
Haverstraw et al.

(10) Patent No.: US 6,454,186 B2
(45) Date of Patent: Sep. 24, 2002

(54) MULTI-FUNCTIONAL SHOWER HEAD

(75) Inventors: Jay A. Haverstraw, Fort Collins; Joseph W. Cacka, Berthoud; Robin D. Harris, Fort Collins; Robert B. Male, Fort Collins; Gary J. Thomas, Fort Collins; Allen Yi, Fort Collins, all of CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 09/853,108

(22) Filed: May 9, 2001

Related U.S. Application Data

(63) Continuation of application No. 09/383,059, filed on Aug. 25, 1999, now Pat. No. 6,230,989.

(60) Provisional application No. 60/142,239, filed on Jul. 2, 1999, provisional application No. 60/105,490, filed on Oct. 23, 1998, and provisional application No. 60/097,990, filed on Aug. 26, 1998.

(51) Int. Cl.[7] ..... A62C 31/00; A62C 37/20

(52) U.S. Cl. ..... 239/443; 239/444; 239/445; 239/562

(58) Field of Search ..... 239/443, 444, 239/445, 446, 447, 448, 449, 562, 381; 137/872, 877, 881, 494, 887, 876; 251/126, 251

(56) References Cited

U.S. PATENT DOCUMENTS

| | | | | |
|---|---|---|---|---|
| 2,567,642 A | | 9/1951 | Penshaw | |
| 3,098,508 A | | 7/1963 | Gerdes | |
| 3,341,132 A | * | 9/1967 | Parkison | 239/443 |
| 3,550,863 A | | 12/1970 | McDermott | |
| D237,708 S | | 11/1975 | Grohe | |
| 3,967,783 A | | 7/1976 | Halsted et al. | |
| 3,998,390 A | | 12/1976 | Peterson et al. | |
| D245,858 S | | 9/1977 | Grube | |

(List continued on next page.)

FOREIGN PATENT DOCUMENTS

| | | |
|---|---|---|
| DE | 3440901 A1 | 7/1985 |
| EP | 0726 811 B1 | 1/1998 |
| FR | 873808 | 7/1942 |
| FR | 1039750 | 10/1953 |
| GB | 2 066 074 A | 1/1980 |

*Primary Examiner*—Lesley D. Morris
*Assistant Examiner*—Davis Hwu
(74) *Attorney, Agent, or Firm*—Dorsey & Whitney LLP

(57) ABSTRACT

A shower head having a plurality of spray modes and unique controls to allow the selection of the desired mode. The shower head includes several unique features to allow the inclusion of several different spray modes, such as wide spray, medium spray, center spray, champagne spray, high speed pulsating spray, low speed pulsating spray, and mist. A waterfall mode can be implemented. The shower head includes a flow control valve that controls the pressure of the water flow, and acts to divert water to a mode selector or to a separate spray mode, such as the mist mode. The flow control valve diverts water between the mode selector and the separate spray mode. It also allows a combination of the modes controlled by the mode selector and the separate spray mode. The shower head also includes a mode selector. The mode selector transfers or routes fluids from the flow control valve to any number of individual or a combination of flow spray mode outlets.

30 Claims, 45 Drawing Sheets

U.S. PATENT DOCUMENTS

D245,860 S 9/1977 Grube
4,081,135 A 3/1978 Tomaro
4,084,271 A 4/1978 Ginsberg
4,117,979 A 10/1978 Lagarelli et al.
4,151,955 A 5/1979 Stouffer
4,151,957 A 5/1979 Gecewicz et al.
4,165,837 A 8/1979 Rundzaitis
4,209,132 A 6/1980 Kwan
4,254,914 A 3/1981 Shames et al.
D261,300 S 10/1981 Klose
4,303,201 A 12/1981 Elkins et al.
4,319,608 A 3/1982 Raikov et al.
4,614,303 A 9/1986 Moseley, Jr. et al.
4,657,185 A 4/1987 Rundzaitis
4,703,893 A 11/1987 Gruber
4,754,928 A 7/1988 Rogers et al.
4,903,897 A * 2/1990 Hayes ..... 239/394
4,953,585 A 9/1990 Rollini et al.
D313,267 S 12/1990 Lenci et al.
D315,191 S 3/1991 Mikol
5,033,897 A 7/1991 Chen
D325,769 S 4/1992 Haug et al.
D325,770 S 4/1992 Haug et al.
D326,311 S 5/1992 Lenci et al.
5,141,016 A 8/1992 Nowicki
5,172,866 A 12/1992 Ward
D332,994 S 2/1993 Huen
5,232,162 A 8/1993 Chih
5,246,169 A 9/1993 Heimann et al.
5,294,054 A 3/1994 Benedict et al.
D348,720 S 7/1994 Haug et al.
5,344,080 A 9/1994 Matsui
D352,347 S 11/1994 Dannenberg
5,397,064 A 3/1995 Heitzman
5,398,872 A 3/1995 Joubran
5,433,384 A 7/1995 Chan et al.
5,476,225 A 12/1995 Chan
D367,696 S 3/1996 Andrus
5,499,767 A 3/1996 Morand
5,507,436 A 4/1996 Ruttenberg
D370,052 S 5/1996 Chan et al.
5,551,637 A 9/1996 Lo
5,558,278 A 9/1996 Gallorini
5,577,664 A 11/1996 Heitzman
5,613,639 A 3/1997 Storm et al.
5,653,260 A 8/1997 Huber
5,718,380 A 2/1998 Schorn et al.
5,806,771 A * 9/1998 Loschelder et al. ..... 239/446
5,820,574 A * 10/1998 Henkin et al. ..... 601/160
5,918,811 A 7/1999 Denham et al.
6,126,091 A * 10/2000 Heitzman ..... 239/380

* cited by examiner 90
82
304
284
306
308
282
316
310
322
320

82
292
288
324
76
336
290
332
336
84
80
280

338
280

MULTI-FUNCTIONAL SHOWER HEAD

RELATED APPLICATIONS

This application is a continuation of application Ser. No. 09/383,059, filed Aug. 25, 1999 now U.S. Pat. No. 6,230,989, which application claims the benefit of provisional application Nos. 60/142,239, filed Jul. 2, 1999, No. 60/105,490, filed Oct. 23, 1998, and No. 60/097,990, filed Aug. 26, 1998, from which priority is claimed and the disclosure of each is incorporated herein by reference in its entirety.

FIELD OF THE INVENTION

This invention relates to shower heads, and more particularly relates to new and improved multi-functional shower heads having several different spray modes and a flow control and mode selector valve allowing full exercise of the available options.

BACKGROUND OF THE INVENTION

Multi-function shower heads have a plurality of spray modes, including various standard sprays and pulsed sprays. Multi-function shower heads may also have flow control valves to allow the user to adjust the flow pressure to a desired level. Many flow control valves are ball valves, and simply restrict the area through which the water flows in order to control the pressure by rotation of the ball in the flow path.

Typically, the spray mode is selected using a control ring positioned around the circumference of the shower head, and moveable with respect to the shower head. The ring is rotated around the shower head to select the desired spray mode. Adjusting the control ring structure often requires the user to grab the control ring across the face of the shower head, thereby interfering with the flow from the shower head. Using the control ring also can cause the orientation of the spray head to be adjusted inadvertently.

Missing in the art is a multi-functional shower head having desired spray modes and convenient controls to select between the spray modes, as well as allow the user to control the flow rate.

SUMMARY OF THE INVENTION

The instant invention was developed with the shortcomings of the prior art in mind, and pertains to a shower head having a plurality of spray modes and unique controls to allow the selection of the desired mode. The shower head includes several unique features to allow the inclusion of several different spray modes, such as wide spray, medium spray, center spray, champagne spray, high speed pulsating spray, low speed pulsating spray, and mist. A waterfall mode can be implemented.

The shower head includes a flow control valve that controls the pressure of the water flow, and acts to divert water to a mode selector or to a separate spray mode, such as the mist mode. The flow control valve diverts water between the mode selector and the separate spray mode. It also allows a combination of the modes controlled by the mode selector and the separate spray mode.

The shower head also includes a mode selector. The mode selector transfers or routes fluids from the flow control valve to any number of individual or a combination of flow spray mode outlets.

In addition, the instant invention includes a shower head that is substantially triangular in shape that allows the control knobs for the flow control valve and the mode selector to be positioned on the lower side surfaces. This eliminates any interference with the spray when the controls are being actuated. Further, the instant invention includes a unique mist-spray aperture structure, and a vacuum breaker structure that can be built into the bracket of a hand-held shower.

In greater detail, the instant invention addresses a multi-functional shower head including a housing having an inlet flow path, a chamber, a first outlet flow path, a mode selector, a plurality of mode channels, and a plurality of outlet mode apertures. The inlet flow path and the first outlet flow path are each in fluid communication with the chamber, the first outlet flow path also being in fluid communications with the mode selector, and the plurality of mode channels each being in fluid communications with the mode selector and the outlet mode apertures. A flow control valve is positioned in the chamber and actuable to control the pressure of the water flow therethrough to the first outlet mode path, and the mode selector is actuable to select at least one of the mode channels. A first turn knob on the housing is operably connected to the flow control valve to allow selective manipulation of the flow control valve. A second turn knob on the housing is operably connected to the mode selector to allow selective manipulation of the mode selector.

In more detail, the above shower head has a substantially triangular front face, having opposing lower sides, and the first turn knob is on one lower side and the second turn knob is on the other of the lower sides.

A further embodiment of the present invention includes a housing having an inlet flow path, a chamber, a first outlet flow path, a second outlet flow path, a mode selector, a plurality of mode channels, and a plurality of outlet spray mode apertures. The inlet flow path, the first outlet flow path, and the second outlet flow path are each in fluid communication with the chamber. The first outlet flow path is in fluid communications with the mode selector, and the plurality of mode channels are each in fluid communications with the mode selector and the outlet mode apertures. The second outlet flow path is in fluid communication with a unique spray mode aperture. A flow control valve is positioned in the chamber and actuable to control the pressure of the water flow therethrough to the first outlet mode path, and includes a diverter portion for diverting water flow to either the first outlet flow path or the second outlet flow path, or a combination of both the first and second outlet flow paths. The mode selector is actuable to select at least one of the mode channels.

In more detail, the instant invention pertains to a shower head for directing the flow of water, the shower head including a housing having an inlet flow path, a chamber having an inlet port and an outlet port, and an outlet flow path. The inlet flow path is in fluid communication with the inlet port, and the outlet flow path is in fluid communication with the outlet port. The water flows from the inlet flow path, through the chamber, and out the outlet flow path. A flow control valve having a shuttle portion and a knob portion is positioned in the housing, the shuttle portion positioned in the chamber and the knob portion extending from the chamber. The shuttle portion and the knob portion are operably connected such that selective actuation of the knob portion moves the shuttle portion in the chamber. The shuttle portion also defines a restrictor. Upon actuation of the knob portion, the shuttle portion moves in the chamber and causes the restrictor to at least partially cover the inlet port to restrict the flow of water into the outlet flow path.

The instant invention also addresses a shower head having a plurality of spray modes for exiting water, the shower head including a housing having a flow path for incoming water, a mode selector, and a plurality of outlet flow paths, each of the outlet flow paths leading to a particular spray mode. The flow path for incoming water is in fluid communication with the mode selector, and the plurality of outlet flow paths are in fluid communications with the mode selector. The mode selector includes a spool valve having a hollow inner core and defining a plurality of outlet apertures, a manifold defining a tubular recess, having a side wall, for rotatably receiving the spool valve, and a plurality of mode apertures formed in the side wall of the recess. Each of the apertures are in fluid communication with at least one of the outlet flow paths and spray modes. The spool valve rotates in the manifold to align at least one outlet aperture with one of the mode apertures to allow water flow from the mode selector through the spool to the outlet flow path associated with the aligned outlet and mode apertures.

A different aspect of the invention is shown by a shower head having a plurality of spray modes for exiting water, the shower head including a housing having a flow path for incoming water, a mode selector, and a plurality of outlet flow paths, each of the outlet flow paths leading to a particular spray mode. The flow path for incoming water is in fluid communication with the mode selector, and the plurality of outlet flow paths are in fluid communication with the mode selector. The mode selector includes a reservoir defining a plurality of mode apertures, each of the apertures in fluid communication with at least one of the outlet flow paths and spray modes, and a valve assembly. The valve assembly defines at least one valve arm, the at least one valve arm having a valve seal and being movable between a first position in sealing engagement with the respective mode aperture and a second position disengaged from the respective mode aperture. The valve arm normally biases the valve seal in engagement with the respective mode aperture. A cam shaft is rotatably mounted in the reservoir and defines at least one cam protrusion aligned along the cam shaft to engage the at least one valve arm, wherein the rotation of the cam shaft causes the at least one cam protrusion to engage the at least one valve arm and move the at least one valve arm from the first position to the second position to allow fluid flow through the outlet aperture.

The flow control valves and the mode selector structures make the control of the features included in the instant invention easy and accurate.

With respect to the mist nozzle structure of the present invention, the mist nozzle includes a first incoming portion, a middle portion, and an outlet portion. The first portion has an end wall forming an aperture therethrough. The middle portion extends from the end wall of the first portion to an outwardly-diverging conical rim forming the outlet portion. Opposing grooves are formed in the side wall of the first portion and extend along the first portion, the opposing grooves continue to extend along the end wall and terminate in a circumferential recess, having a base, formed in the end wall about the aperture. A plug is positioned in the incoming portion and engages the end wall to force water through the opposing grooves and into converging streams at the recess, the converging streams impacting to form mist, and flowing through the middle portion and out from the outlet portion.

Regarding the vacuum breaker portion of the present invention, it is positioned in the bracket of a hand-held shower and activated by water pressure. The bracket has an outer housing, a pivot ball in the housing for attachment to a shower pipe, a stand-tube having a rim in the housing spaced from the pivot ball, and a space formed between the housing and the stand tube. The vacuum breaker includes a pivot ball support defining a bore therethrough, a first end for engaging the pivot ball, and a second end having an outwardly conical shape, and at least one aperture formed in the second end in the conical shape. A support ring is positioned in the housing adjacent the stand-tube, the support ring defining a central aperture. A flexible washer is included having a circular shape and defining a central aperture and a circumferential rim, with a web extending between the central aperture and the rim. The flexible washer is positioned between the pivot ball support and the support ring with the central aperture in alignment with the central aperture of the support ring. The web of the washer is movable from a first position with no water pressure where the web engages the second end of the pivot ball support to sealingly cover the aperture formed therein, to a second position under water pressure where the web sealingly engages the rim of the stand tube and uncovers the aperture in the second end of the pivot ball support to allow water to flow through the aligned central apertures.

Other aspects, features and details of the present invention can be more completely understood by reference to the following detailed description of a preferred embodiment, in conjunction with the drawings, and from the appended claims.

DETAILED DESCRIPTION OF THE PREFERRED EMBODIMENT

Figure 1:
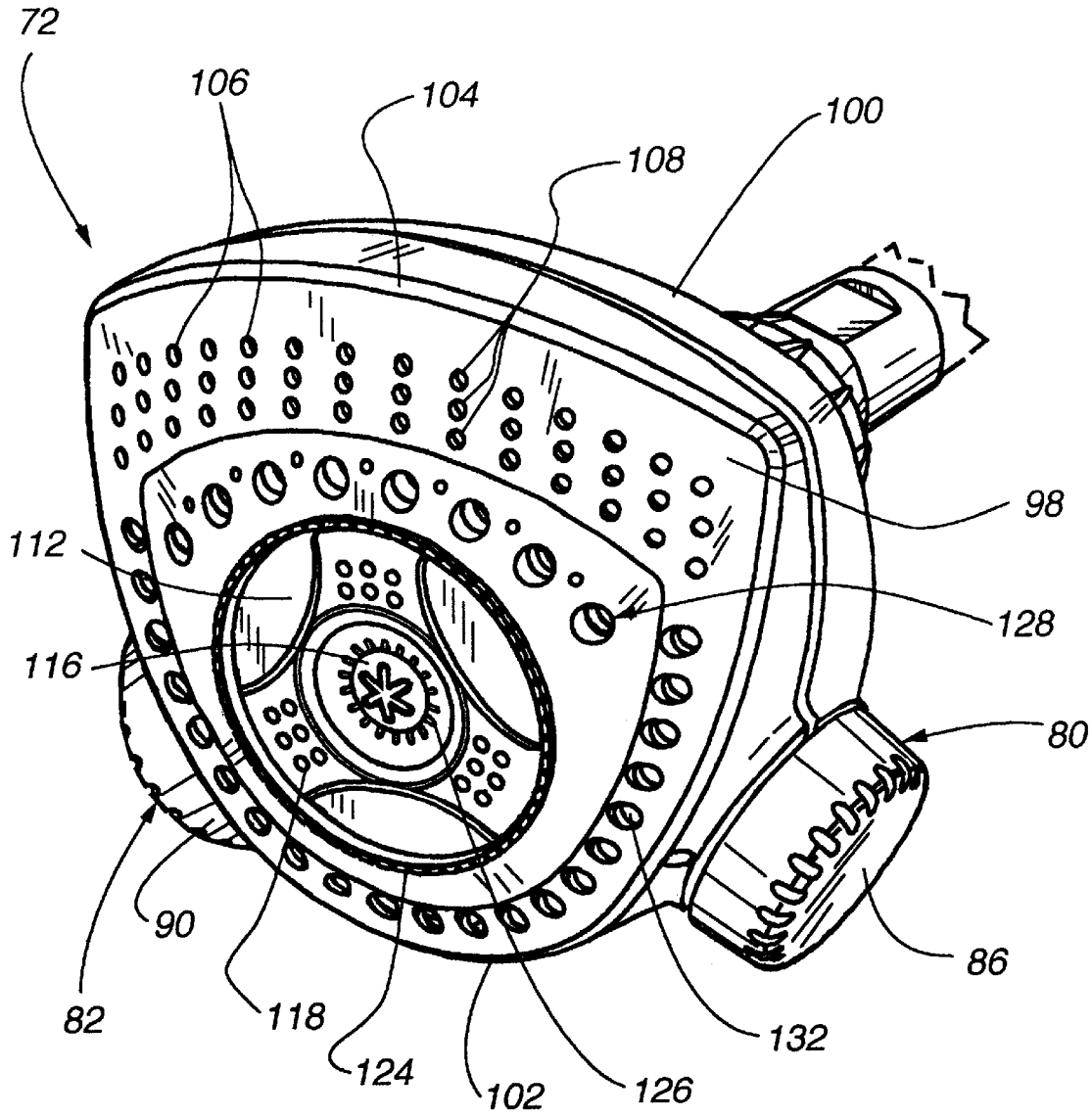
FIG. 1 shows a perspective view of a wall-mount shower head in accordance with the present invention.

Referring first to FIG. 1, a wall mount shower head 72 incorporating the features of the present invention is shown. The shower head includes a variety of spray modes, including at least normal spray, pulsating spray, champagne spray, mist spray, and combinations thereof. In general, the shower head defines an incoming flow path 74 and two outgoing flow paths 76, 78. One outgoing flow path 76 is split into several spray modes by a mode selector 80. The other outgoing flow path 78 is to a mode not able to be selected by mode selector 80, in this case the mist mode. A flow control valve 82 is used to divert water from the incoming flow path 74 to either, or both, of the outgoing flow paths 76, 78. The flow control valve 82 also allows the user to adjust the water pressure of the selected spray mode. A mode selector 80 is used to select the various spray modes, other than mist, and a flow controller 82 is used to convert to the mist mode, and for adjusting the pressure of the water passing through the selected spray modes. Much, if not all, of the shower head of the present invention can be made of plastic or other similar material suitable for the construction of shower heads.

The mode selector 80 includes a first valve assembly 84 (see FIG. 11) for diverting flow to the desired spray modes, which is actuated by a first adjustment knob 86 extending from the bottom, right-hand side of the shower head 72. The mode selector adjustment knob 86 allows the user to select the desired spray mode without having to grab the entire perimeter of the shower head 72 and possibly accidentally adjust the direction the shower head is pointing. In addition, the user's hand is less likely to interfere with the spray while adjusting the spray mode. The flow controller 82 includes a second valve 88 assembly for controlling the flow rate to the mode selector 80 and for converting into and out of mist spray mode, and is actuated by a second adjustment knob 90 extending from the bottom left-hand side of the shower head.

Figure 2:
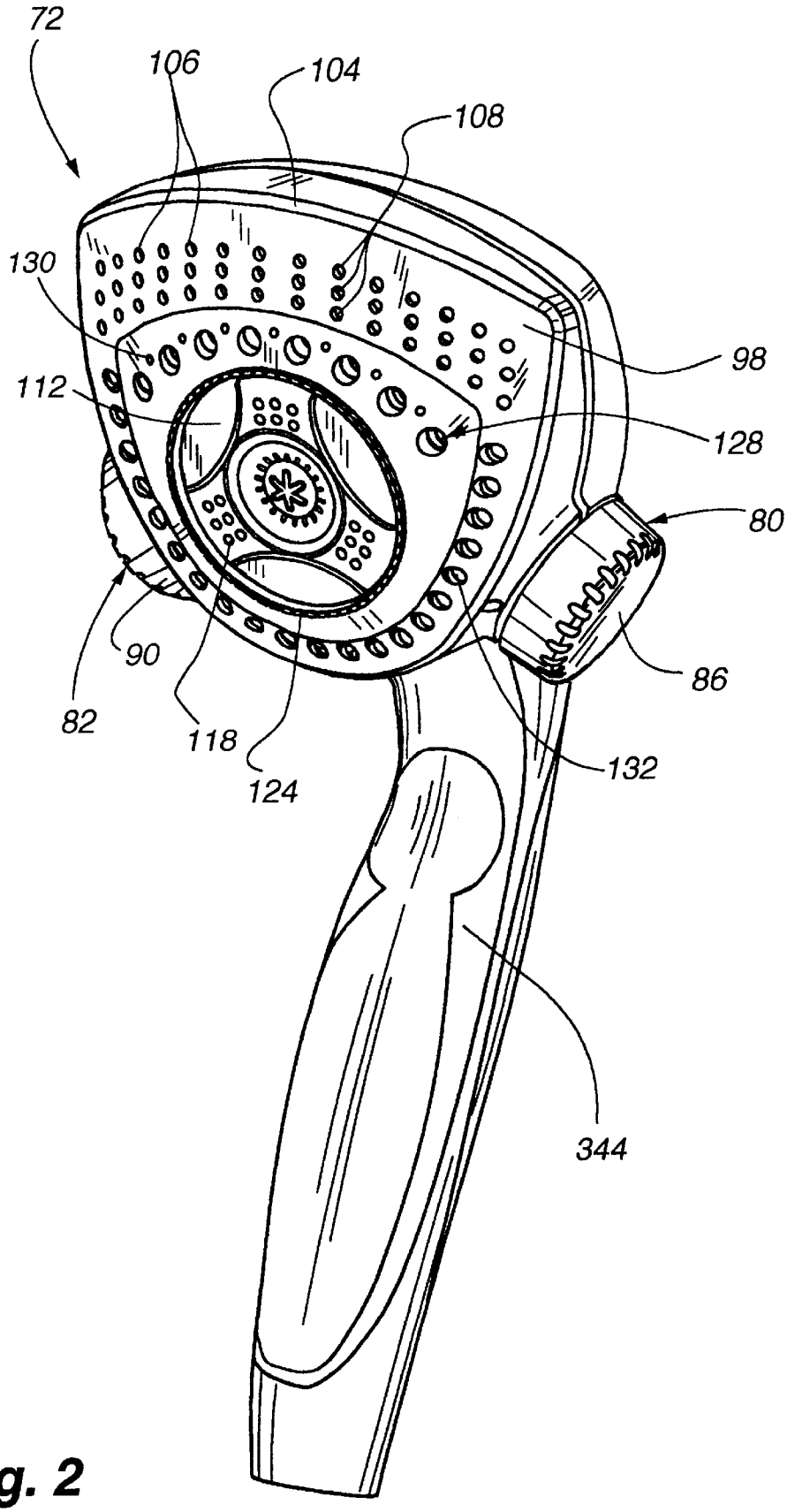
FIG. 2 shows a perspective view of a hand-held shower head in accordance with the present invention.

The shower head 72 is described herein as a wall-mount shower head. The inventive shower head can also be incorporated into a hand-held shower head, as shown in FIG. 2. The hand-held shower head functions identically to the wall-mount shower head, except it requires a hose 92 to connect the shower head 72 to the shower pipe and a cradle 96 to support the shower head 72 when not being used in hand-held mode.

Figure 4:
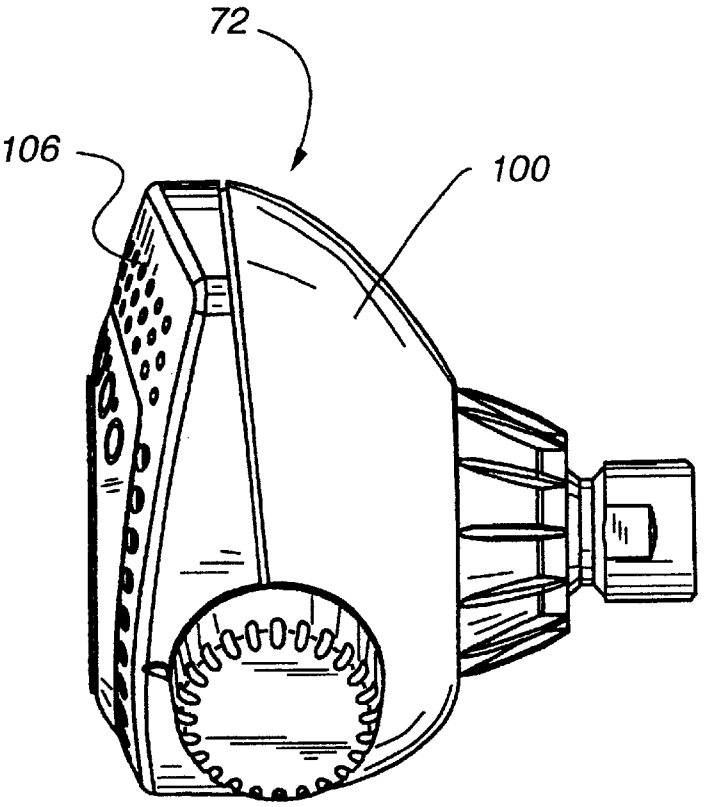
FIG. 4 shows a side view of the wall-mount shower head in accordance with the present invention.
Figure 3:
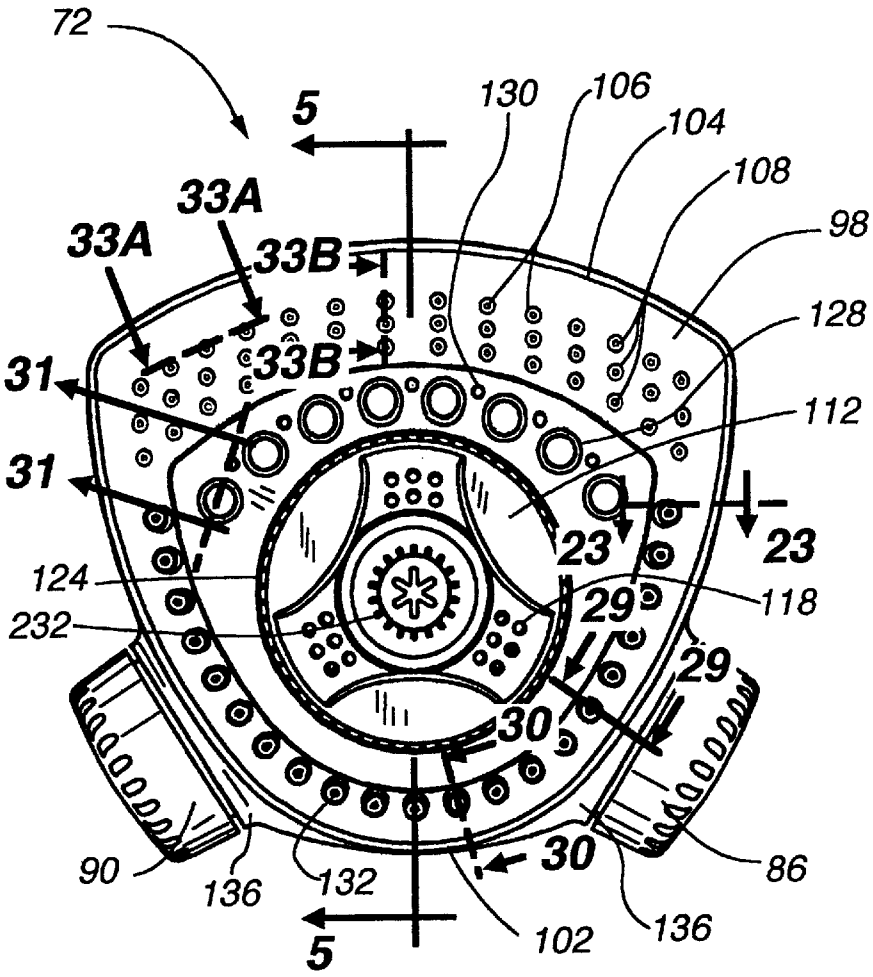
FIG. 3 shows a front view of the wall-mount shower head in accordance with the present invention.

The shower head 72, as shown in FIGS. 1, 3 and 4 has a triangular front shaped portion 98 transitioning into a generally conical rear portion 100 for attachment to the shower pipe (not shown). The generally triangular front portion 98 is formed by a U-shaped bottom edge 102 and an arcuate (concave downwardly) top edge 104. This generally triangular front portion 98 allows a deviation from the traditional circular shower head designs, and more importantly allows for unique and beneficial spray modes.

The mode selector adjustment knob 86 extends from the lower right-hand side of the front portion 98 of the shower head 72, and the flow controller adjustment knob 90 extends from the lower left-hand side of the front portion 98 of the shower head 72. The internal flow paths 76, 78 have been designed for this configuration, while it is contemplated that the knobs 86, 90 could be reversed if the appropriate changes to the flow paths are also made.

Referring to FIGS. 1, 3 and 4, the shower head 72 of the present invention includes several spray modes, such as normal spray, mist, champagne, pulsed, and waterfall. The arched rectangular band of apertures along the top edge of the faceplate 104 form the normal spray apertures 106. The arched band is downwardly concave. The arched rectangular pattern emits a spray at virtually all flow levels that provides a more wide coverage pattern than the standard circular spray. The normal spray apertures 106 are preferably formed by a series of columns 108 each having three apertures. The columns 108 are each vertically offset from one another to form the arched array of spray apertures 106. Each of the external spray apertures have internal bore directions formed so as to direct the spray generally away from spray path of the inwardly-adjacent nozzle spray paths. See FIGS. 33A and B. This causes the spray to widen as it emerges from the shower head 72, and remain substantially in separate streams. The wide, arcuate-rectangular spray path covers a wider area on a user's body than a circular spray pattern.

Pulsating spray emerges from the apertures formed in the orifice cup 112, which is positioned in the central portion 114 of the front portion 98 and removably held in position there by a center retainer 116. The pulsating flow apertures 118 are formed in three circumferentially spaced groups of apertures 118. A turbine 120 is positioned inside of the orifice cup to create the pulsating flow. See FIG. 5. The turbine 120 held between the orifice cup 112 and the front channel plate 122, upon which the orifice cup 112 is positioned and secured to. This is described in more detail below. The turbine 120 structure itself is known and available in the art.

An outer circle of apertures 124 around the edge of the orifice cup 112 forms a circular-shaped medium normal spray. An inner circle of apertures 126 formed in the orifice cup 112 provides a small, dense, circular water spray formation.

The champagne apertures 128 are positioned just below the arched rectangular band of normal spray apertures 108. The arched champagne apertures 128 form a pattern that is downwardly concave. The champagne apertures 128 are formed in a curved line which is slightly more arcuate than the arched band of regular spray apertures 106. The curvilinear orientation of the apertures is important for the champagne spray mode in order to obtain the desired effect. Champagne flow is a highly aerated, relatively large stream of water that has a soft, bubbly feel to the user. The apertures are positioned in an arcuate orientation to each form an individual (separate) rope or stream of water flowing from each of the apertures preferably to the floor of the shower.

Air inlet apertures 130 are formed between the champagne apertures to allow air to be entrained in the champagne flow as it emerges from the shower head. This structure is described in more detail below with respect to FIGS. 5, 31 and 32.

The mist apertures 132 are formed along the perimeter of the lower side of the face plate 122 in a U-shape that is concave upwardly. This U-shaped aperture pattern helps keep the mist from flowing directly at the user's face when the mist mode is actuated (with the shower head positioned generally in front of the user's face). The water flow from the mist apertures 132 is conditioned into fine water droplets to simulate a steam effect. The structure of the mist apertures 132 is described in more detail below with respect to FIGS. 23–30.

A waterfall slot 134 can be positioned above the normal spray band. See FIG. 35. The slot 134 for waterfall flow is also curvilinear and oriented to be downwardly concave. The waterfall slot creates a sheet of water as the water emerges from the shower head 72. The structure of the waterfall slot is described in more detail below with respect to FIGS. 35–40.

The front portion, or face plate 122, has a raised or beveled central portion that has a top edge and bottom edge shaped similarly to the top and bottom edges of the face plate. The champagne apertures 128 are positioned along the top edge of the raised portion. Two partial shroud collars 136 for adjustment knobs 86, 90 are formed along the bottom edge, each on opposite sides from one another, of the shower head.

Figure 6A:
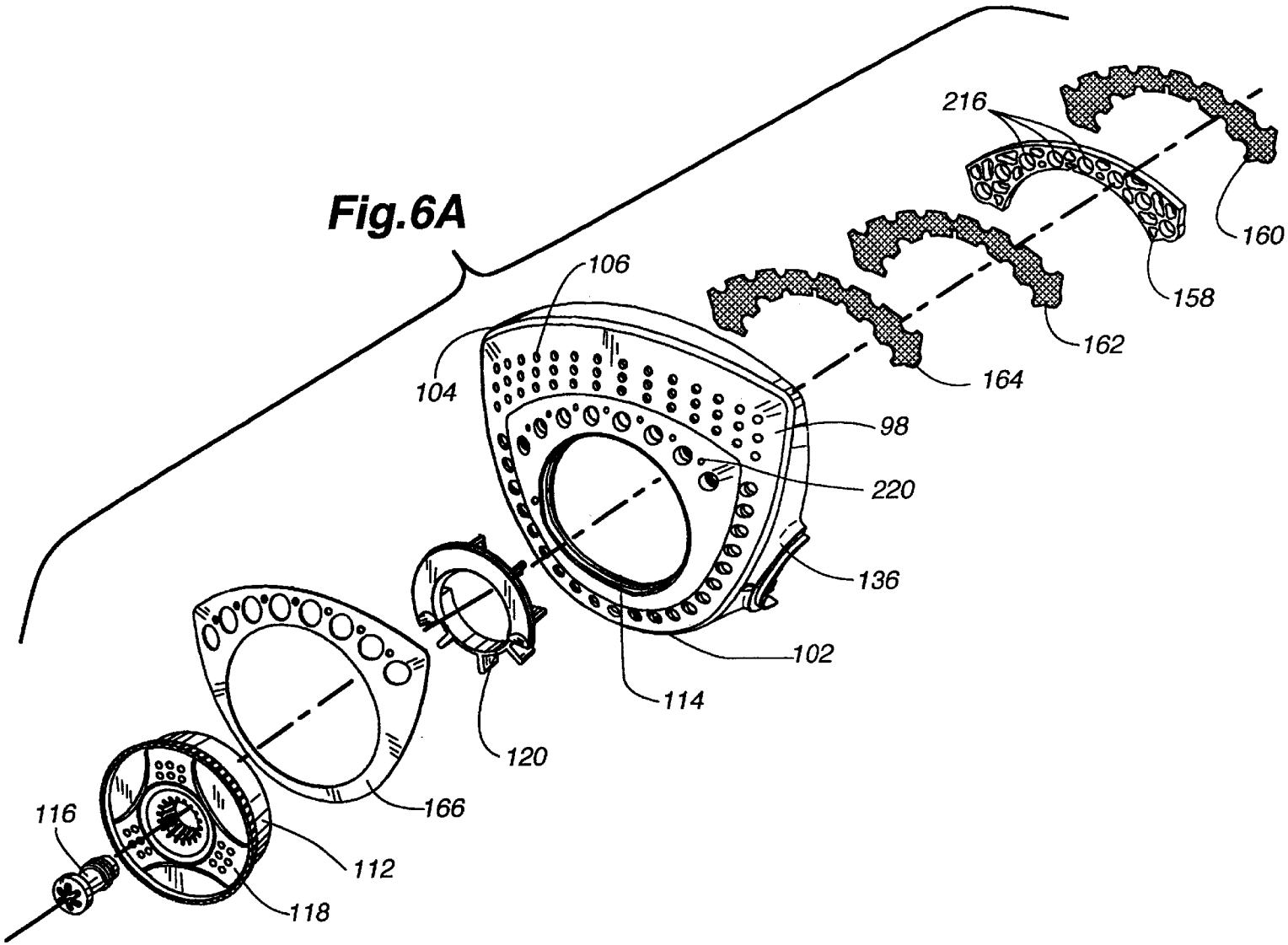
FIGS. 6A–B show an exploded view of the wall-mount shower head in accordance with the present invention.
Figure 6B:
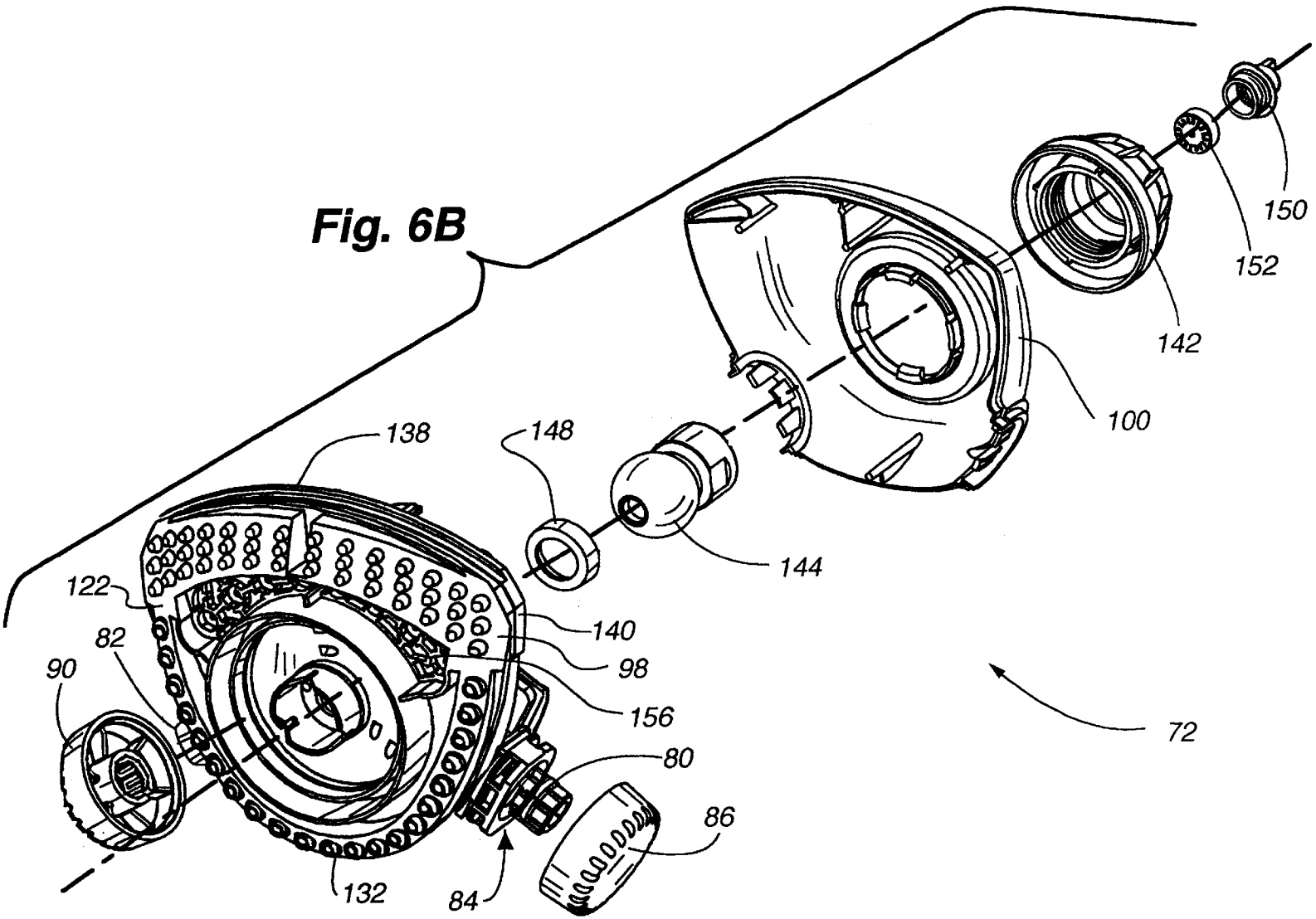

FIGS. 6A and 6B show an exploded view of the wall-mount shower head of the present invention. The shower head includes a spray head unit 138 incorporating the flow control valve 82 and the spray mode selector 80. The spray head unit includes a front channel plate 122 and a rear channel plate 140 attached together by a hot-melt process. The flow control valve 82 and the spray mode selector 80 are positioned in the rear channel plate 140. Both the flow control valve 90 and spray mode selector 86 are user-actuated by knobs extending from the spray head unit.

A rear housing cover 100 fits over the rear side of the spray head unit, which in turn has a base cone 142 that houses the pivot ball 144 and related parts for attachment to the shower pipe. The base cone 142 threadedly attaches to the externally threaded collar 146 extending from the rear of the rear channel plate 140. The base cone 142 has a generally frustoconical shape, with a threaded central bore and indentations spaced circumferentially around its body. The base cone holds the pivot ball in place, which inserts into the collar on the rear of the rear channel plate. One end of the pivot ball attaches to the shower pipe extending from the wall, which is the source of water for the shower head. The pivot ball is sealingly (by a seal washer 148) and pivotably received in the collar 146 to allow pivotable orientation of the shower head on the shower pipe. The screen filter 150 and flow regulator 152 are positioned in the pivot ball. The base cone 142 also holds the housing tightly against the rear periphery of the front housing cover to encompass the spray head unit.

The front channel plate 122 defines a circular recess 154 for receiving a turbine, as is known and available in the art. A spray cup 112 covers the recess and turbine, and is attached to the front channel plate by a retainer 116. The front channel plate 122 also defines a curved recess 156 formed around the champagne apertures 128. A champagne insert 158 is positioned in the recess 156 on top of the first sized screen 160. Two screens 162, 164 are positioned over the champagne insert 158. The screens 162, 164 and champagne insert 158 help create an aerated champagne spray.

A front housing cover 98 (a triangular shaped front housing or faceplate) fits over the front channel plate 122 and around the spray cup 112, and mates with the rear housing cover 100. A cosmetic faceplate or nameplate 166 can be used to decorate the front cover, or other parts of the housing, as desired.

Figure 7:
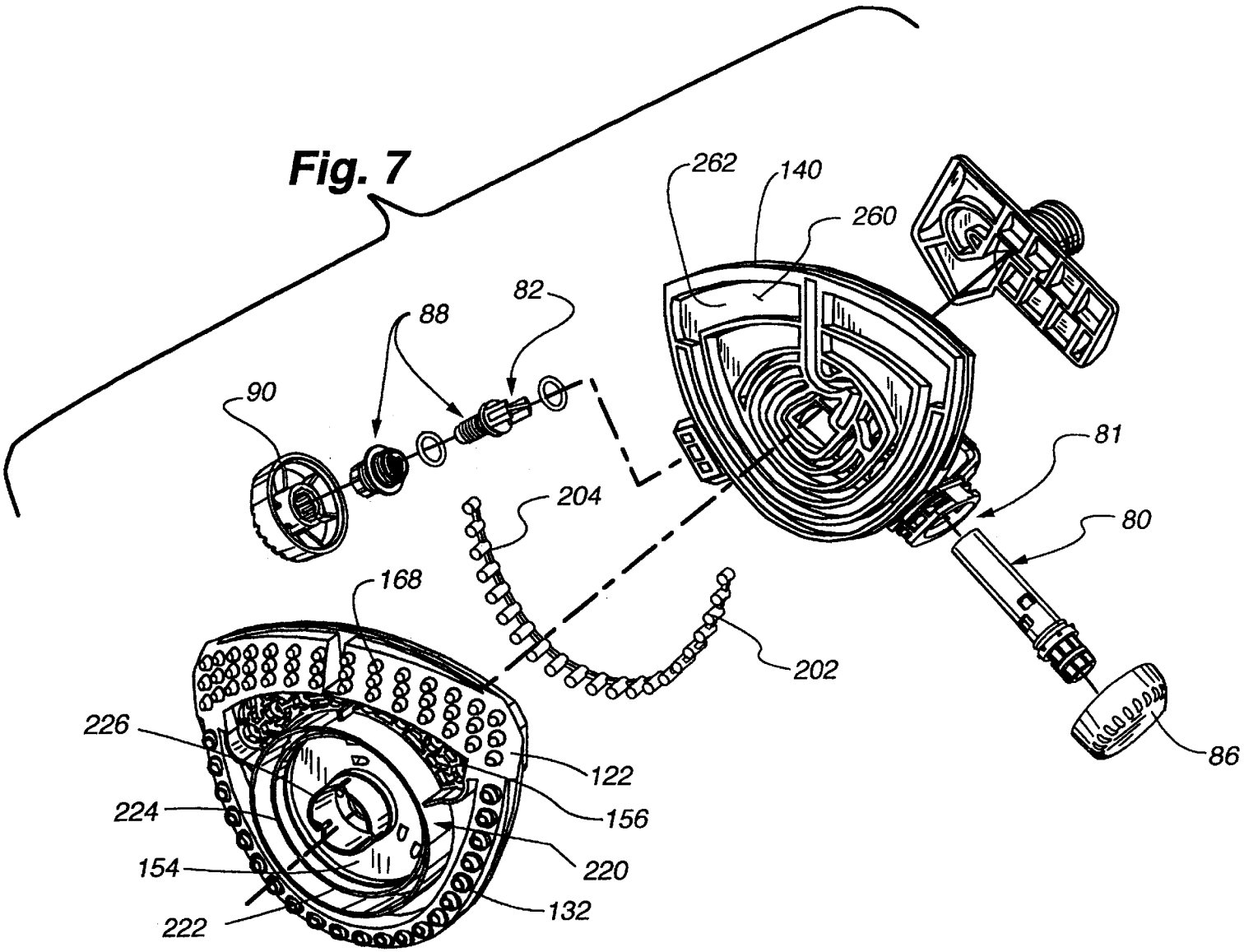
FIG. 7 is an exploded view of the spray head unit utilized in both the wall-mount and hand-held shower heads of the present invention.

The spray head unit 138, as shown in FIG. 7, defines nozzles or apertures on the front side and houses the mode selector 80 and flow control valve 82 on the back side. The spray head unit 138, by the attachment of the front and rear channel plates 122, 140, respectively, creates a housing having the inlet flow path and the outlet flow paths, and contains the flow controller and mode selector. Water outlet flow paths to the spray modes are also defined therein to direct the water from the mode selector to the proper apertures for the desired spray modes. Each water outlet flow path is in fluid communication with the mode selector 80, such that when the mode selector is positioned as desired by the user, water flows from the mode selector, through the appropriate flow path and to the output apertures of the desired spray mode. The front and rear channel plates 122, 140 respectively each define channels such that when attached together form continuous channels that are separate from other channels.

The front channel plate 122 has substantially the same triangular outer profile as the front housing cover 98. The front channel plate forms apertures that mate from behind with the apertures defined in the front housing cover. Each of the normal spray apertures 106 formed in the front channel plate 122 is a protruding nozzle 168, which increases the velocity of the water flowing therethrough. The front of the nozzle extends through the corresponding aperture in the front housing cover and is flush with the front of the faceplate 98. Each nozzle 168 in each column is offset from a line normal to the centerline of the front channel plate 122.

Figure 33A:
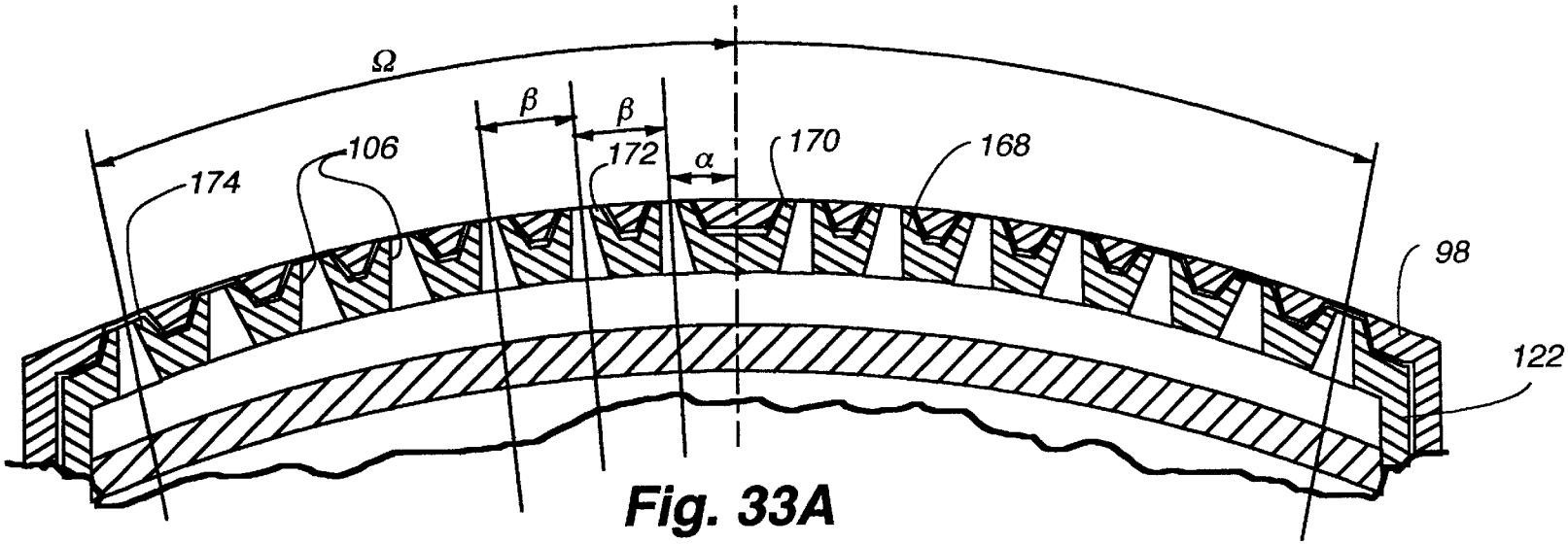
FIG. 33A is a section taken along line 33A—33A of FIG. 3.
Figure 33B:
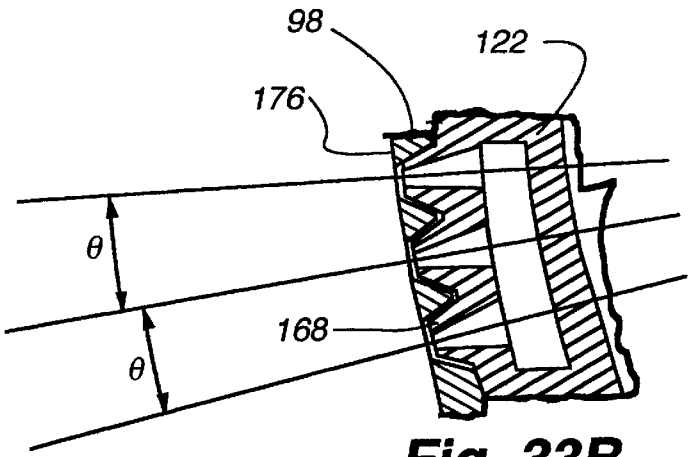
FIG. 33B is a section taken along line 33B—33B of FIG. 3.

Referring to FIG. 33A, the first column 170 on each side of the centerline is offset an angle alpha, preferably 0.75 degrees outwardly. The second column 172 on each side is offset from the first row by an angle beta, preferably 1.5 degrees outwardly, and so on, with the seventh column 174 on each side being offset outwardly by an angle omega, preferably 9.75 degrees. The total angular coverage is thus 19.5 degrees. This is to allow for adequate spray separation and manufacturing ease (to satisfy mold processing limitations). Other degrees of divergence can be used between columns of nozzles, such as 3 degrees. The nozzles 168 also diverge in the vertical direction, with the middle row being normal to the front of the front channel plate 122. See FIG. 33B. The top nozzle 176 is diverted by angle theta, preferably 3 degrees upwardly, and the bottom nozzle 178 is diverted by angle theta also. The outlet port of each nozzle is the same size, preferably 0.050 inches. Due to the vertical and lateral curvature of the front channel plate 122 and the offset of the nozzles, each incoming port of the nozzle 168 is generally an asymmetrical ellipse and has a differing size. The nozzle geometry is a cone which is symmetrical about the axis which defines each individual water stream path.

Each of the mist apertures 132 formed in the front channel plate 122 is a protruding nozzle 180. See FIGS. 7, 23 and 28–30. The mist aperture nozzles 180 in the front channel plate 122 plug into apertures 182 formed in the faceplate. Each mist nozzle 180 has an incoming portion 184, a middle portion 186 and an outlet portion 188. See FIG. 28. The incoming portion 184 on the rear side of the front channel plate 122 for each mist aperture 132 is a cylindrical collar. The incoming portion 184 includes an end wall 190 forming an aperture 192 therethrough, which begins the middle portion 186. The outlet portion 188 is an outwardly-diverging conical rim extending from the middle portion 186.

Each incoming portion 184 has opposed grooves 194 formed longitudinally and linearly along the side wall 196. Each groove 194 continues along the end wall 190 and engages the aperture 192 of the second portion 186 tangentially, and connects circumferentially with the opposing groove 194 to form a circumferential recess 198 around the outlet portion 188. Each groove 194 along the side walls 196 and end wall 190 is preferably approximately 0.030 inches wide and 0.030 inches deep. The diameter of the circumferential area 198 formed by the intersecting grooves around the middle portion aperture 192 is approximately 0.090 inches. The middle portion aperture 192 is substantially cylindrical, and has a diameter in the range of 0.025 to 0.060 inches, and is preferably 0.040 inches. The length of the second portion, which is a cylinder, measured from the base of the circumferential recess 200 formed in the end wall 190 to the beginning of the third portion 188 is preferably about 0.065 inches. This length affects the coarseness of the mist spray. The third portion 188 is a conical portion, and helps disperse the mist evenly as it emerges from the mist apertures 182. The angle of the conical third portion is preferably about 90 degrees or larger to avoid interfering with the spray pattern.

Figure 30:
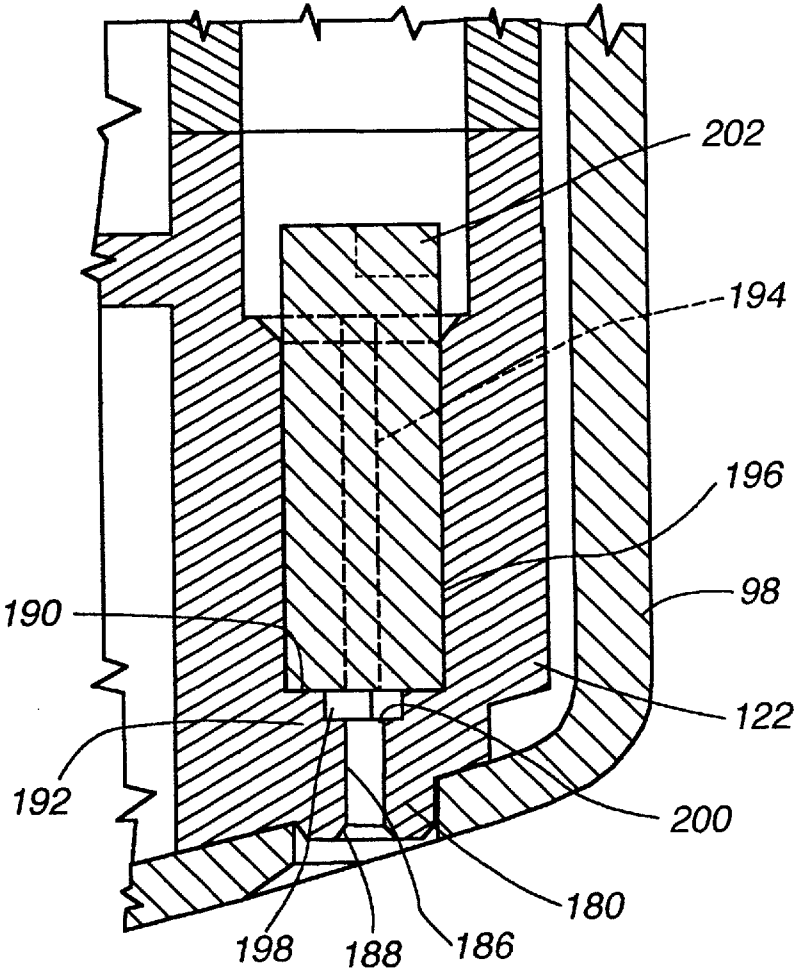
FIG. 30 is a section taken along line 30—30 of FIG. 3.
Figure 29:
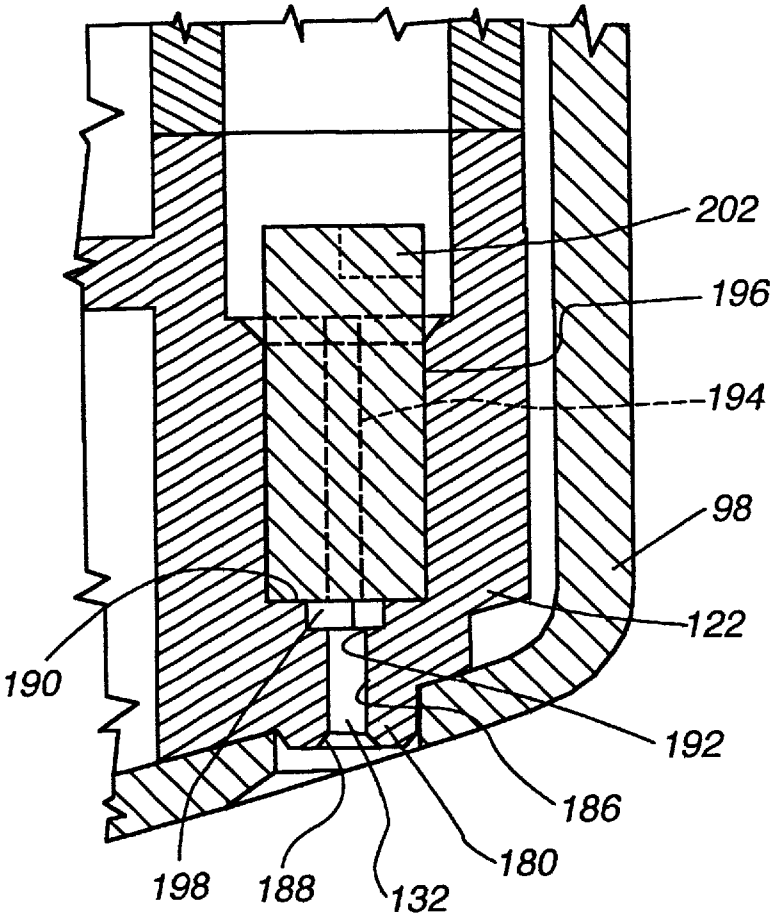
FIG. 29 is a section taken along line 29—29 of FIG. 3.

A plug 202 is inserted into each first portion 184 to leave only the grooves 194 open. See FIGS. 23, 24, 25, 26, 29 and 30. The water is split by the grooves 194 into two strands of high-velocity water. The grooves 194 direct the water to the second portion aperture 192 and almost directly at each other in a swirling manner about the circumferential recess 198 area to create the tiny droplets required for creating a steam effect. The mist is created when the water streams impact one another and flow through the second portion 186. The plugs 202 are polypropylene, and preferably cylindrical to fit into each first portion 184 of the mist apertures 132. A span 204 is formed between each of the plugs 202 to connect them together in a gang. The gang of plugs 202 can be inserted into the mist apertures 132 easily during manufacturing, thus eliminating the inconvenience of inserting individual plugs 202. The size of the plugs 202 decrease from the center of the gang to the end of the gang because the mist nozzles at the lower portion of the U-shape are longer than those at the upper end of the U-shape. This change in length is due to the curvature of the front channel plate 122 of the shower head 72. FIG. 29 shows a shorter plug 202 at the upper end of the U-shape, and FIG. 30 shows a longer plug 202 at the lower portion of the U-shape.

Figure 32:
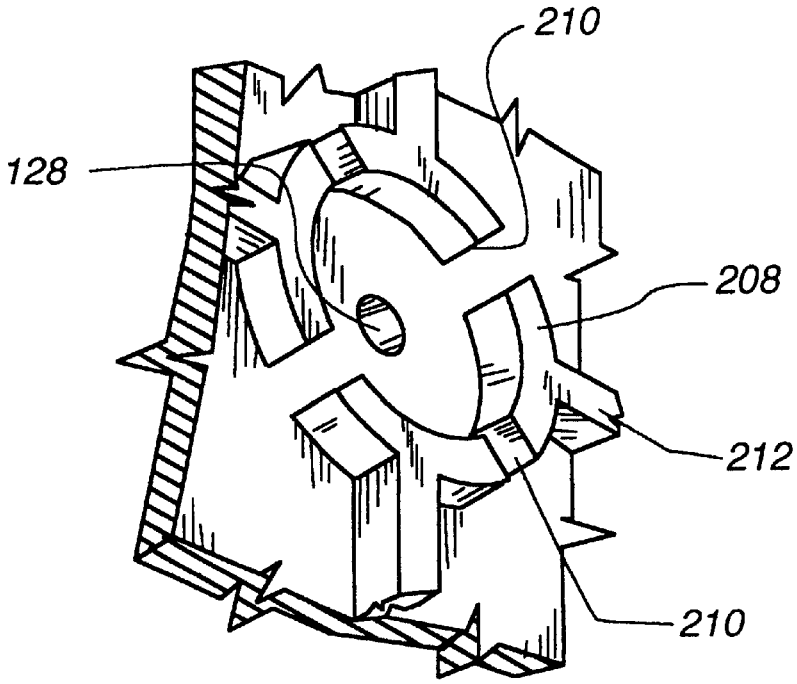
FIG. 32 is an enlarged partial view of the collar on the outside of the spacer insert in the mist structure.
Figure 31:
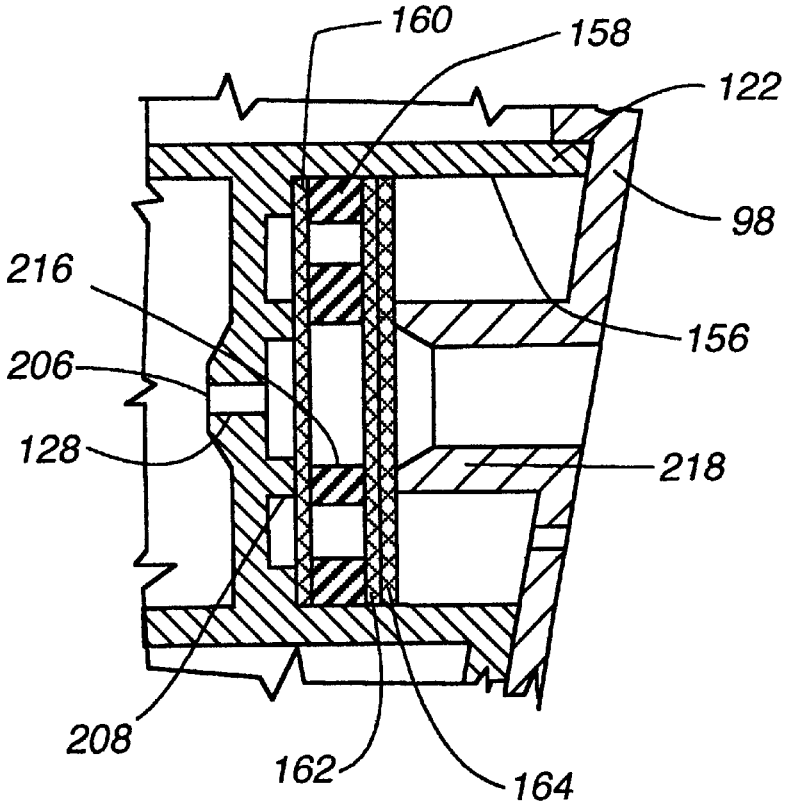
FIG. 31 is a section taken along line 31—31 of FIG. 3, and shows the mist aperture structure.

The champagne apertures 128 are shown in detail in FIGS. 31 and 32, and are positioned in the curved recess 156 formed in the front of the front channel plate 122. The champagne apertures 128 formed in the front channel plate 122 have an inlet port 206 formed by a sloped cylindrical boss. The cylindrical boss allows the length to diameter ratio of the champagne aperture 128 in the front channel plate 122 to be approximately 3:1, which creates the desired fluid velocity under line pressure. A collar 208 surrounds the aperture 128 on the outer surface of the channel plate 122. Each collar 208 has two or preferably four radially spaced notches 210 formed therein to allow air to be incorporated into the water stream, as is described later. The collars 208 are interconnected by support braces 212. The support braces 212 and collars 208 are the same height, and support an aeration screen 160 that extends over the entirety of the curved formed in the front of the front channel plate 122.

A champagne insert 158 is positioned in the recess 156 on top of one aeration screen 160. The thickness of the insert element 158 is between 0.070 inches and 0.170 inches, and is preferably 0.120 inches, to space the screens 162, 164 apart a desired distance. The insert 158 defines apertures 216 that are positioned coextensive to and in alignment with the champagne apertures 128. Two aeration screens 162, 164 are positioned on the insert 158 and abut the collar 218 formed on the back of the front cover housing which surrounds the champagne aperture formed in the front cover housing. The champagne apertures 128 formed in the front housing coextend to and are in alignment with the champagne apertures formed in the front channel plate 122. Small air holes 130 are formed in the front cover housing over the champagne recess 156, preferably between the champagne apertures 128 in the housing cover, to allow air to be entrained in the water flowing through the screens 160, 162, 164. See FIGS. 3 and 5.

The combination of the screens, spacer insert and the notch 210 formed in the collar 208 create the aerated flow required for the desired champagne effect. The water is accelerated through the incoming champagne apertures 128 in the front channel plate 122 and passes to impact the screen 160 to break up the flow. The impact of the water on the screen 160 creates a vacuum, which draws air through the notch 210 and air inlet holes 130 into the water stream. The second screens 162, 164 further break up the flow and further aerate the water exiting the champagne apertures in the faceplate to have the desired aerated quality and form separate aerated ropes.

The center 220 of the front channel plate 122 defines three concentric annular flange rings 222, 224, 226. See FIGS. 5 and 7. A threaded bore 228 is formed in the front channel plate 122 inside the innermost annular flange ring 226 for locating the threaded end of the center retainer 116, which secures the orifice cup 112, through the front housing cover 98, to the front channel plate 122. The inner annular flange wall 230 of the orifice cup 112 sealingly mates with the innermost annular flange ring 226 of the front channel plate 122 to direct water to the center ring of spray apertures 232. The turbine 120 is positioned between the inner and outer flange walls 234 of the orifice cup 112. The outer annular flange wall 234 of the orifice cup 112 sealingly seats against the outermost annular flange ring 222 to form a turbine chamber 236 and to direct water through the turbine 120 to the corresponding pulsating water apertures 118. A chamber 238 is formed between the annular flange rings 222, 224 to allow water to pass to the mid-level spray.

Figure 5:
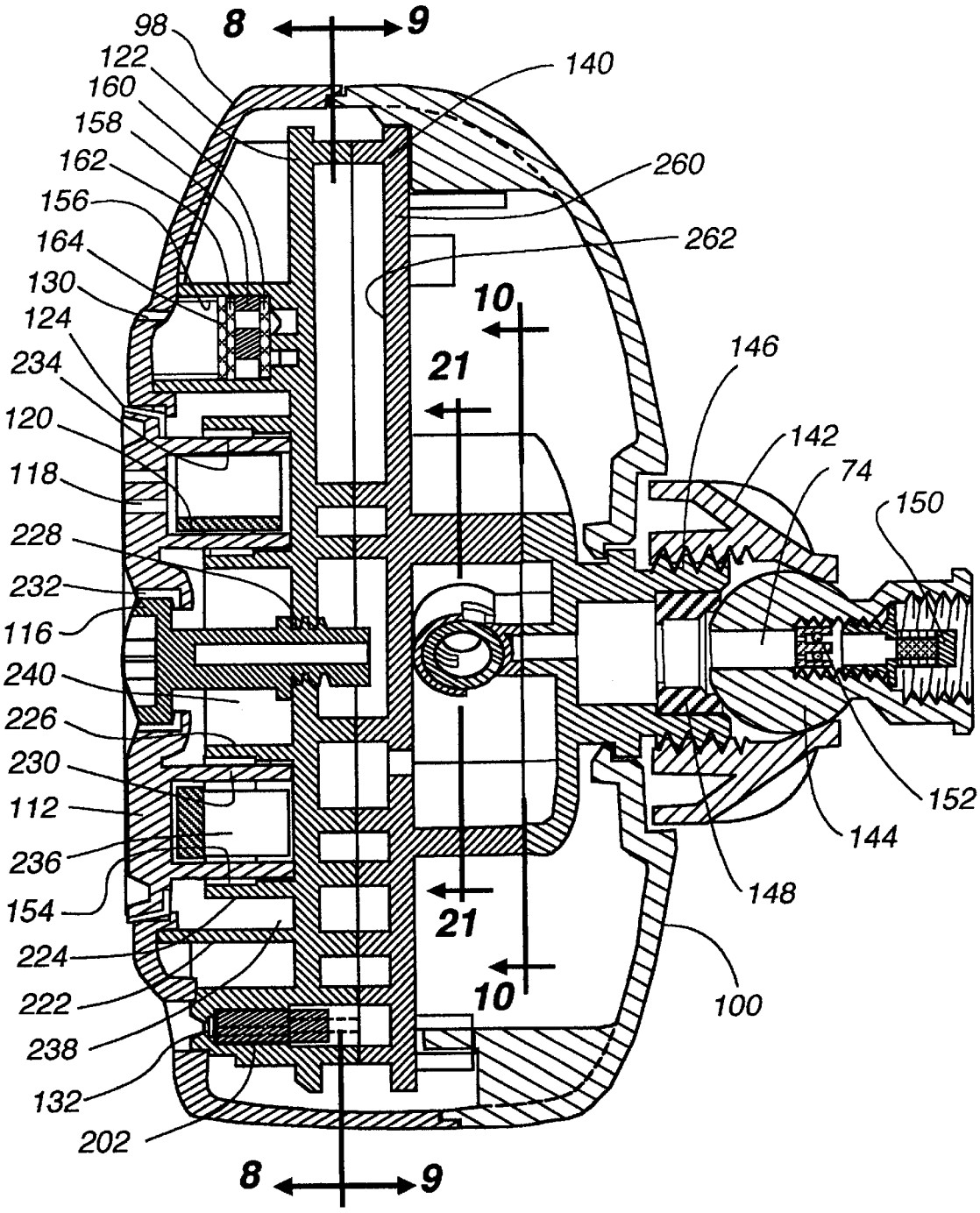
FIG. 5 is a section taken along line 5—5 of FIG. 3.

The orifice cup 112, shown in FIGS. 5 and 6A, show the pulsating flow apertures 118, the central ring apertures 232, and medium flow slots 124 around the outer circumference. The central ring apertures 232 are actually slots formed along a side wall of a central aperture defined in the center of the orifice cup 112. The retainer 116 seals against the open side of the slots to form a channel to direct the water flow around the retainer and through the central ring apertures (slots). The annular flange walls 230, 234 mentioned above are also shown extending from the back side of the orifice cup 112. The medium flow through the slots in the outer circumference of the orifice cup can operate in combination with the flow through the inner ring as determined by the actuation of the mode selector 80.

The front channel plate 122 seats closely behind and adjacent to the rear of the face plate 98, with the various apertures mating with the corresponding apertures in the face plate, as described above.

Figure 8:
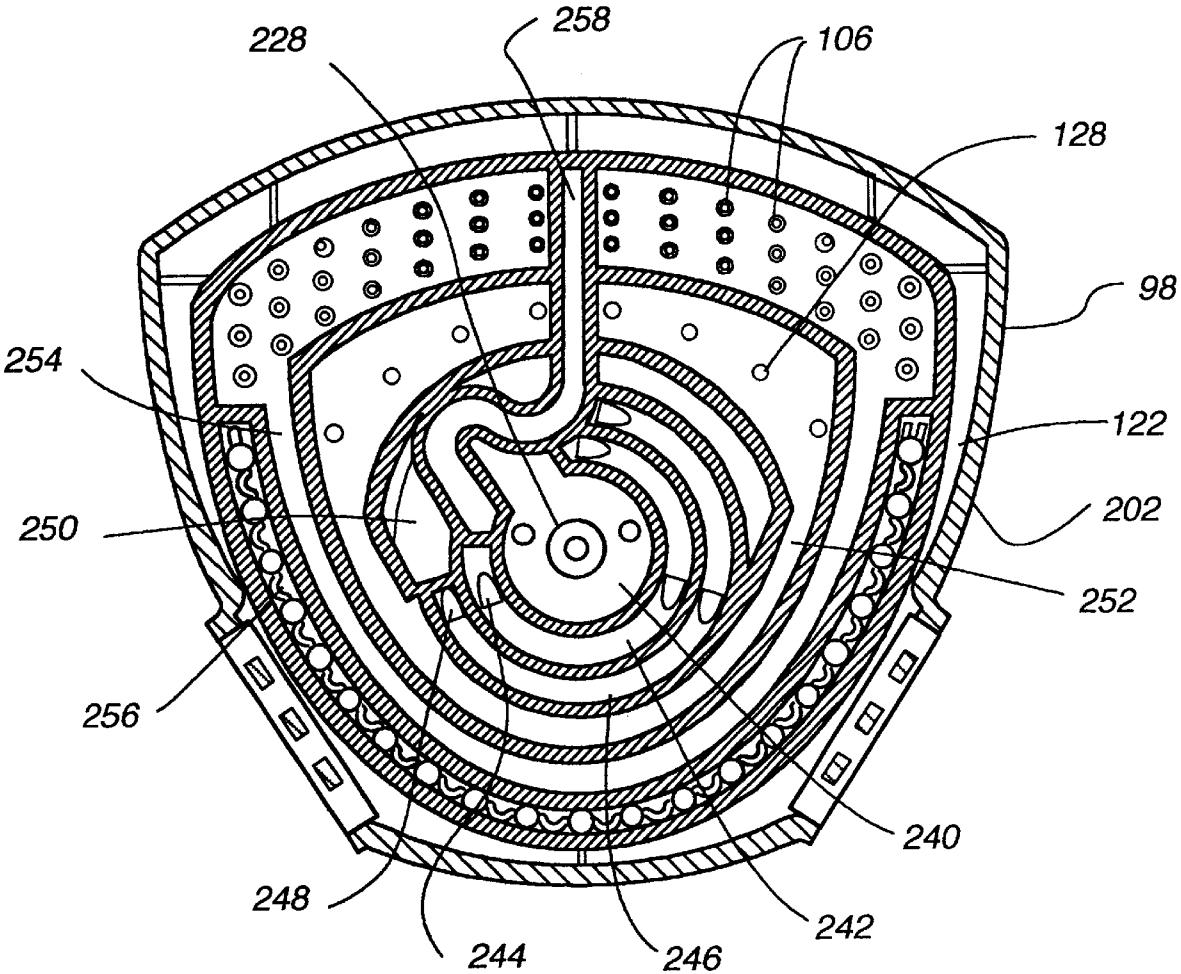
FIG. 8 is a section taken along line 8—8 of FIG. 5.

As seen in FIG. 8, the rear side of the front channel plate forms a plurality of channels, compartments or chambers to direct water from the mode selector 80 to the appropriate spray mode apertures as selected by the user. A first chamber 240 is circular in shape and is the small spray chamber 240. This spray exits around the retainer 116, as described above.

A second chamber 242 concentrically surrounds a majority of the first chamber 240 and is the inner turbine chamber 242. Three apertures 244 are formed in the chamber, each aperture having a flat end and a curved end. Each aperture is angled through the channel plate in order to impact the turbine blade at a substantially right angle. These apertures are positioned relatively close to the center of the turbine and result in the "fast" pulsating flow.

A third chamber 246 concentrically surrounds a majority of the second chamber 242 and is the outer turbine chamber 246. Three apertures 248 similar to those described above are positioned to strike the turbine blades near their ends to cause the turbine to spin slower, to form the "slow" pulsating flow.

A fourth chamber 250 directs water to the medium spray apertures 124.

A fifth compartment 252 is generally U-shaped and partially surrounds the third 246 and fourth chambers 250, and directs water flow through the champagne apertures 128. A sixth 254 is generally U-shaped and surrounds the fifth compartment 250, and directs water flow through the broad band normal spray apertures 106. A seventh compartment 256 is also generally U-shaped and surrounds the sixth compartment 254, and directs water flow through the mist apertures 132. An eighth channel 258 extends upwardly to direct flow through the waterfall slot 134, if one is included. The channels and compartments are formed by walls or ridges extending rearwardly from the front channel plate 122.

Figure 9:
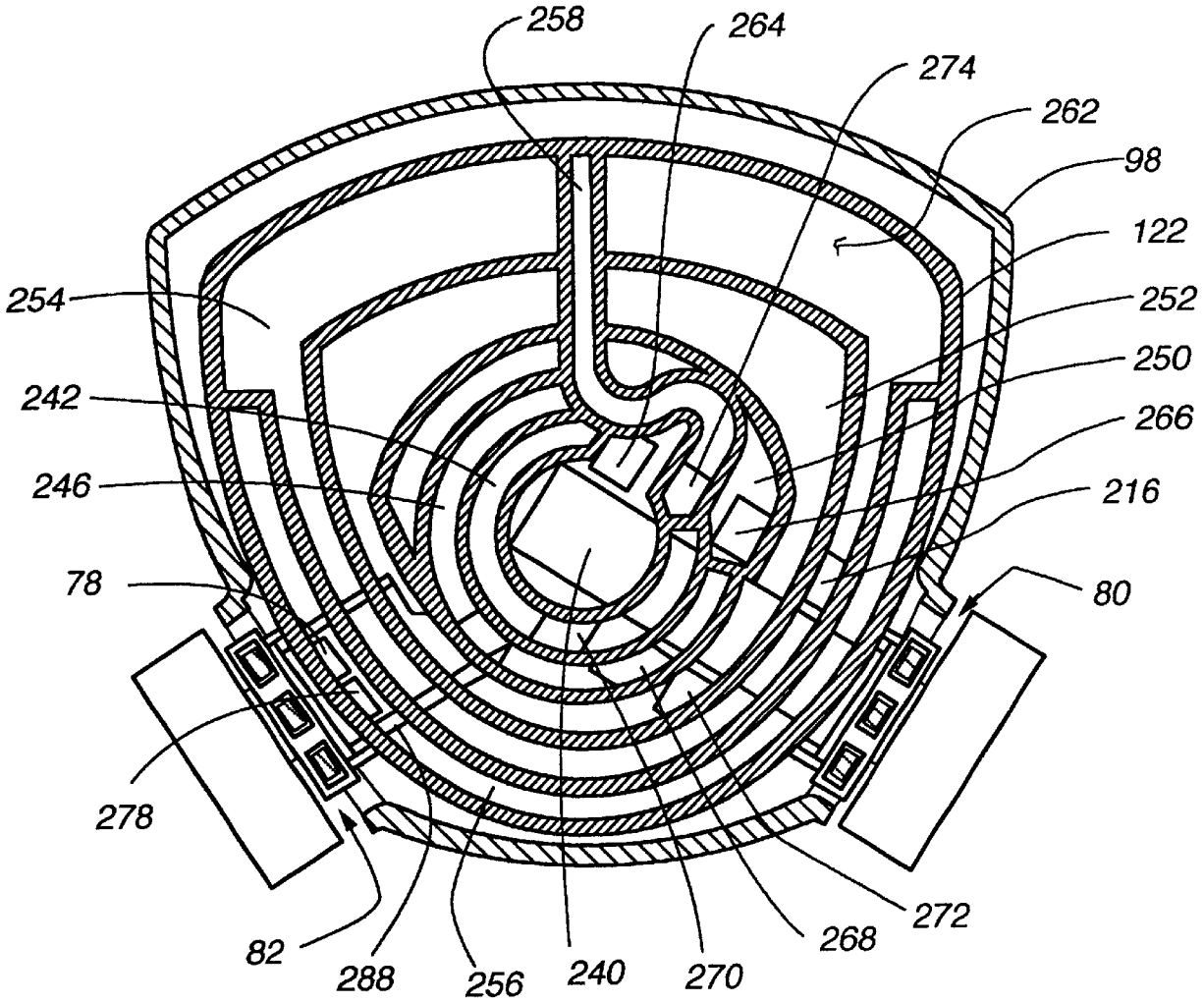
FIG. 9 is a section taken along line 9—9 of FIG. 5.

The rear channel plate 140, as shown in FIGS. 7 and 9, has a main wall 260 defining a front side 262 forming channels and compartments matching the channels and compartments formed on the rear surface of the front channel plate 122. The front channel plate 122 and the rear channel plate 140 are sealingly engaged to direct water flow from the mode selector 80 to the appropriate spray mode aperture. Apertures are formed through the main wall 260 in the rear channel plate 140 into select channels and compartments on the front side 262 of the rear channel plate 140, to allow water from the mode selector 80 to pass through. The apertures are labeled on FIG. 9, and are for the center spray 264, the medium spray 266, the fast and slow turbine pulsed spray 268, 270 respectively, champagne spray 272, waterfall 274, normal band spray 276 and mist spray (from the flow control valve) 278.

The curved channels and uniquely shaped chambers in the spray head unit are made possible by the use of hot-plate welding the front and rear channel plates together. Hot plate welding allows the joining of two surfaces together. The hot plate welding process provides for hermetic seals, long weld lengths, and desired bond strength required for a structure such as the shower head of the present invention. Seals formed by this process are reliably hermetic because the plastic is actually melted and joined together. The weld surface can be as long as is practical, such as for the channels in the spray head unit.

This manufacturing technique allows the shower head to deviate from the traditional circular heads of the past, and provide additional space and channel paths to allow for uniquely shaped spray patterns, such as the U-shaped mist, arcuate champagne, or wide-band normal spray.

The operation of the shower head of the instant invention is controlled by the flow control valve 82 and the mode selector 80, both built into the back of the rear channel plate 140. See FIG. 10. The instant invention incorporates two turn-knobs 86, 90, one for each of the flow control valve 82 and mode selector 80, which activate the functions of the shower head in a manner more convenient than the typical control ring found on conventional shower heads. One turn-knob 86 actuates the mode actuator 80, which allows the user to select any non-mist spray mode. The other turn-knob 90 actuates the flow control valve 82 to allow the user to control the flow rate to the selected mode, activate the mist mode to mix with any existing mode, and transition entirely to the mist mode (and return from mist to the desired non-mist mode).

The turn-knobs 86, 90 are located on the lower sides of the shower head for convenient use. This position minimizes interference of the spray while changing modes compared to a control ring positioned around the circumference of the shower head.

Figure 10:
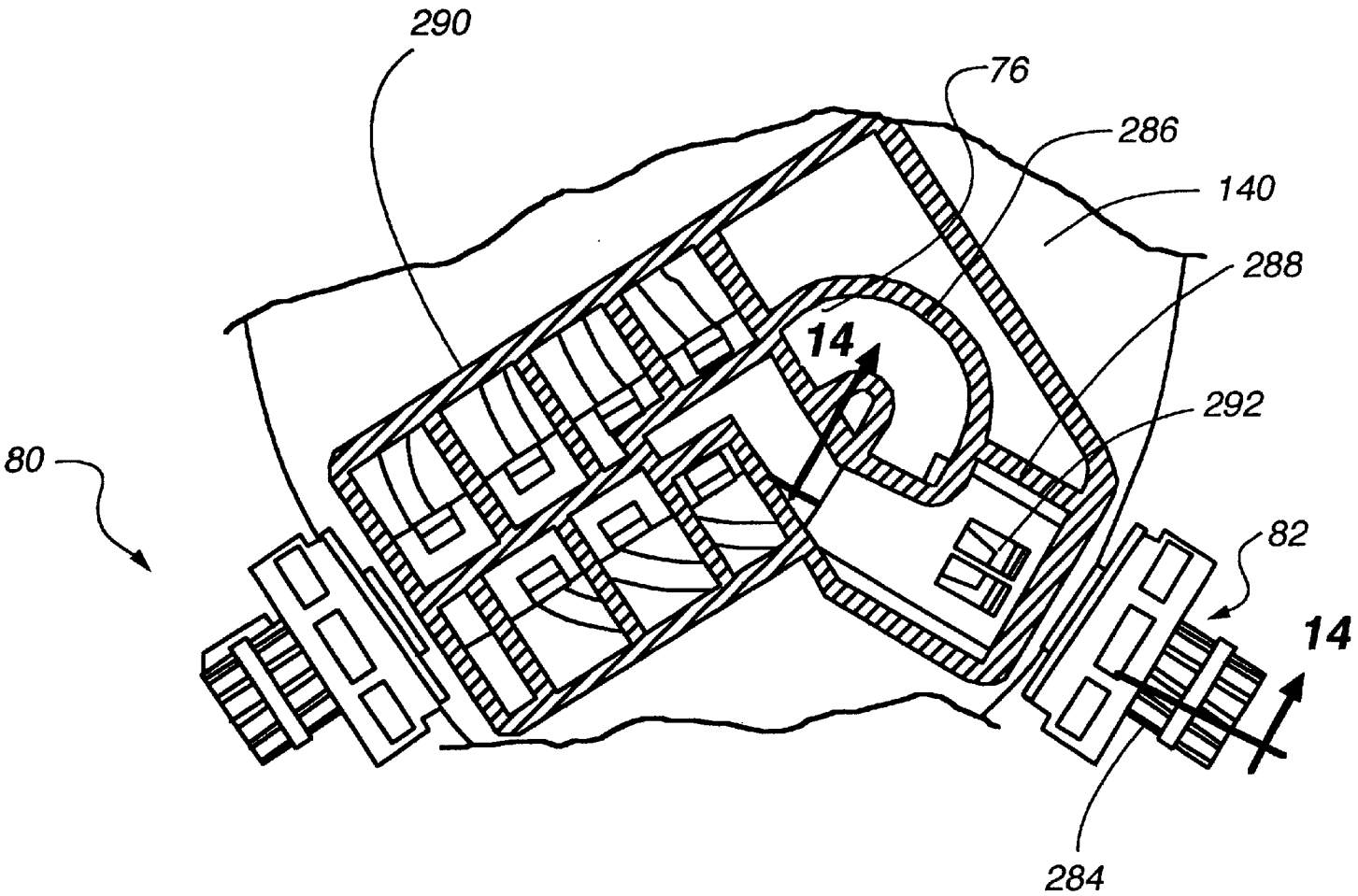
FIG. 10 is a section taken along line 10—10 of FIG. 5.
Figures 11, 12, 13:
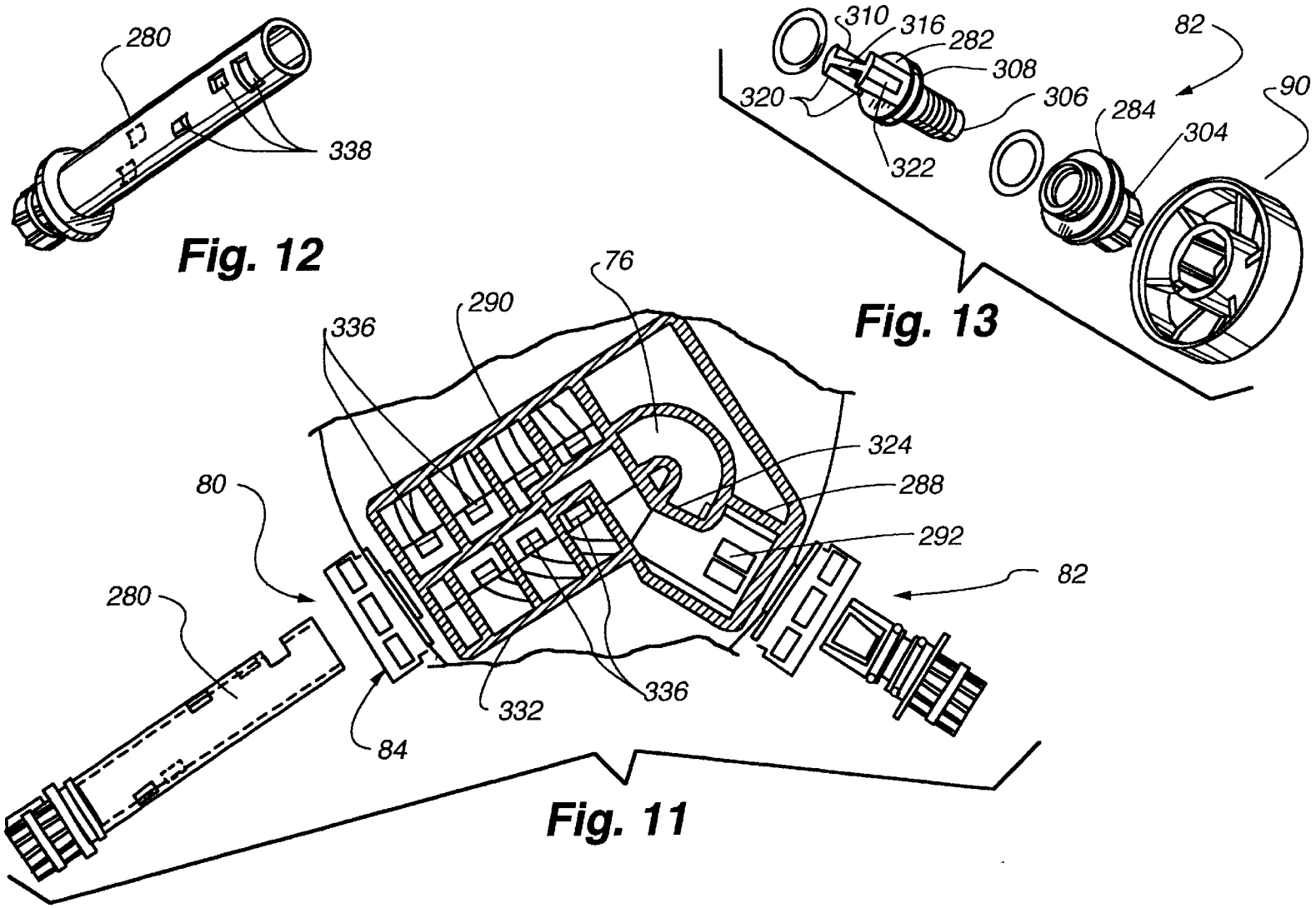
FIG. 11 is similar to FIG. 10 and shows an exploded view of the flow control valve and the mode selector.
FIG. 12 is a perspective view of the spool valve portion of the mode selector.
FIG. 13 is an exploded view of the flow control valve, particularly the shuttle and knob portion.

FIG. 11 shows a partial exploded view of a shower head 72 utilizing the flow control valve 82 and mode selector 80 of the present invention. FIG. 12 shows the spool valve 280 used in the mode selector 80, and FIG. 13 shows the shuttle 282 and knob portion 284 used in the flow control valve 82. Referring to FIG. 10, the flow control valve 82 and the mode selector 80 are contained in an L-shaped housing 286 on the rear face of the rear channel plate 140. The L-shaped housing 286 is divided into two portions, the first portion 288 being for the flow control valve 82, and the second portion 290 being for the mode selector 80. There is a fluid passageway 76 defined between the first and second portions of the housing, with the passage of water therethrough controlled by the flow control valve 82. The first portion 288 also defines an aperture 278 for allowing flow to the chamber in the spray head unit that leads to the mist apertures. The flow control valve 82 controls the flow of water into the first portion 288, and diverts it to the mist apertures, to the mode selector in the second portion, or to a combination of both.

If the water is directed to the mist apertures, the mist spray mode is activated. If the water is directed to the mode selector, then the setting of the mode selector determines the spray mode activated. The water can also be directed to a combination of both the mist mode and the selected spray mode. Basically, water flows through the flow path in the shower head, into the inlet apertures 292 of the first portion of the L-shaped housing to first flow past the flow control valve, then either to the mode selector for dispensing through certain output modes, or through the mist output mode, or both, depending on the position of the flow control valve.

The mode selector (mode actuator) changes the flow to various individual or combinations of output modes, such as normal spray, pulsed, combination of normal and pulsed, champagne-style flow and others. The mode selector is described in greater detail below.

The flow control valve 82 is a combination shuttle valve 282 and knob 284, as shown in FIGS. 14–22. The flow control valve 82 can be operated with one hand, and can be actuated without inadvertently causing the shower head orientation to be altered or interfering with the spray.

Figure 14:
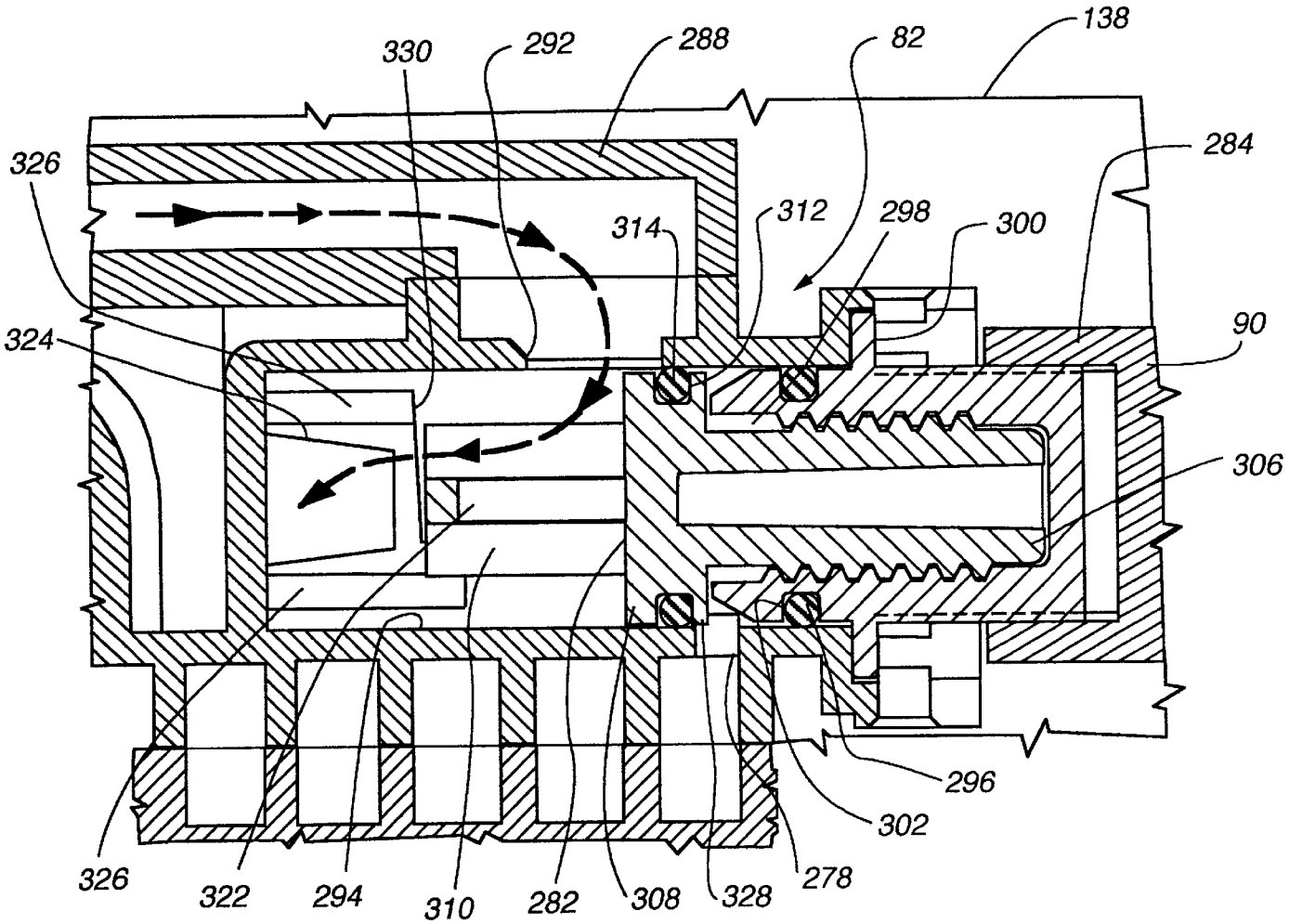
FIG. 14 is a section taken along line 14—14 of FIG. 10, and shows the flow control valve in its outermost position with the diverter diverting water to the mode selector with the flow restrictor in the horizontal position for maximum flow.
Figure 15:
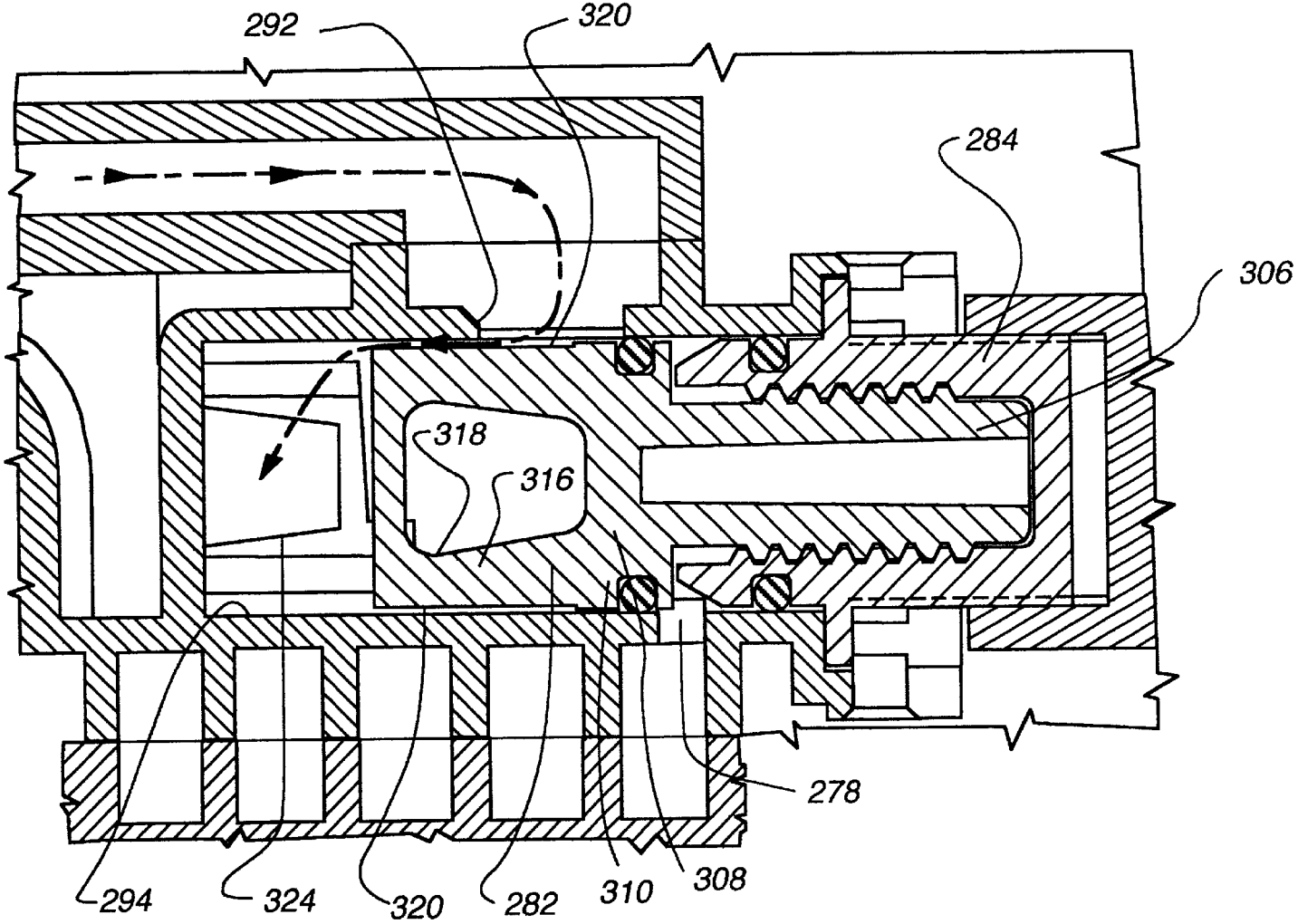
FIG. 15 is a representative section similar to FIG. 14, and shows the flow control valve in its outermost position with the diverter diverting water to the mode selector with the flow restrictor in the vertical position for minimum flow.

The shuttle valve 282, as shown in FIG. 14, is positioned in a recess or chamber 294. The end of the recess is open, but is sealed off when the shuttle valve is inserted therein to keep water from leaking out of the recess. An outer O-ring 296 positioned around the knob 284 seals the chamber 294.

The knob portion 284 has a generally cylindrical body defining a central axial threaded recess 298. An annular flange 300 extends from the outer wall of the knob portion for engagement with the spray head unit 138. An annular groove 302 is formed in the outer surface of the knob portion 284 for receiving the outer O-ring 296. A series of radially spaced, longitudinally extending keys 304 are also formed on the outside wall of the knob portion for receiving the knob cover 90 in a torque-transmitting relationship. The knob cover 90 has corresponding grooves for receiving the keys 304. The knob cover aesthetically covers the knob and, when turned, also turns the knob. The threaded end of the shuttle 282 is threadedly received in the threaded central recess 306 of the knob portion.

The shuttle 282 includes a threaded portion at one end 306, a middle diverting portion 308, and a flow restrictor portion 310 at the end opposite the threaded portion. The shuttle valve 282 is preferably made of a plastic, or other rigid material suitable for use as described herein. The threaded end has approximately 7 flights of continuous threading. The knob portion receives the threaded end of the shuttle. The knob portion is rotationally fixed to the housing 286, so that when it is turned the shuttle threads are engaged and the shuttle moves along the length of the recess. This is the threaded means for moving the shuttle in the chamber.

The threaded post of the shuttle can have a slot formed along its length. There can be one slot formed in the post, or more than one slot, such as diametrically-opposed slots. The slots allow the post to collapse and "slip" on the threads in the knob portion when the shuttle has been moved all the way to one end or the other of the chamber and cannot move any further. At these locations, if the knob is turned the post collapses at the slots and lets the threads slip so as to not damage the threads in the cavity or on the post.

The diverting portion 308 is defined by an annular groove 312 receiving an O-ring 314 therein, and creates a diverting means. The diverting portion moves towards and away from the outer O-ring 296 depending on the direction the knob portion is rotated.

The flow restrictor portion 310 has an I-shaped cross section (see FIG. 13), and extends across the diameter of the shuttle valve 282 in one direction. The intermediate flat portion 316 of the flow restrictor defines an aperture 318. The opposing edges 320 of the flow restrictor form lateral flanges, forming the I-shaped cross section. The lateral flanges 320 are spaced from the wall of the chamber 294 to allow water to flow past when the flanges are adjacent the inlet apertures 292. Each top and bottom edge of the shuttle valve can also form a groove 322 extending along its length to facilitate the flow of water therealong.

The recess or chamber defines an inlet aperture 292 for water, and a first outlet aperture 324 for directing water to the mode selector 80, and a second outlet aperture 278 for directing water to the mist spray mode structure (or any other spray mode structure separated from the spray modes fed by the mode selector). See FIG. 14. As the knob portion is turned, the shuttle is moved axially into or out of (along) the recess in the shower head by the interaction of the threads on the knob portion and the threads on the shuttle. The O-ring 296 on the knob portion seals against a side wall of the shower head in a substantially water-tight manner. As the shuttle 282 is moved from the outer extreme position (FIG. 14) to the inner extreme position (FIG. 20), the diverting section 308 on the shuttle 282 translates along a portion of the length of the chamber to move from separating the water outlet apertures 278, 324 to exposing different amounts of each one for a mixture of flow through modes controlled by the mode selector 80, and the separate spray mode, in this case the mist spray mode. The knob portion 284, in the embodiment described herein, must be turned approximately 5 and one-half turns to move from diverting flow to the mode selector only to diverting flow to the mist mode only. In between there is a combination of flow to the mode selector and to the mist mode, with the majority of flow changing from the mode selector to the mist mode gradually, as described below.

The chamber also defines top and bottom key structures 326 to keep the shuttle valve 282 from rotating as it translates along the chamber 294. The key structures 326 only restrict the shuttle valve 282 from rotating after one-quarter turn, if starting with the shuttle valve all the way out (FIG. 14). From one-quarter turn to the five and one-half turns the shuttle valve only translates along the chamber 294 in the shower head 72 because it is kept from rotating by the key structure 326. From zero to one-quarter turn, the shuttle valve rotates in the chamber to move the flow restrictor from the horizontally-extending position in FIG. 14, which allows maximum flow to the mode selector, to a vertically-extending position in FIG. 15, which allows minimum flow to the mode selector. The shuttle stays in the vertically-extending position, held in place by the key structures, for the rest of the translation along the chamber.

Referring to FIG. 14, the shuttle valve 282 is shown in its outermost position, at the zero turn position. See also FIG. 21. The flow restrictor 310 is horizontally-extending, thereby allowing a maximum flow to the mode selector 80. Since the aperture to the mode selector is at one end of the chamber, and the aperture to the mist mode is at the other end of the chamber, the sealing section of the shuttle, at zero turns, seals against the side wall of the chamber to keep any water from flowing to the mist mode aperture. From here the knob can only be turned in one direction, chosen by the thread orientation of the knob and shuttle valve. The one direction the knob can be turned must actuate the shuttle valve to move it into the chamber, not further out of the chamber. The shuttle valve cannot translate out of the chamber any further due to engagement between the end of knob with the flange 328 forming the seat for receiving the inner O-ring on the shuttle. The shuttle valve 282 cannot translate any further into the chamber without first rotating the flow restrictor to the vertical orientation (see FIG. 15), because of the interference of the flow restrictor with opposing sloped curved side walls 330 formed in the chamber. The sloped side walls 330 encourage the flow restrictor to rotate to the vertically-oriented position.

Between zero turns and one-quarter turn, the flow to the mode selector goes from maximum to minimum, since as the flow restrictor rotates from horizontal to vertical, it cuts off the area of the inlet apertures through which water can flow, thus restricting flow. The flow from the water inlet is what is blocked off, although the flow restrictor could be designed to block-off flow at the aperture leading to the mode selector. This is how the flow pressure regulation to the spray modes controlled by the mode selector is performed. This allows the user to use a non-mist mode (in this example) and have high flow (horizontally-extending restrictor, FIG. 14), low flow (vertically-extending restrictor, FIG. 15), or substantially anywhere in between as desired.

Turning the valve one-quarter of a turn rotates the shuttle valve 282 by being urged to rotate from the horizontal position to the vertical position by the engagement of the opposing edges 320 with the opposing sloped side wall surfaces 330 in the chamber. See FIG. 15. At this point the top and bottom edges 320 of the flow restrictor are engaged by the key structure 326 at the top and bottom of the chamber, respectively. This orientation of flow restrictor allows minimum flow to the mode selector 80. From this point to the innermost position the shuttle valve can only translate along the chamber.

Figure 16:
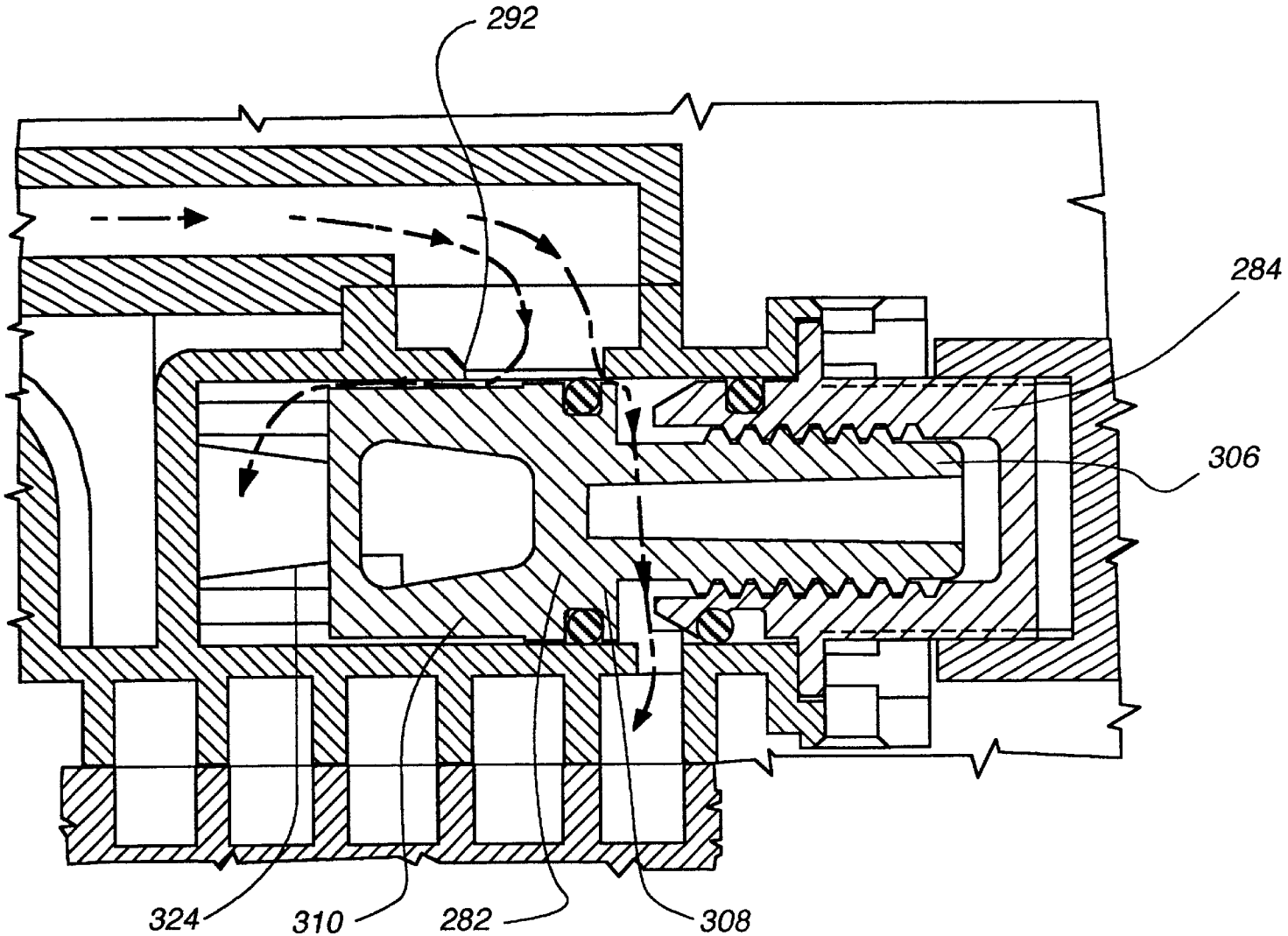
FIG. 16 is a representative section similar to FIG. 15, and shows the diverter in an intermediate position to divert water to both the mode selector and the mist apertures.

FIG. 16 shows the flow control valve 82 after one full turn. The shuttle 282 translates inwardly enough to cause the diverter section 308 to slightly move over the inlet aperture 292 to form a gap allowing some flow to the mist aperture 278. The diverter section 308 begins to pass over the water inlet aperture 292, which creates the gap. At this position there is still flow to the mode selector 80, so two output spray modes are actuated at once. A space is formed between the end of the knob 284 and the flange 328 on the shuttle 282 that holds the O-ring 314, which increases as the shuttle translates inwardly, thus increasing the size of the flow path for water flowing to the mist mode aperture. At this point, however, the water flow to the mist mode aperture is mainly constricted by the size of the gap formed by the diverting section moving over the water inlet aperture 292.

Figure 17:
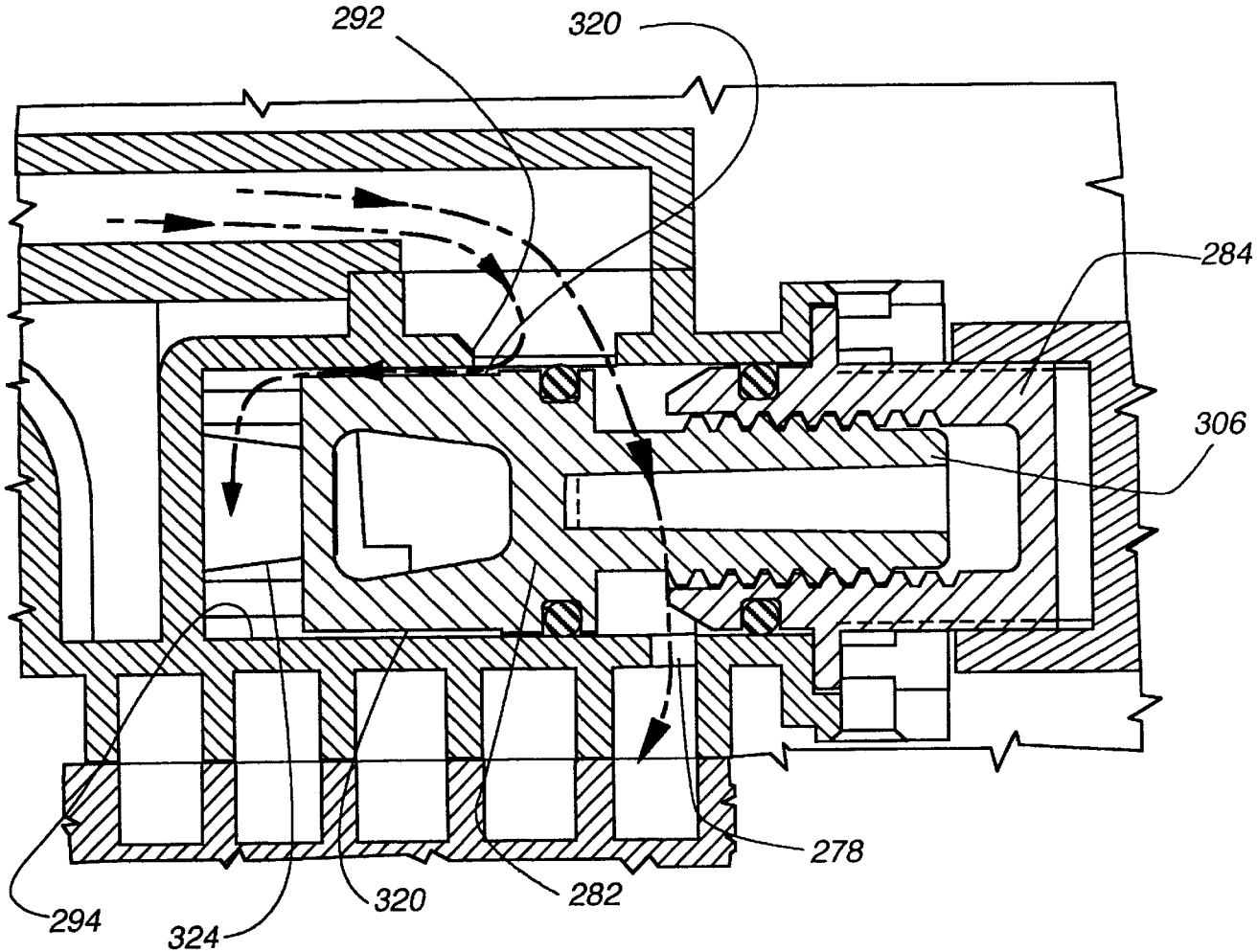
FIG. 17 is a representative section similar to FIG. 16.

FIG. 17 shows the shuttle 282 position after two turns, where the shuttle has translated further inwardly, thus increasing the gap size in the inlet aperture, and allowing more flow to the mist mode aperture while not increasing, and slightly decreasing, the flow to the mode selector.

Figure 18:
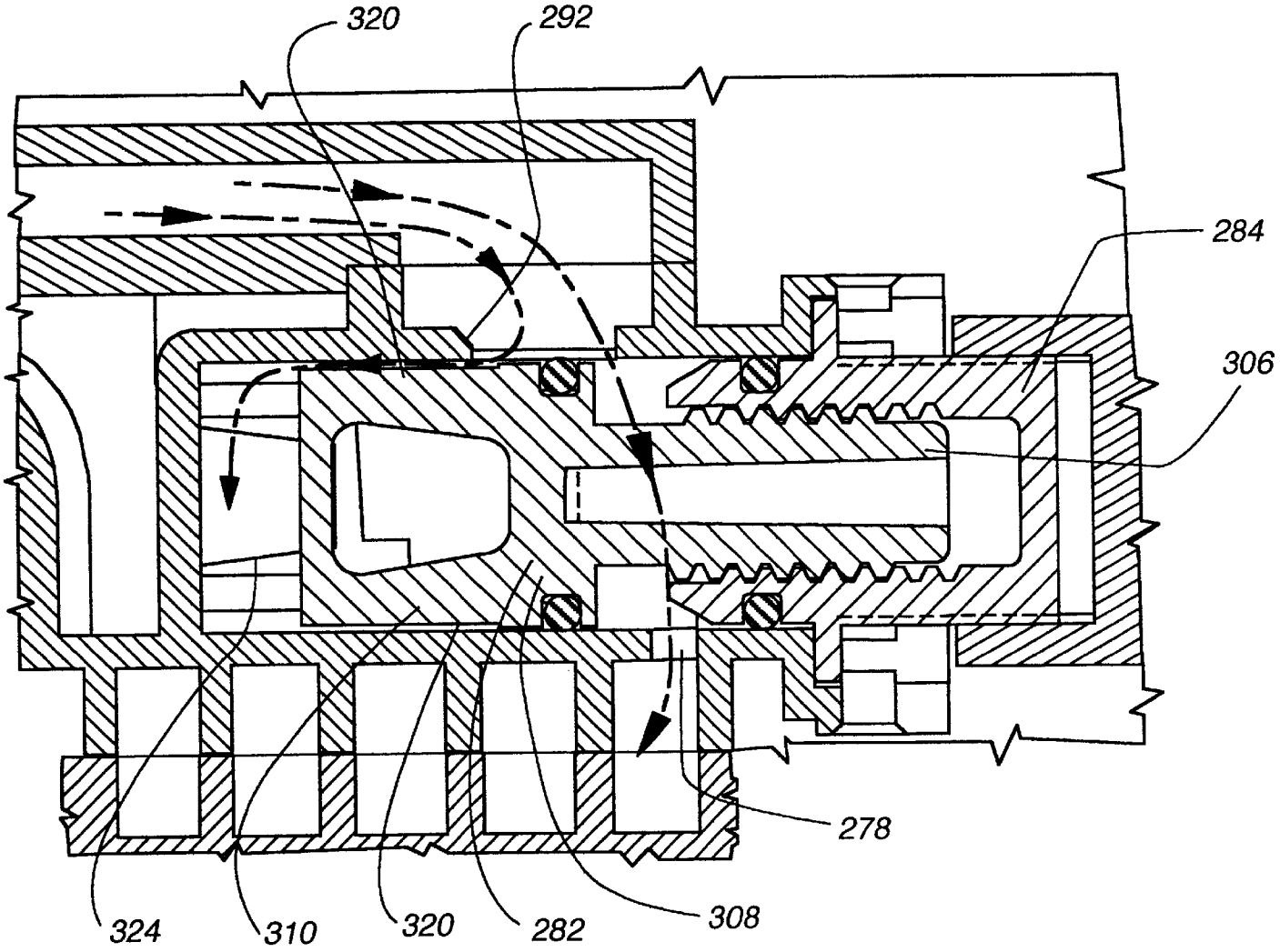
FIG. 18 is a representative section similar to FIG. 17.

FIG. 18 shows the shuttle 282 position after three turns, where the shuttle has translated further inwardly, thus further increasing the gap size in the inlet aperture 292, and allowing more flow to the mist mode aperture 278 while not increasing, and slightly further decreasing, the flow to the mode selector 80.

Figure 19:
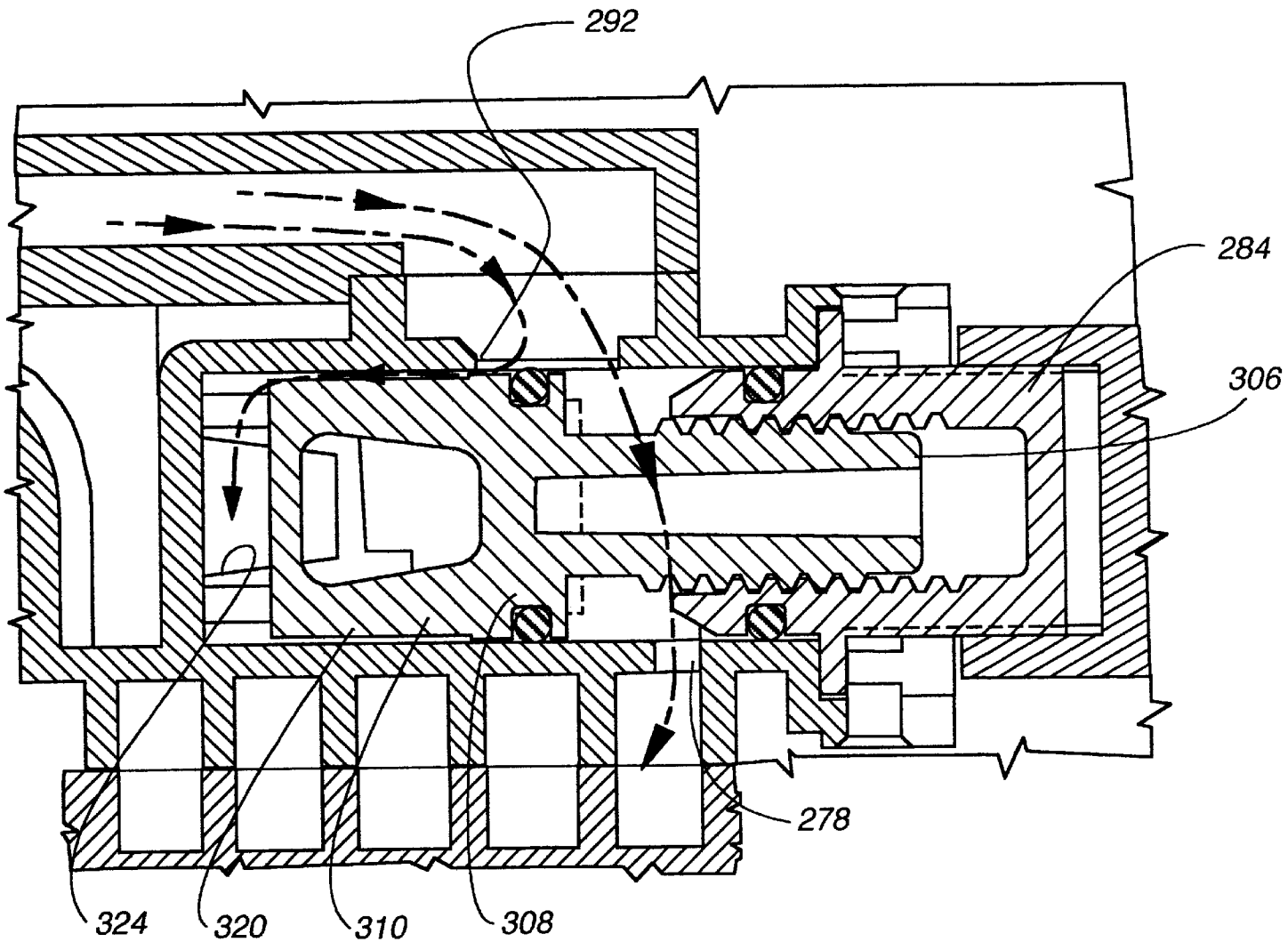
FIG. 19 is a representative section similar to FIG. 18.

FIG. 19 shows the shuttle position after four turns, where the shuttle has translated further inwardly, thus further increasing the gap size in the inlet aperture 292, and allowing more flow to the mist mode aperture 278 while not increasing, and slightly further decreasing, the flow to the mode selector 80.

Figure 20:
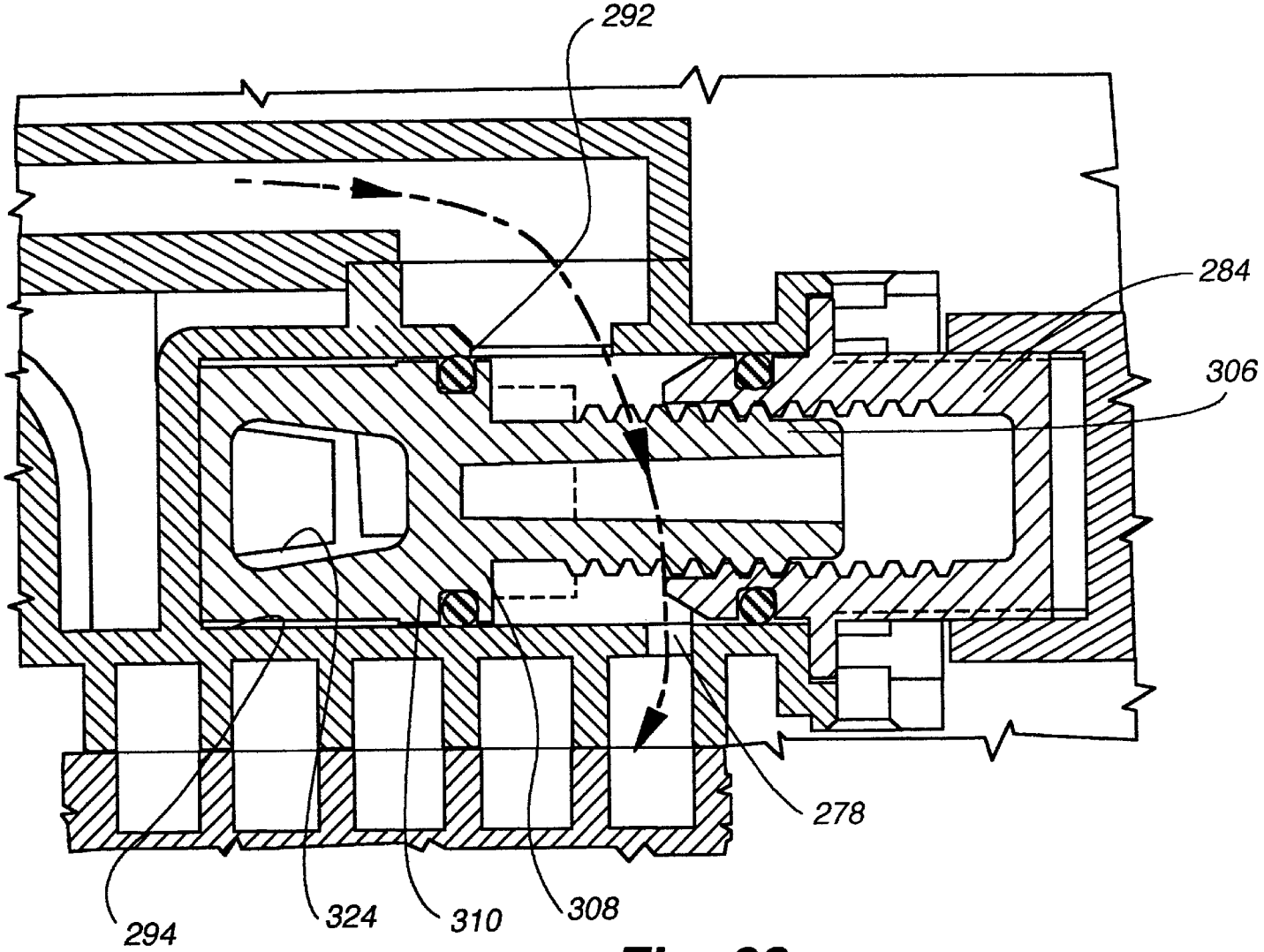
FIG. 20 is a representative section similar to FIG. 19, with the diverter in its innermost position and diverting water to the mist apertures only.
Figure 21:
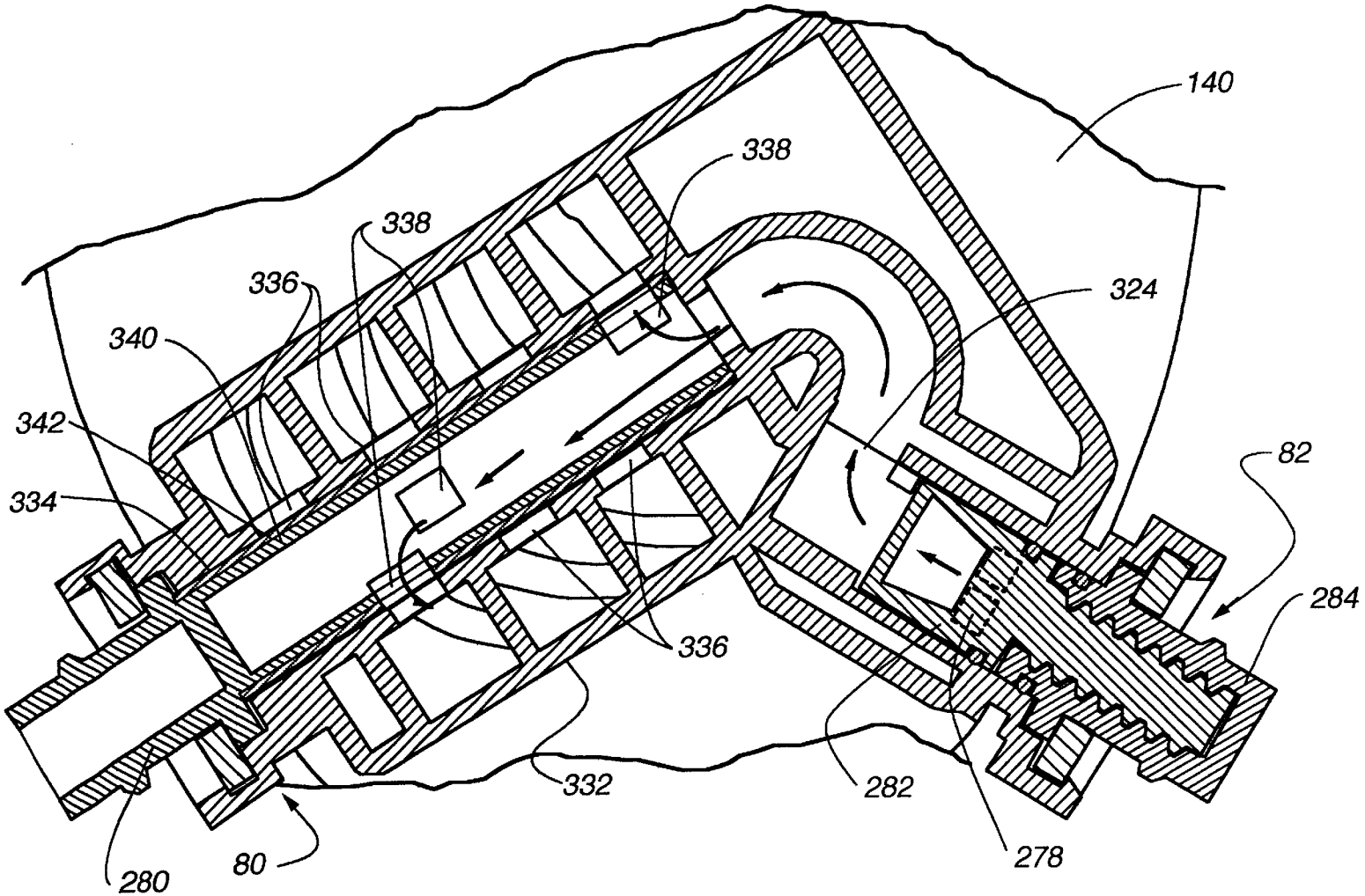
FIG. 21 is a section taken along line 21—21 of FIG. 5, and shows the first outlet flow path from the flow control valve to the mode selector, and the second outlet flow path to the mist mode apertures, with the diverter of the flow control valve in the outermost position to divert water only to the mode selector.
Figure 22:
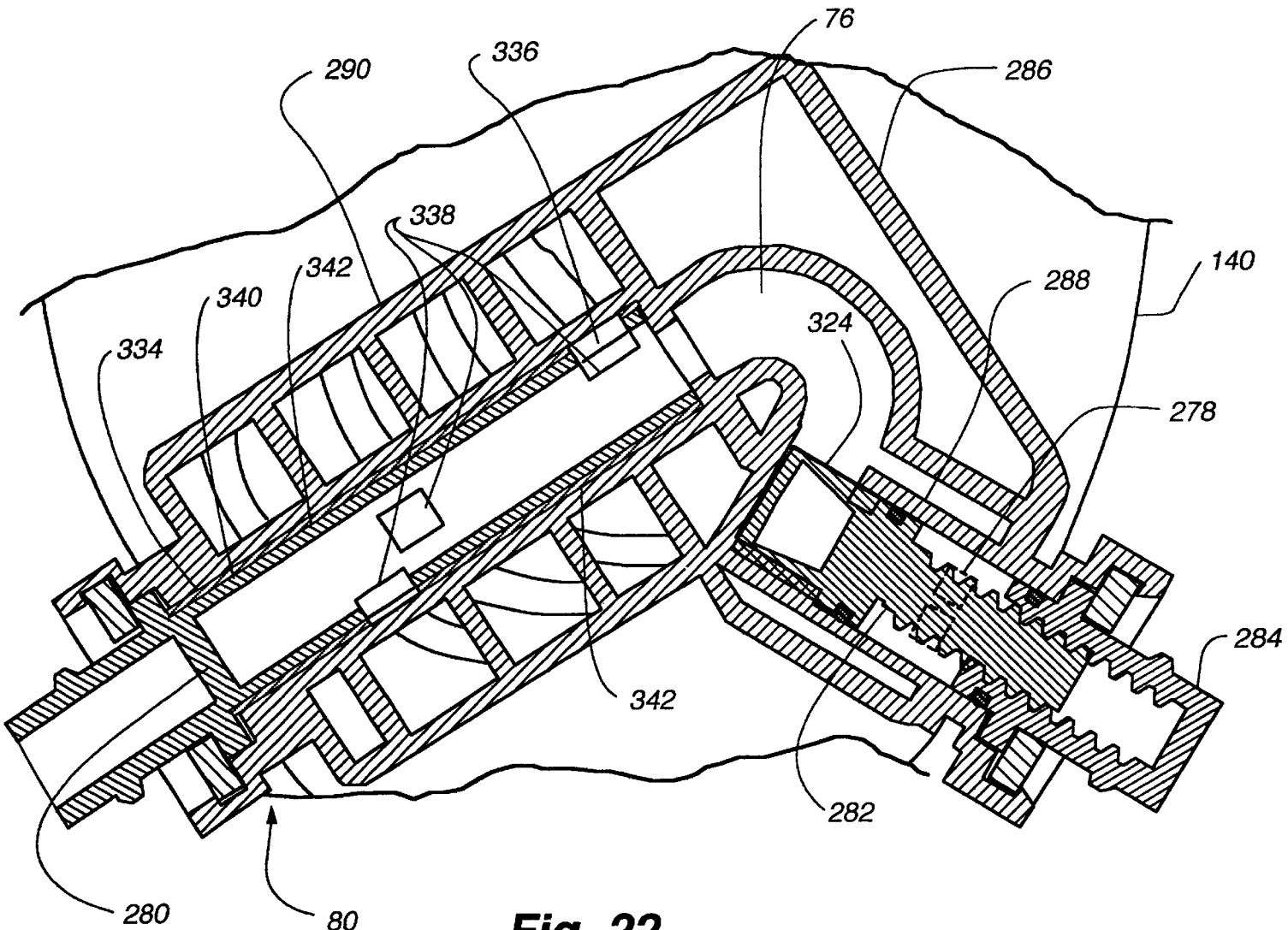
FIG. 22 is a section similar to FIG. 21, and shows the flow control valve in the innermost position to divert flow only to the mist mode apertures.
Figure 24:
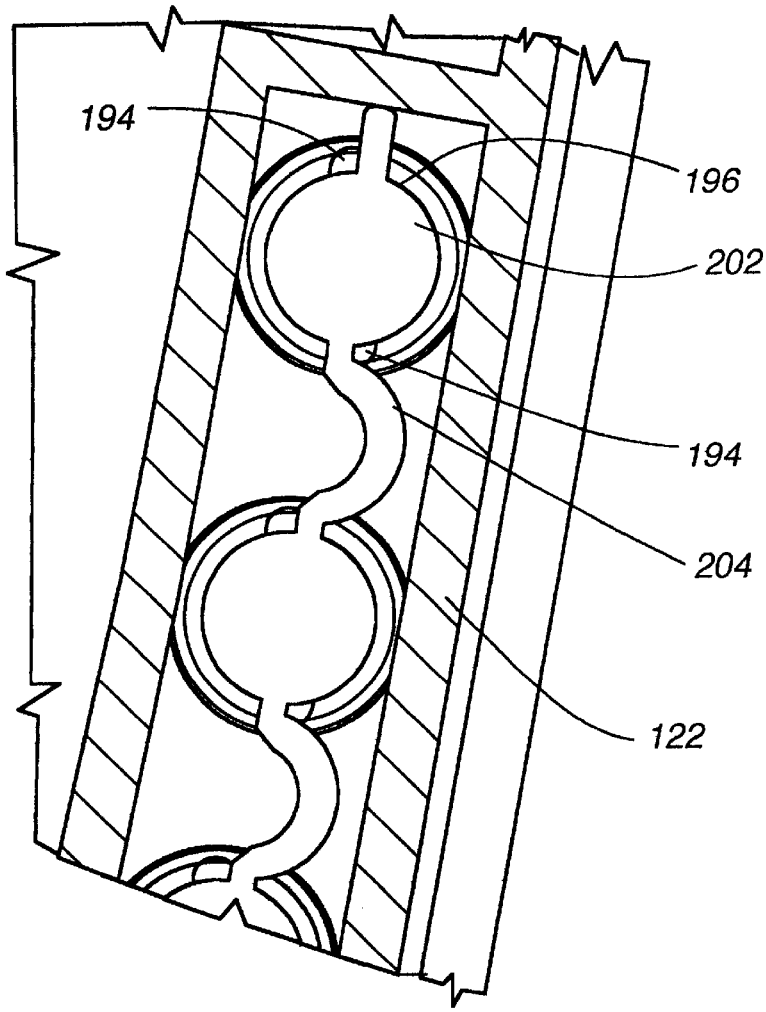
FIG. 24 is a section taken along line 24—24 of FIG. 23.
Figure 23:
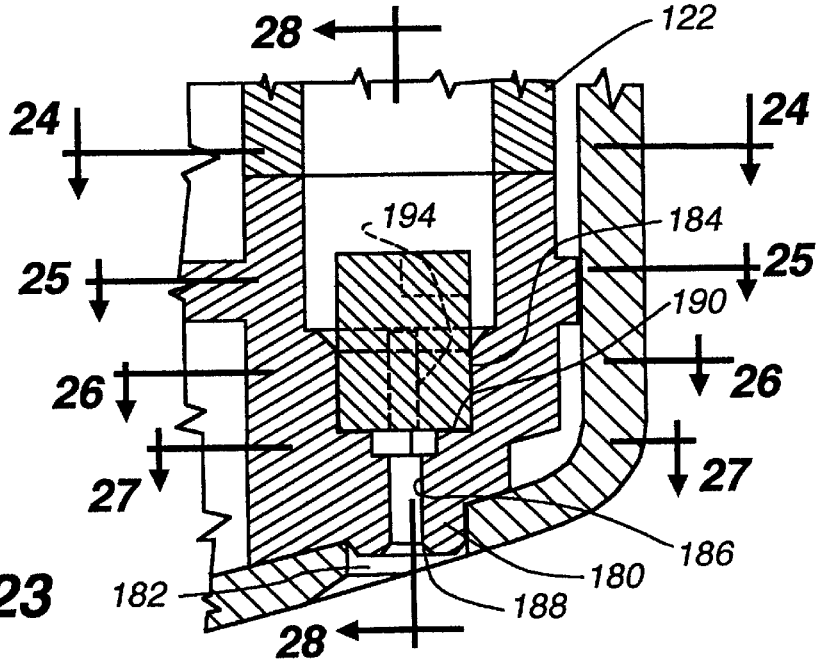
FIG. 23 is a section taken along line 23—23 of FIG. 3, and shows the mist aperture structure.
Figure 25:
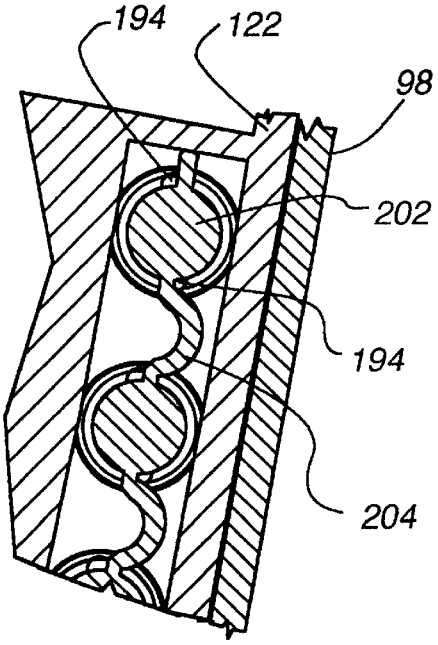
FIG. 25 is a section taken along line 25—25 of FIG. 23.
Figure 26:
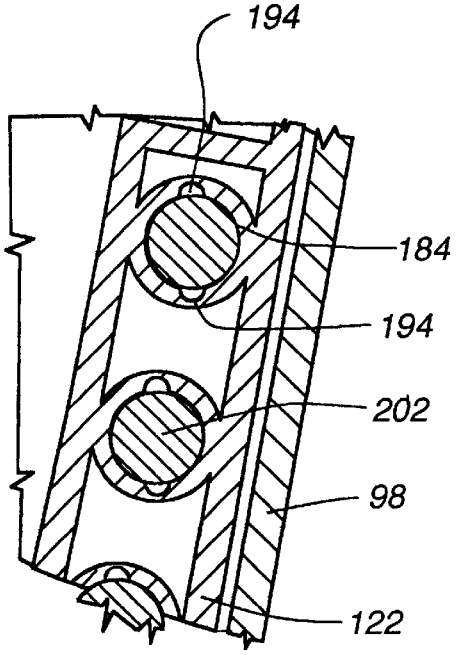
FIG. 26 is a section taken along line 26—26 of FIG. 23.
Figure 27:
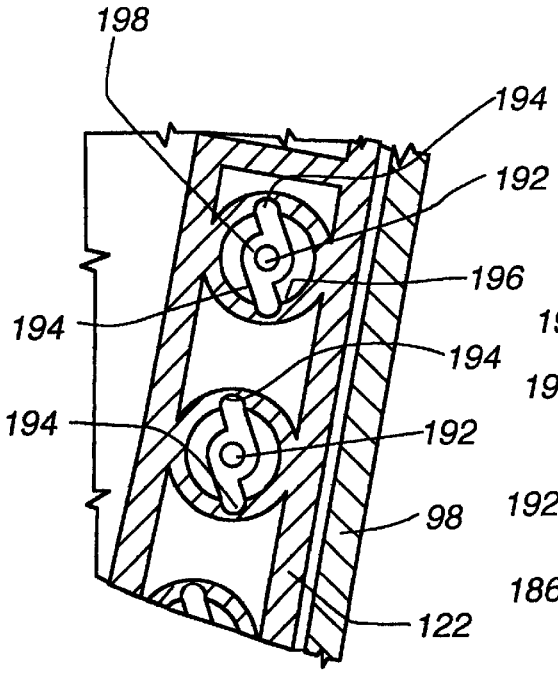
FIG. 27 is a section taken along line 27—27 of FIG. 23.
Figure 28:
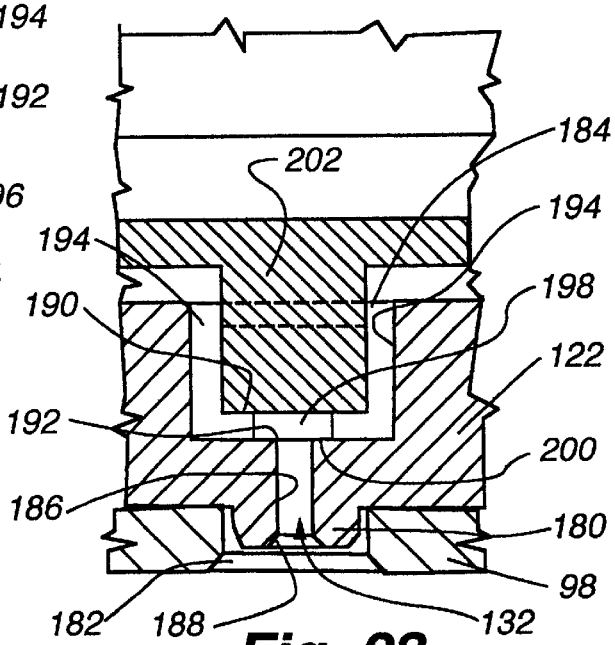
FIG. 28 is a section taken along line 28—28 of FIG. 23.

FIG. 20 shows the shuttle position after five turns, where the shuttle 282 has translated further inwardly to a point where the diverting section 308 of the shuttle has passed over the entire inlet aperture 202 and again contacts the side wall and blocks all flow to the outlet aperture 324 to the mode selector, and directs all flow to the mist mode aperture 278. The gap size in the inlet aperture 292 has been increased to a maximum dimension to allow the maximum amount of flow to the mist mode aperture 278 and shutting off the flow to the mode selector. See also FIG. 22, showing the shuttle valve 282 moved inwardly and entirely blocking the water from flowing to the aperture 324 leading to the mode actuator 80.

In returning from 100% mist spray to 100% spray through the mode controlled by the mode selector, the user turns the knob approximately five times in the opposite direction to translate the shuttle in the opposite direction in the chamber. The shuttle 292 moves back to the outermost position, changing the flow gradually in reverse order through the stages described above. This gradual change allows the user to finely tune the amount of mist (or separated spray mode), the amount of mixed spray modes, and the flow rate to the desired levels.

The first quarter turn of the flow diverter from the outermost position moves the flow diverter from the horizontal position to the vertical position in the chamber. This is a result of the opposing edges of the flow diverter engaging the opposing sloped side wall surfaces 330. Each opposing edge of the flow diverter engages one of the sloped surfaces. Each of the sloped surfaces 330 slopes away from the opposing respective edge in the direction the opposing edge moves when the shuttle 292 is rotated. For example, referring to FIG. 21, the sloped surface engaging the right hand edge of the diverter slopes up and away from the opposing edge of the diverter along the well of the chamber, and the curved surface engaging the left hand of the diverter slopes down and away from the left edge of the diverter along the side wall of the chamber. When the shuttle is moved along the chamber, the edges 320 of the diverter engage the respective curved surface 330 and are urged to rotate from the horizontal to the vertical position. The key engages the sides of the edges 320 to keep the diverter from rotating.

This flow control valve has at least two unique features different from the existing technology. First, the moving member is a spool valve that routes fluids from an inlet port to any number of individual or any combination of fluid outlet ports. Second, the moving member has a soft sealing member bonded to the inner, rigid spool. This allows for a valve device that routs fluid to any number of exit ports that has only two parts. This structure allows adjustment of the mode selector without interfering with the flow of water from the shower head while actuating the mode selector.

The water flowing from the flow control valve 82 through the mode selector aperture is channeled to the mode selector 80. See FIG. 21. The mode selector 80 is actuated by the user to select the desired spray mode, such as normal, pulsed, champagne, small, or medium sprays, a combination of those or others designed into the shower head 72. The mode selector 80 is a manifold 332 in combination with a valve assembly (spool valve) 280. See FIGS. 11 and 12. The manifold 332 has a tubular recess 334 formed therein for receiving the cylindrical spool valve 280. Several mode apertures 336 are formed in the walls of the tubular recess 334. The apertures 336 each lead to a channel or chamber in the front of the spray head unit 138 to actuate different spray modes. FIG. 9 shows the apertures opening into the chambers in the spray head. More than one spray mode can be actuated at a time. See FIGS. 21 and 22.

The spool valve 280 defines a plurality of outlet apertures 338 in its outer wall, the outlet apertures 338 each aligning at least with one mode aperture 336. The outlet apertures 338 can be formed on the spool valve 280 so as to have only one mode aperture 336 aligned with one outlet aperture 338 at a time. The outlet apertures 338 can also be formed on the spool valve 280 so as to have more than one mode and outlet apertures aligned at a time for combination sprays modes.

The spool valve 280 has a hollow tube inner core 340 constructed of a rigid material. This tube 340 is sealed on one end. In a secondary operation a compliant elastomeric material is molded to the core tube 340 and forms an outer surface thereon 342. The core and elastomeric material bond to each other creating a spool valve assembly with a soft compliant sealing surface 342. The outlet apertures 338 are formed through the walls 340, 342 of the spool valve. The cylindrical spool valve assembly 280 is located in the tubular recess 334 of the manifold 332.

During normal use, the fluid is channeled to the inside of the spool valve 280 assembly through the flow control valve 82 as described above. The valve assembly 280 is rotated such that the openings along the length of the spool valve assembly 338 align with mode apertures 336 (openings within the housing) and allow fluid flow out of those openings. The compliant material on the spool valve seals against the wall of the tubular recess 334 in the manifold 332 so that water only flows into the mode aperture 336 aligned with an outlet aperture 338 in the spool valve 280.

The water initially flows from the flow control valve 82 to the mode selector 80. The water is then channeled into the inside of the spool valve through the open end. The water then flows through the spool valve 280 to the outlet aperture 338 aligned with a mode aperture 336, and flows out of the outlet aperture 338, through the mode aperture 336, and on to the outlet spray mode as selected by the user.

An end of the spool valve 280 opposite the open end extends from the shower head housing, or is accessible to the user by an extension or knob, and can be rotated by the user to align the desired outlet apertures in the spool 338 with the corresponding mode apertures to actuate the desired spray modes.

The knob 90 for the flow control extends from one lower side of the shower head, and the knob 86 for the mode selector extends from the other lower side of the shower head for easy access by the users with a minimized occurrence of re-orientation of the shower head due to actuation of either one of the knobs.

Figure 34:
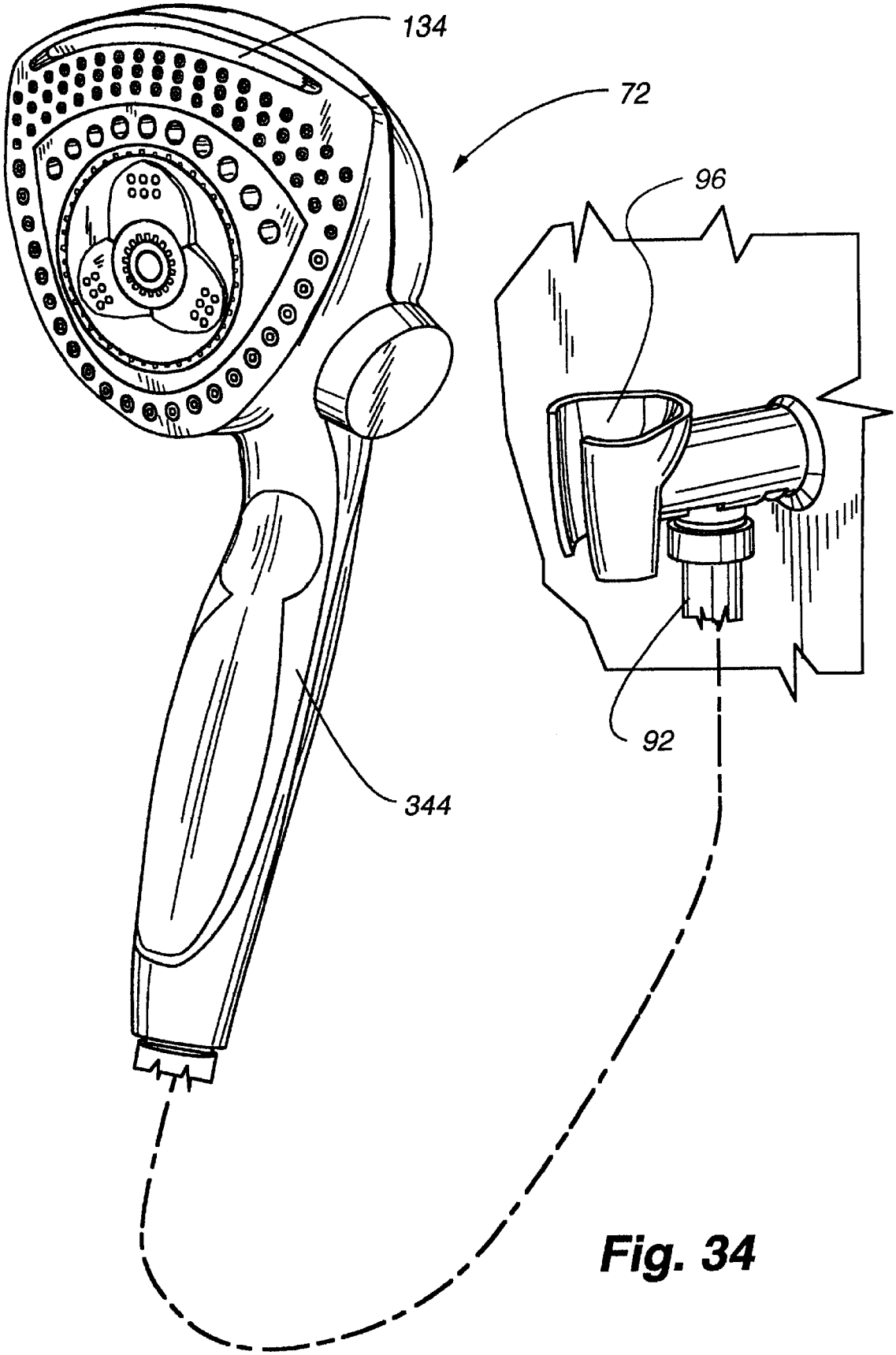
FIG. 34 is a perspective view of the hand-held shower head and the associated bracket, which incorporates the vacuum breaker.

The shower head 72 can be embodied in a hand-held shower device also. FIGS. 2 and 34 show the hand held embodiment. The working structure of the shower head in this embodiment is substantially the same as that described above, with the following changes. The base cone and rear housing are not used, and instead the handle housing 344, the wall mount 96, and the vacuum breaker assembly 346 (shown in FIGS. 41, 42 and 43) are used.

In the hand-held embodiment, a wall bracket is available to mount to the shower pipe and support the hand-held shower head in a cradle shaped to conform to the downwardly extending handle portion. A water hose 92 extends from the bracket to the handle.

Figure 35:
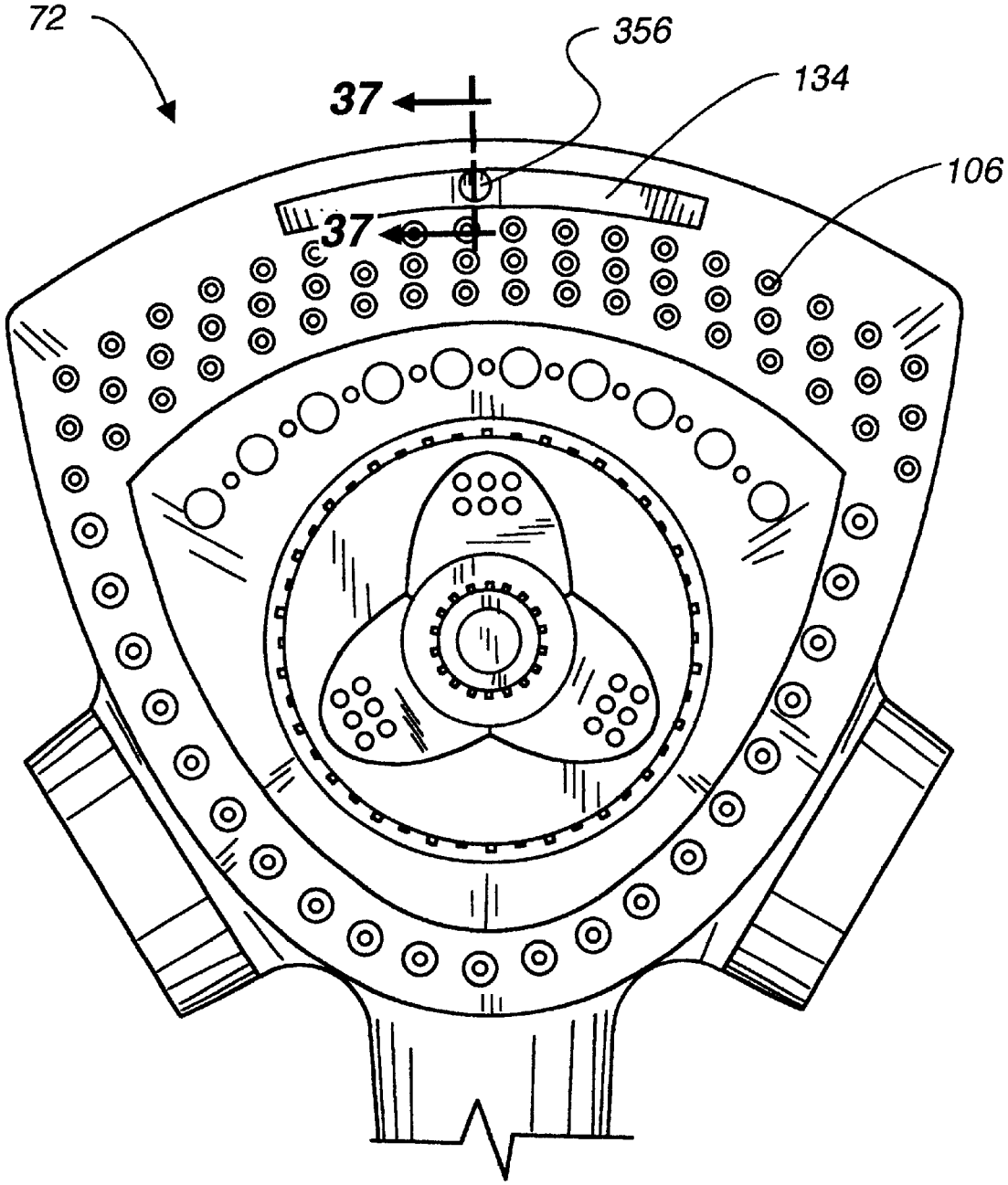
FIG. 35 is a front view of the hand-held shower head and shows the waterfall slot.
Figure 36:
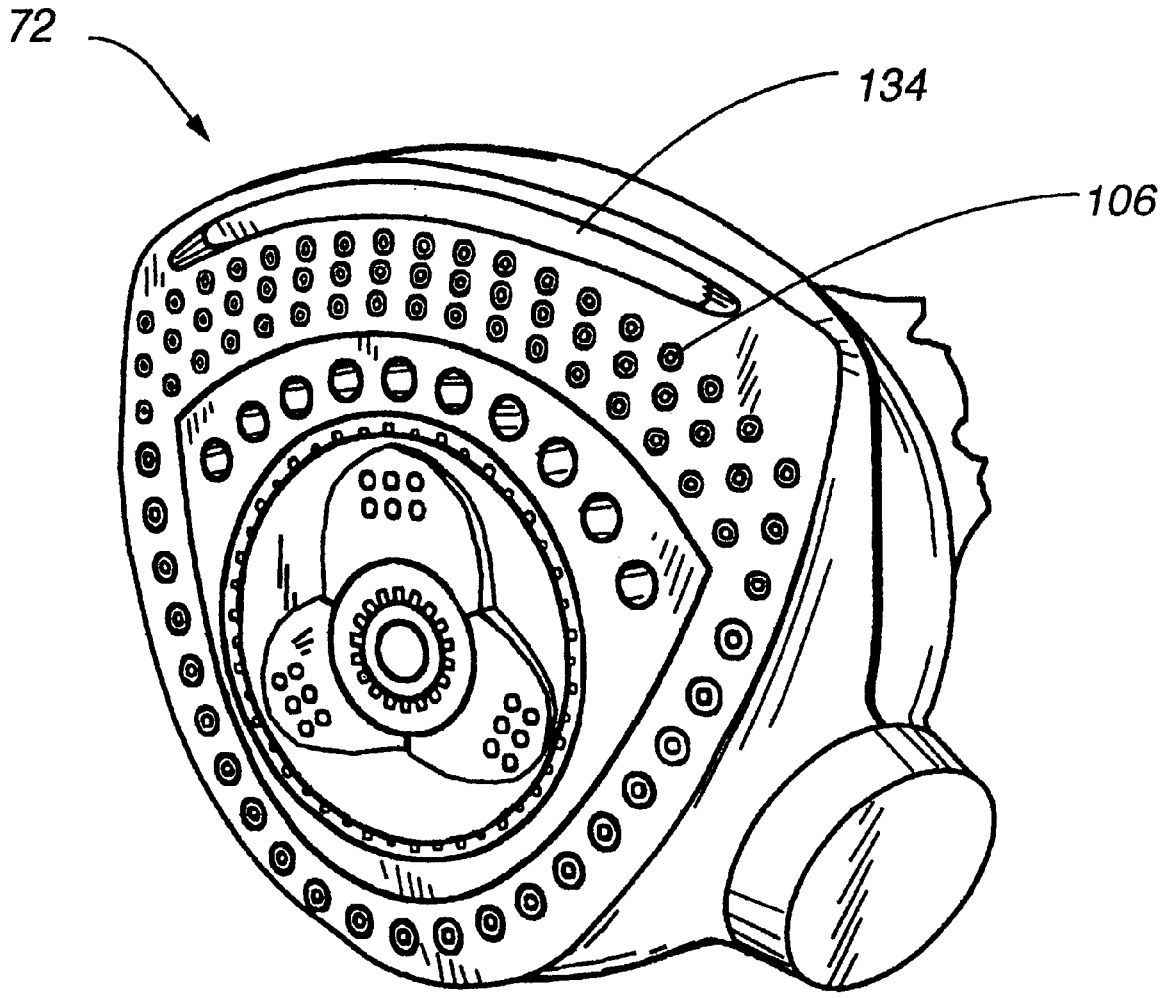
FIG. 36 is a perspective view of the wall-mount shower head and shows the waterfall slot.

The waterfall mode can be implemented in either the wall-mount or the hand-held embodiments. The water fall mode is shown incorporated in FIGS. 35, 36, 37, 38, 39 and 40. FIG. 35 shows the waterfall mode in the hand-held embodiment, with the waterfall slot 134 positioned above the wide-band of normal spray apertures 106. The waterfall slot 134 is arcuate, and can extend about ⅓ to about ⅔ the width of the shower head 72, depending on the desired spray effect. FIG. 36 shows the waterfall slot 134 incorporated into the wall-mount embodiment. The waterfall effect is created by directing a stream of laminar water onto a plate 348 having outwardly-diverging side walls 350 terminating in a wide end 352 with a sharp, clean edge 354. See FIG. 40. The stream should impact the plate 348 between 0 degrees and 90 degrees in a direction pointed toward the wide end 352 of the plate 348.

Figure 37:
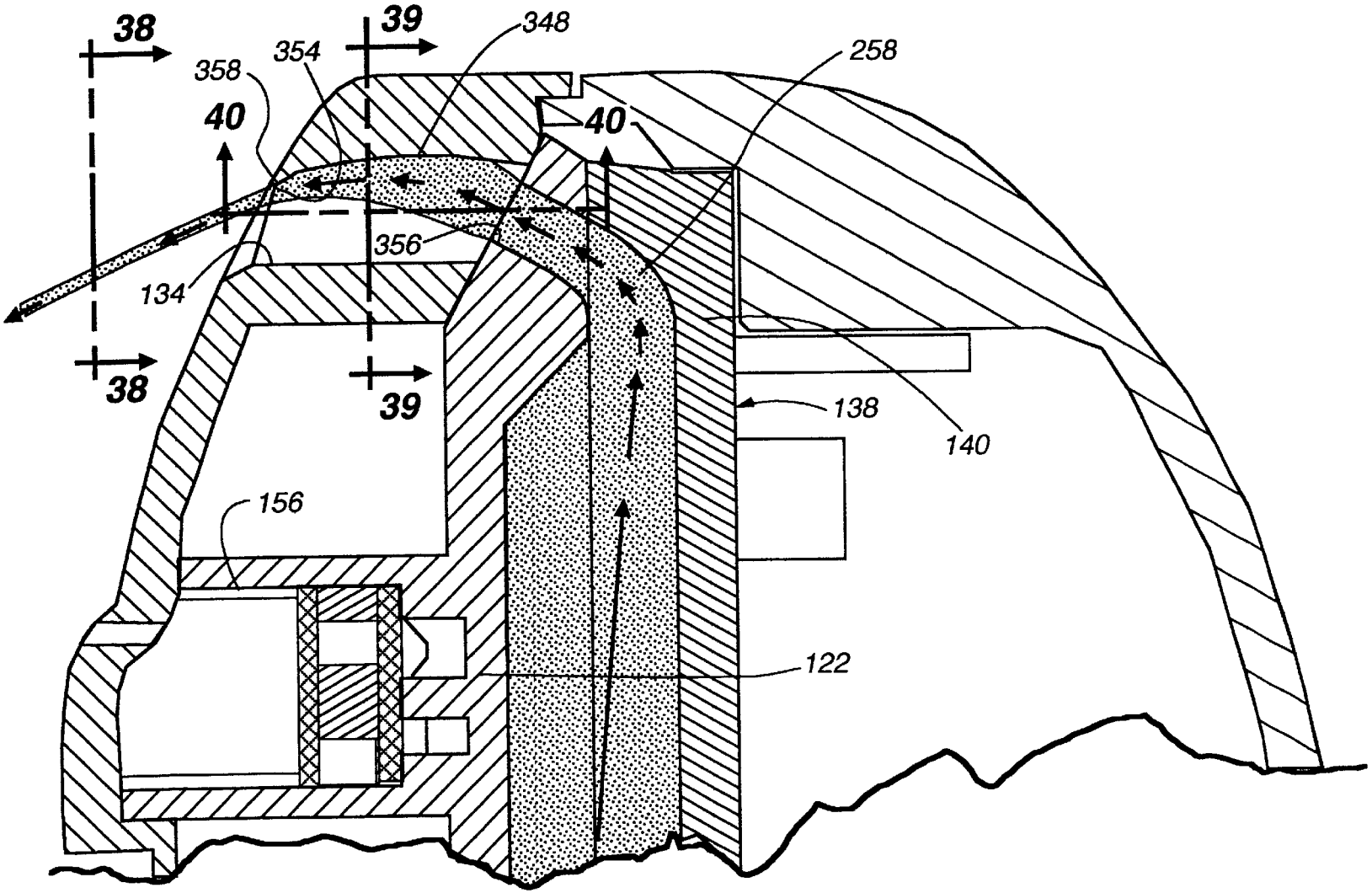
FIG. 37 is a section taken along line 37—37 of FIG. 35, and shows the flow path of the water to the waterfall slot.
Figure 38:
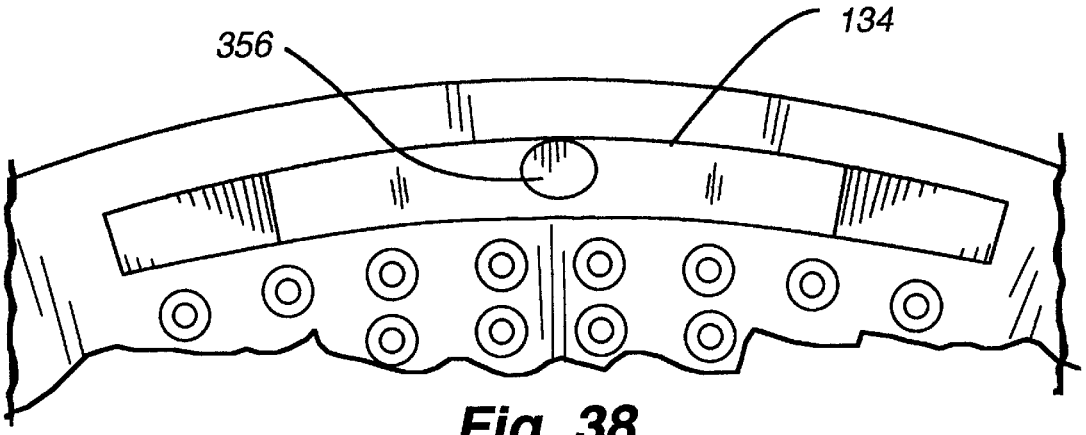
FIG. 38 is a front view taken in line with line 38—38 of FIG. 37.
Figure 39:
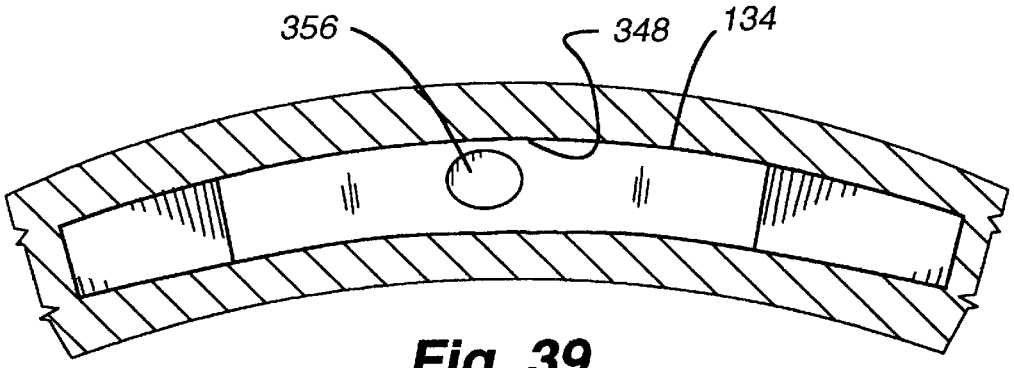
FIG. 39 is a section taken along line 39—39 of FIG. 37.
Figure 40:
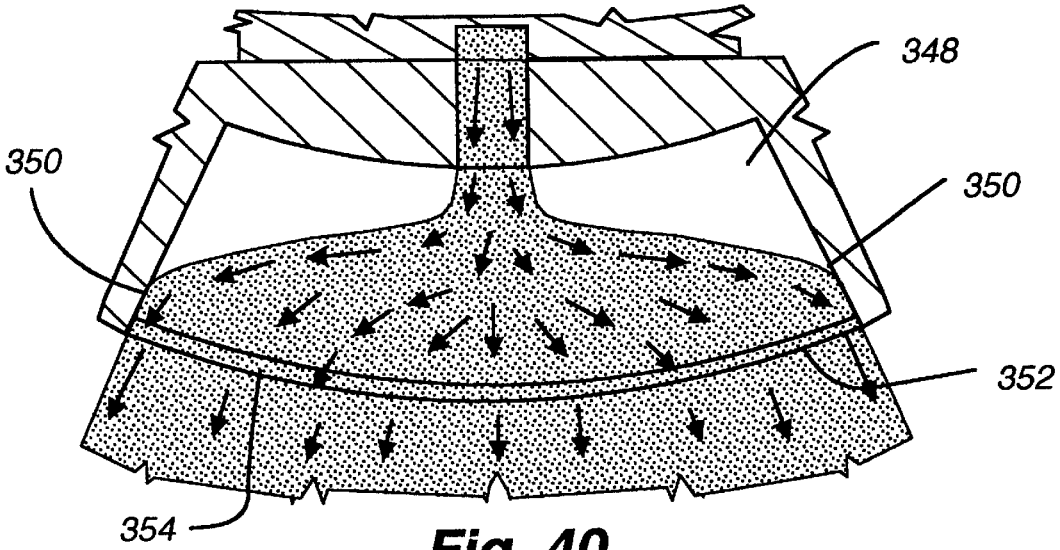
FIG. 40 is a section taken along line 40—40 of FIG. 37.

In the instant embodiment, the plate 348 faces downwardly and the stream is directed upwardly at the spread plate 348. FIG. 37 shows the eighth chamber 258 extending upwardly along the inside of the spray head unit 138. The eighth chamber 258 is a pre-conditioning chamber to allow the water to become smooth so the resulting waterfall effect is a clear, not foamy, water spread. Preferably, the eighth chamber 258 has a straight, or smoothly-curving, path of approximately 8 inches in length to condition the water from a turbulent state to a non-turbulent state. The water stream exits a nozzle 356, also designed to minimize turbulence, that is directed at the spread plate 348.

Once the water hits the spread plate 348, the water spreads out and engages the diverging side walls 350. The water pools at the walls 350 and is thus thicker at each side wall than in the middle of the plate 348. The water spreads across the plate, being thicker at the side walls 350, and passes the edge 354 of the spread plate 348. The thicker portions near the side walls 350 are diverging as they leave the plate and the web of water between them continues to spread in a smooth fashion, forming a sheet of water. The sheet of water extends out to approximately 18 inches from the shower head. After about 18 inches, the waterfall flow dissipates into a non-cohesive sheet.

The spread plate 348 should be flat or smoothly curved with no protrusions in order to create a continuous sheet of water. The edge 354 of the spread plate 348 must be a clean edge with no bumps or abrasions. Any bumps or abrasions will ruin the continuous, clear nature of the sheet of water. The edge 354 can have a ramp surface 358, if desired, to further conform the water sheet into a waterfall form. The spread plate 348 can be positioned to face upwardly, with the stream directed downwardly at it. In the instant embodiment the downwardly-facing spread plate 348 fit more efficiently into the design of the shower head 72. The term "turbulence" used above is to characterize a swirled, non-continuous flow, which may coincide with the technical meaning of the term. The term "laminar" used above is to characterize a continuous, clear flow, which may coincide with the technical meaning of the term. It is also contemplated that a turbulent spray could be directed at the spread plate, which would result in a water fall spray having a foamy, non-continuous characteristic.

Figure 42:
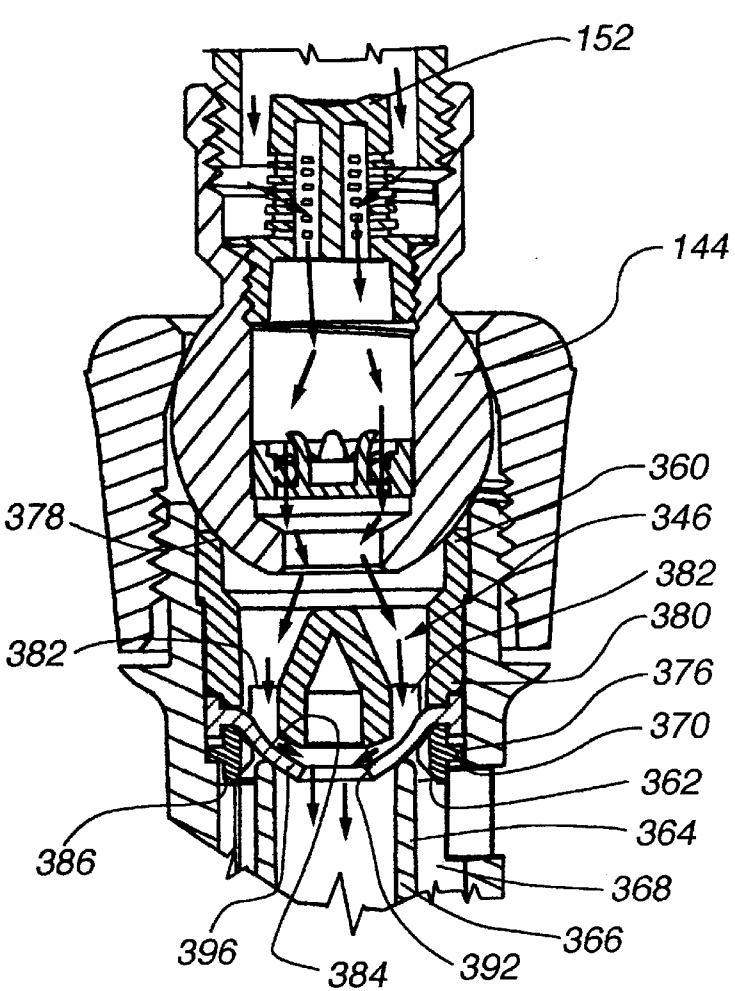
FIG. 42 is a representative section of the vacuum breaker structure in the bracket for the hand-held shower head, showing the vacuum breaker with water pressure.
Figure 41:
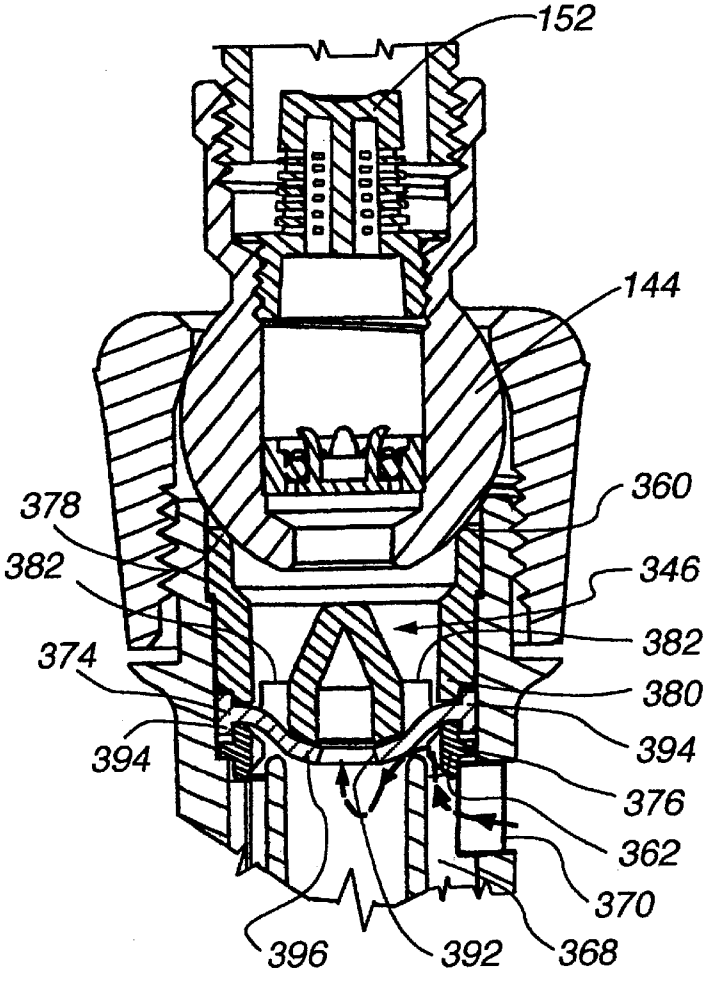
FIG. 41 is a representative section of the vacuum breaker structure in the bracket for the hand-held shower head, showing the vacuum breaker with no water pressure.
Figure 43:
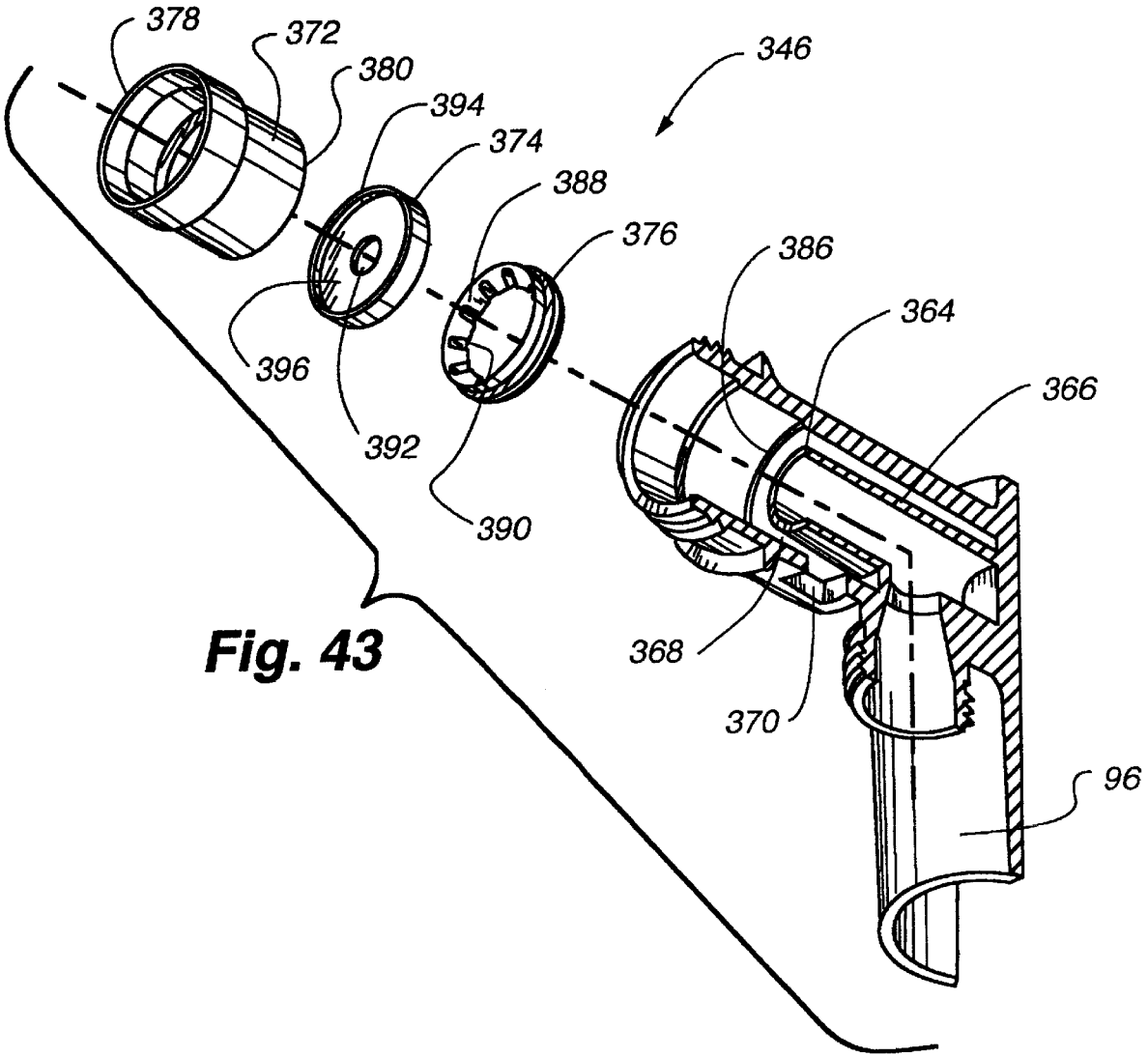
FIG. 43 is an exploded view of the vacuum breaker.

A vacuum breaker 346 is used in the hand-held embodiment to prevent siphoning of possibly contaminated water from the shower hose 92 into the house water supply system. The vacuum breaker 346 of the present invention is shown in FIGS. 41, 42 and 43. The vacuum breaker 346 is built into the bracket 96 for holding the hand-held shower head. The bracket 96 attaches at one end to the shower pipe, and has a water flow path that leads to the shower hose 92 attached at the other end of the bracket. The water flow path is formed through the pivot ball 144 (and the flow restrictor 152 inside of the pivot ball) pivotally retained in the bracket. The vacuum breaker 346 is inside the bracket 96, and engages the pivot ball 144 at one end 360. The other end 362 of the vacuum breaker 346 is in selective engagement with the end 364 of a stand-tube 366. The stand-tube 366 directs the water to the shower hose 92. A space 368 is formed around the stand-tube 366 inside the bracket housing 96, and an aperture 370 is formed in the bracket housing into the space.

The vacuum breaker 346, as shown in FIGS. 41–43, includes three members, a pivot ball support 372, a flexible, resilient washer 374, and a support ring 376. The pivot ball support 372 is generally cylindrical in shape and has a rim 378 at its first end that engages the pivot ball 144. The second end 380 defines an outwardly conical section with at least one aperture 382 formed therein, and preferably three formed at equal distance from one another. The aperture 382 or apertures are formed in the side walls 384, not at the tip of the conical section. The very tip of the conical section reverses back into the pivot ball support 372, and acts to circumferentially divert the in-flowing water to the apertures 382 formed in the side walls of the conical section 384. (See FIG. 42.)

The bracket housing 92 forms a circumferential seat 386 for receiving the support ring 376. The seat 386 is positioned just upstream of the end of the stand-tube 366, and the support ring 376 rests on the upstream side of the seat 386. The support ring 376 is circular in shape and defines a central aperture surrounded by an inwardly angled annular engagement surface 388 with radially-spaced notches 390 formed therein. The washer 374 is flexible, and is disc-shaped with a center aperture 392. The outer edge 394 of the washer 374 forms a continuous rim extending in both directions from the washer.

As shown in FIG. 41, the flexible washer 374 rests on the support ring 376, against which the pivot ball support 372 in turn rests. The rim 394 on the flexible washer is captured by the downstream rim 380 of the pivot ball support and the upstream rim of the support ring 376. This engagement creates a seal to keep water or air from passing the flexible washer other than through its central aperture 392. The central portion or web 396 of the flexible washer 374 engages the conical end surface of the pivot ball support 372 and covers the apertures 382 formed therein when there is no incoming water pressure, or when there is a vacuum being drawn from the shower pipe. This is a first or sealed position.

FIG. 42 shows the vacuum breaker 346 when there is incoming water pressure. This is a second or unsealed position. The water pushes the central portion 396 of the flexible washer 374 away from the conical end of the pivot ball support 372, which uncovers the apertures formed therein. The web extends downstream to engage the rim 364 of the stand-tube to form a seal therewith. Water thus flows through the pivot ball support 372, through the apertures formed in its conical end 382, through the central aperture of the flexible washer 392, and into the stand-tube 366. No water flows outside the stand-tube 366 and out of the aperture formed in the housing. This flow is depicted by the arrows of FIG. 42.

The vacuum breaker 346 works to inhibit the siphoning of water from the shower hose and back into the house water supply when there is no incoming water flow. At certain times a vacuum is formed in the shower pipe, which could normally siphon the water out of the shower tube (between the bracket and the shower head). However, the flexible washer 374 acts to plug the holes in the pivot ball support 372 (see FIG. 41), and keep any water from flowing back into the shower pipe. If there is a leak in the vacuum breaker 346, air is drawn through the aperture in the housing near the stand-tube 366, backwards through the leak in the vacuum breaker 346 and into the shower pipe. The arrows in FIG. 41 show this flow. Typically, when the vacuum breaker 346 is properly working, the air vent 370 is not utilized. The air vent aperture 370 is a back-up, and keeps water from accidentally being siphoned if the vacuum breaker fails.

The instant vacuum breaker structure is integral with the bracket, small in size, and easily manufactured and assembled. The diameter of each of the three components are smaller than the diameter of the pivot ball, allowing the vacuum breaker to be easily built into the bracket. It combines the required siphon barrier and the back-up air-vent system into only a small portion of the bracket structure.

While the preferred embodiment of the flow control valve is set forth above, several alternative embodiments are capable of providing similar function and benefits. Each of these valves are located in the shower head at the same location as the previously-described flow control valve, and each diverts incoming water either to the mode selector, the mist (or separated) spray mode, or a combination of both, and adjusts the flow pressure to the mode selector.

FIGS. 44–48 represent a second embodiment of the flow control valve 82'. The valve 82' is positioned in the sleeve or chamber. Water flows into the chamber in which the valve is located through an inlet aperture 398. The inlet aperture 398 can be a single aperture or a plurality of apertures. The inlet apertures 398 can have particular shapes to affect flow pressure, as described below. An outlet aperture 400 is formed in the end of the chamber to allow water to flow to the mode selector 80, and an outlet aperture 402 is formed in the side wall of the chamber to allow water to flow to the channel leading to the mist spray apertures. Once in the chamber, the valve 82' acts to direct the water into the mode selector 80, the mist mode, or both, through the respective apertures. The valve also controls the water pressure flowing into the mode selector.

The first half of the valve 82' has a first knob portion 404 for receiving a turn-knob. The first knob portion 404 is shaped as a key to receive the turn-knob 90 in a torque transferring manner. A pair of radially extending flanges are formed on the shaft of the first knob portion 404 and form a seat 406 for an O-ring seal 408. The outer flange extends outwardly further than the inner flange to act as a stop and to rotatably retain the knob portion 404 in the spray head unit 138. It also keeps the first half from being inserted too far into the chamber. The O-ring seal 408 keeps water from exiting the shower head around the knob portion 404. The internal end 410 of the knob portion 404 is cylindrical in shape and defines external threads 412.

The second half of the valve is a shuttle 414, and includes an internally threaded cavity 416, a pair of radially extending flanges 418, a stop structure 420, and a hexagonally shaped keyed end 422. See FIG. 48. The flanges 418 form a seat 424 for an O-ring 426 which seals with the inside wall of the chamber, as described below. The shuttle 414 is received on the knob portion 404 inserting the threaded end 410 of the knob portion 404 into the threaded cavity 416.

The valve 82' is positioned in the chamber and the knob portion 404 is secured to the outer wall of the spray head unit 138. The knob end 404 is secured using a snap-ring 428 or the like in conjunction with the outer flange 430 to rotatably retain the knob end. The first half is rotatable in the chamber. The keyed end 422 of the shuttle 414 is positioned in the mode selector outlet aperture 400, which is shaped to prohibit the rotation of the keyed end 422, but to allow the axial translation of the keyed end 422 therein. The mode selector outlet aperture 400, for instance, can have opposing walls 432 engaging one or more of the walls of the keyed end of the second half of the valve (See FIG. 48). The walls 432 keep the shuttle 414 from turning, but allow the shuttle to slide (translate) axially along the chamber.

The shuttle 414 is caused to slide or translate along the chamber when the knob portion 404 is rotated. The threaded engagement 410 of the knob portion 404 and the shuttle 414 result in the shuttle moving relative to the fixed knob portion when the knob portion is rotated. Generally, the shuttle 414 acts as a diverter and translates from an initial position, through an intermediate position, to a final position. This range of translation takes approximately three compete turns of the knob portion 404. The amount of turning needed to move the shuttle through the entire range depends on the threading design of the post of the knob portion (which the threaded cavity of the shuttle matches). More or less than three turns can be obtained by changing the thread pitch. With a right-hand thread, the clockwise rotation of the knob portion 404 causes the shuttle 414 to move towards the knob portion 404. A counter-clockwise rotation of the knob portion 404 causes the shuttle to move away from the knob portion. The opposite relative movements would occur with a left-hand thread. With respect to the description of the this valve 82', a right-hand thread convention is used.

Figure 44:
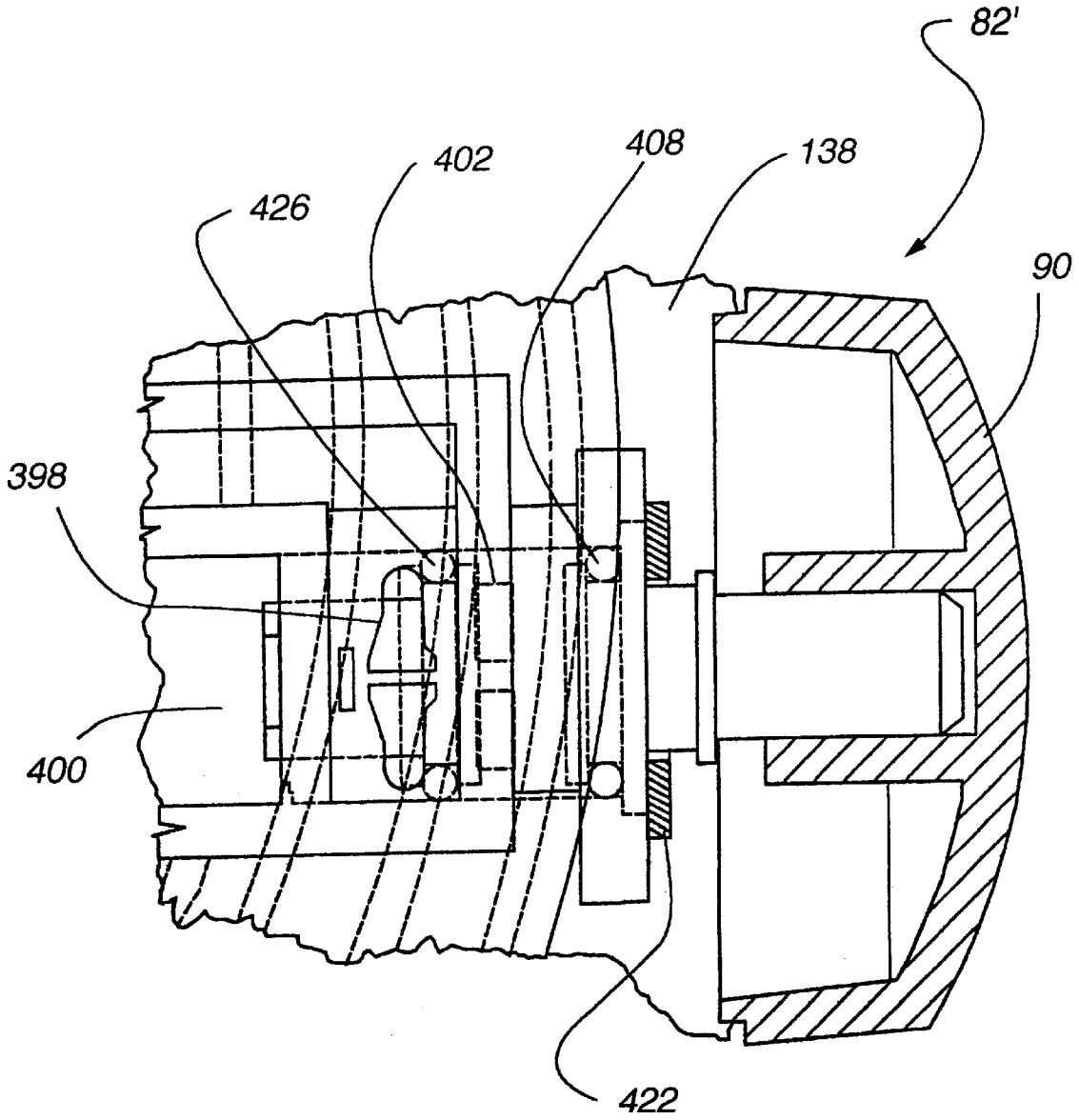
FIG. 44 is a representative top section view of an alternative embodiment of the flow control valve.
Figure 45:
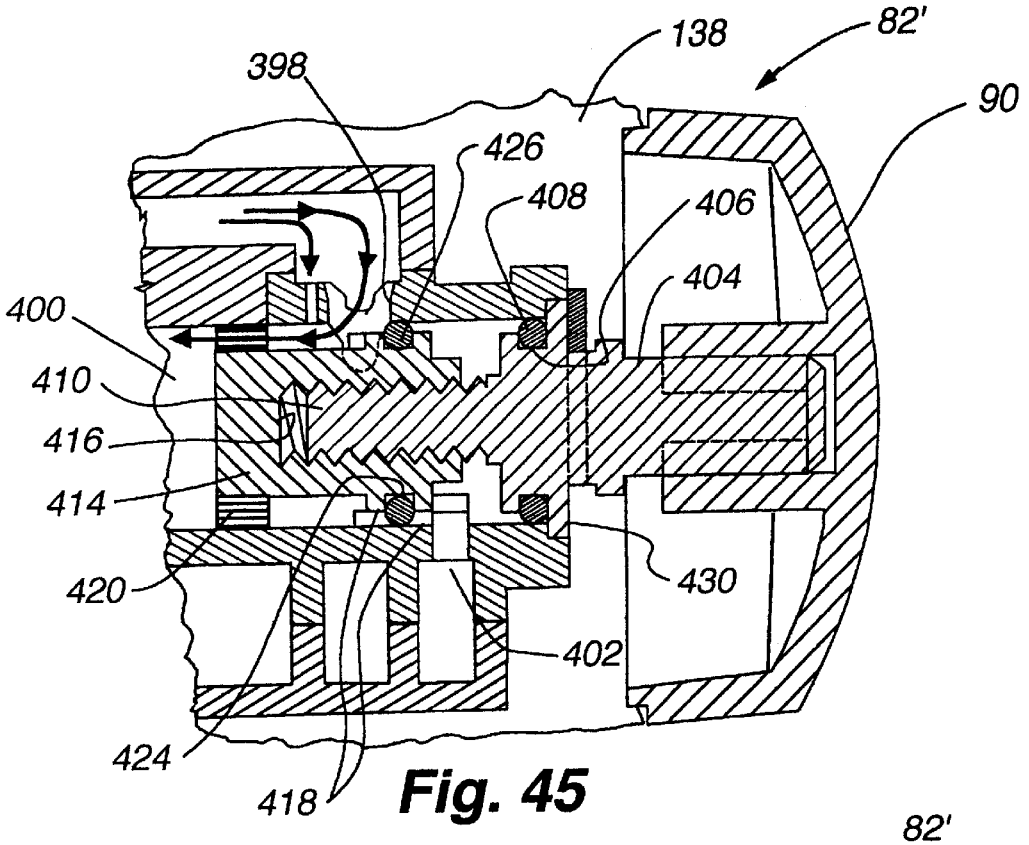
FIG. 45 is a representative side section view of the alternative embodiment shown in FIG. 44, with the diverter in the outermost position.
Figure 46:
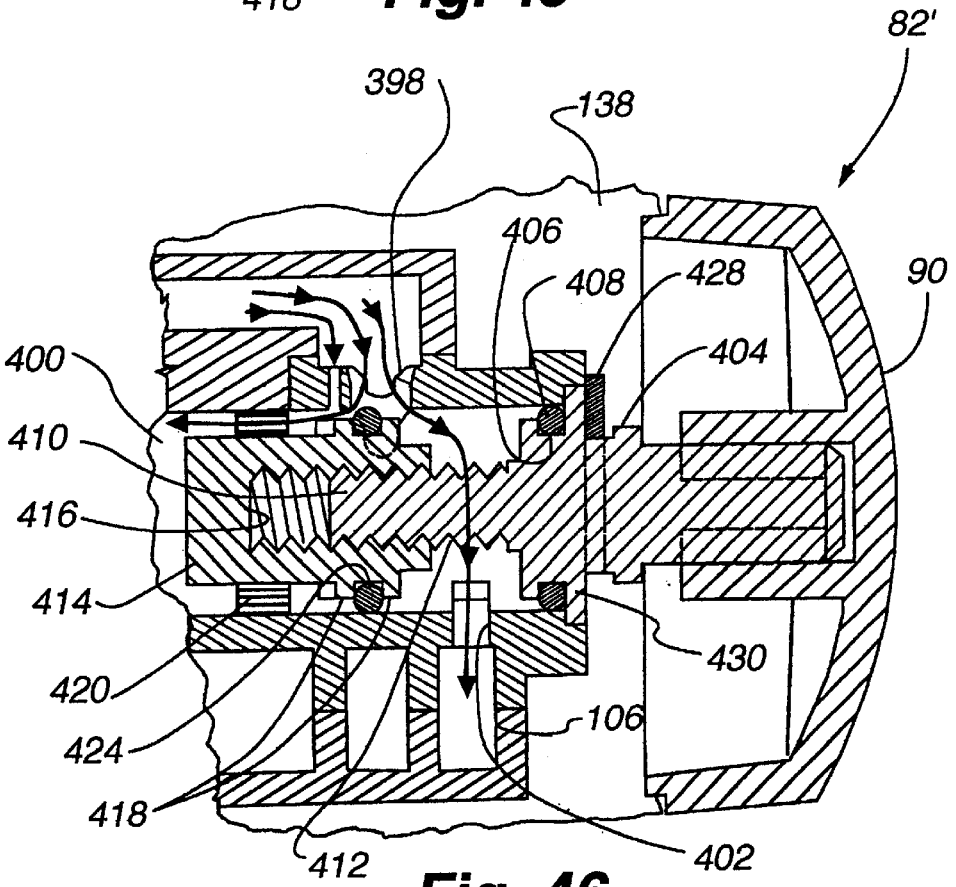
FIG. 46 is a representative side section view of the alternative embodiment shown in FIG. 45, with the diverter in an intermediate position.

The initial position of the diverter is shown in FIGS. 44 and 45. The shuttle O-ring seal 426 (which is the diverter) is positioned outwardly of the two generally triangular and the rectangular inlet apertures 398 formed in the top of the chamber (together forming the inlet aperture). The shuttle O-ring seal 426 is positioned inwardly of the mist inlet aperture 402. In this position, that water flows through the inlet aperture 398 and through the chamber, the mode selector aperture 400, and on into the mode selector 80. In this position, the flow into the mode selector for passage to any mode except mist mode is at a maximum level.

Upon turning the knob portion 404 in a counter-clockwise direction, the shuttle 414 is moved away from the knob portion 404, thus moving the diverter 426 over the inlet aperture 398 to restrict flow to the mode selector 80, and thus reduce the flow rate (and water pressure). This allows the water pressure to be adjusted by the user for whatever mode the user has chosen. As the knob portion 404 is turned further in a counter-clockwise direction, the diverter 426 moves further away from the knob portion 404. This moves the diverter 426 further across the inlet aperture 398 to split the incoming water flow to both the mist apertures 402 and to the mode selector 80. See FIG. 46. At this point, water is flowing to both the mode selector and the mist mode outlet. As the knob portion 404 is continued to be turned in the counter-clockwise direction, the diverter 426 moves to a position where most of the water is diverted to the mist mode outlet 402. At this point most water is flowing to the mist mode outlet aperture 402 and only a small amount of water is flowing to the mode selector 80.

Figure 47:
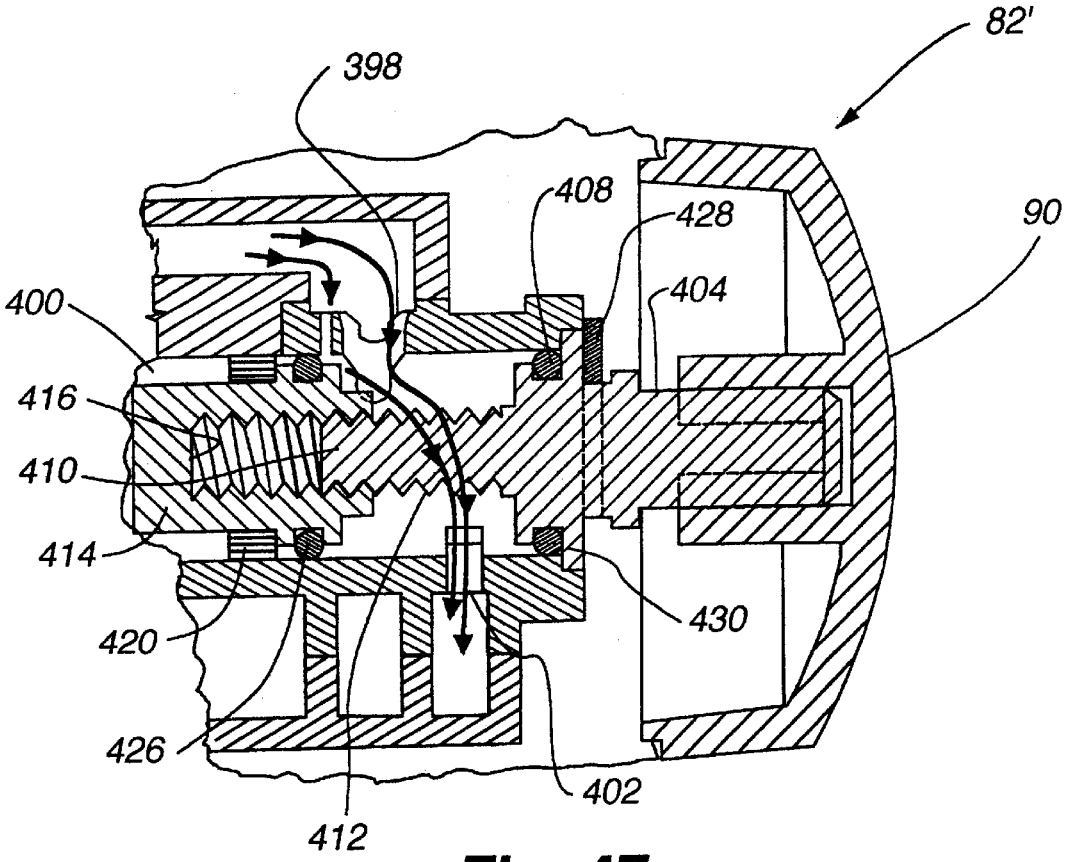
FIG. 47 is a representative side section view of the alternative embodiment shown in FIG. 46, with the diverter in the innermost position.
Figure 48:
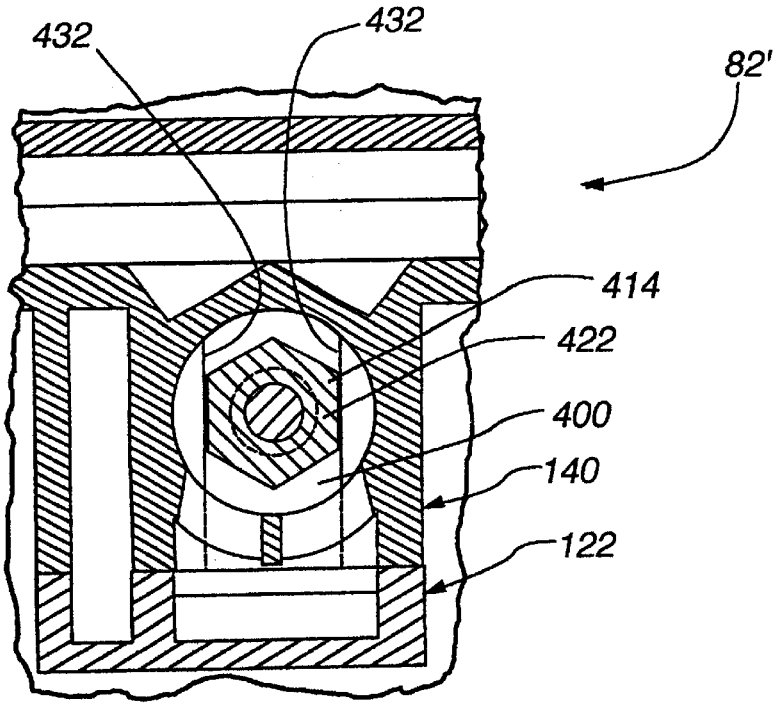
FIG. 48 is an representative section of the alternative embodiment shown in FIG. 46, specifically of the keyed end of the shuttle inserted into the mode selector outlet port.

FIG. 47 shows the shuttle 414 in its innermost position, with the diverter 426 positioned inwardly of the inlet aperture 398 so all water flows to the mist mode aperture 402 and no water flows to the mode selector 80.

In transitioning from mist mode back to another mode set by the mode selector 80, the knob portion 404 is turned clockwise, and the above process is performed in reverse. The flow to the non-mist mode begins gradually and mixes with the mist mode, and strengthens until the mist mode is no longer actuated. The user can thus feel the non-mist mode before the mist mode is entirely turned off.

Figure 49:
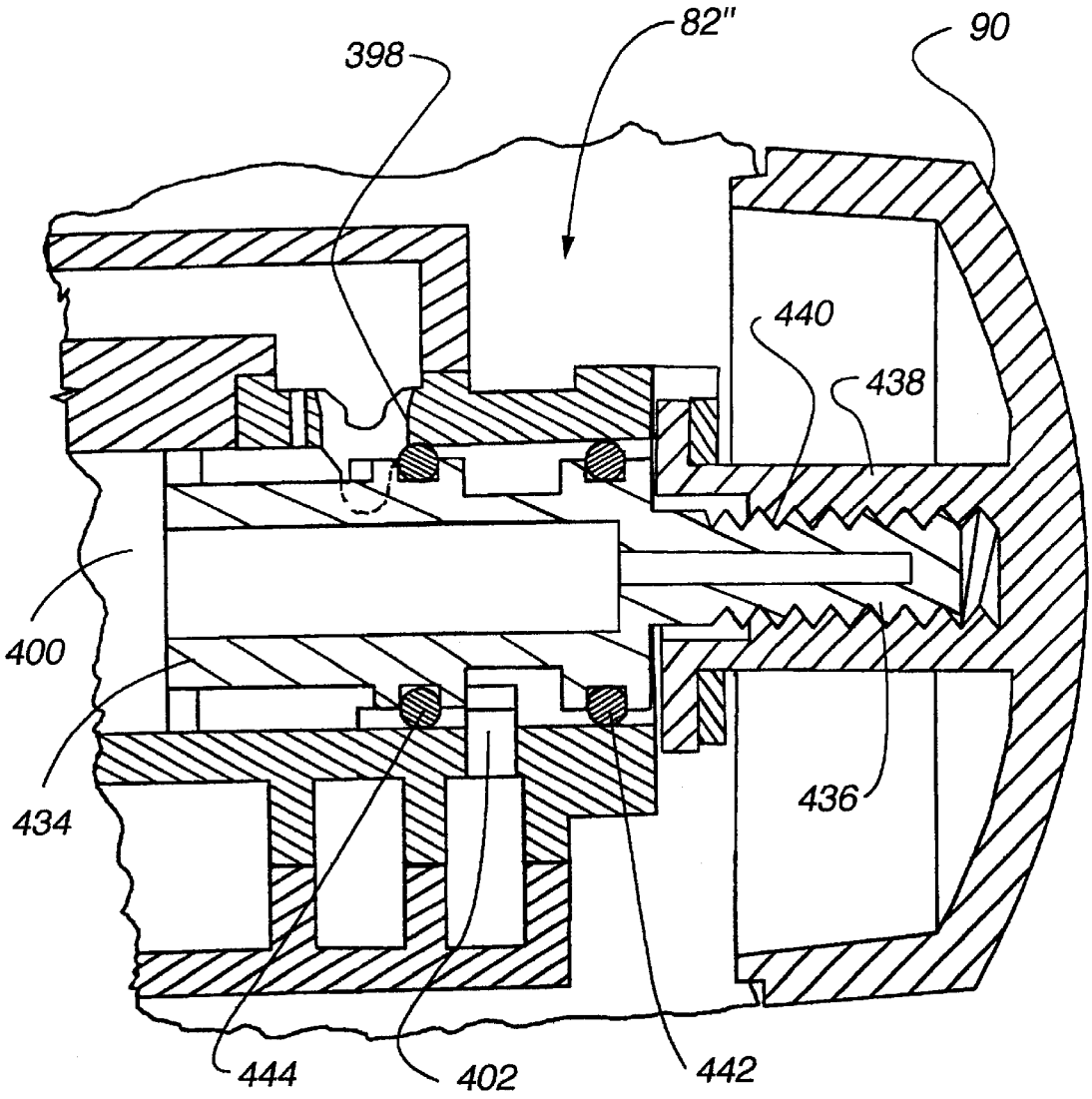
FIG. 49 is a representative section view of another alternative embodiment of the flow control valve.

FIG. 49 shows a third embodiment of the flow control valve 82". The valve 82" is positioned in the chamber, and the chamber has the same inlet 398, outlet 400 and mist 402 apertures. This third embodiment of the flow control valve 82" is similar to the second embodiment, with the main difference being that the shuttle 434 defines the threaded post 436 and the knob portion 438 defines the threaded cavity 440. Also, the outer seal 442 that keeps water from flowing past the knob portion 438 is formed on the shuttle 434, and moves with the movement of the shuttle 434. It does not, however, pass over the mist mode outlet aperture 402 at any point. It maintains a seal with the chamber to keep water from flowing past the knob portion 438. An O-ring seal 444 is formed around the shuttle 434 to act as a diverter, similar to that described above. The actuation of the diverter is identical, with the same shuttle movement and resulting water flow control characteristics, as the embodiment described above.

Figure 50:
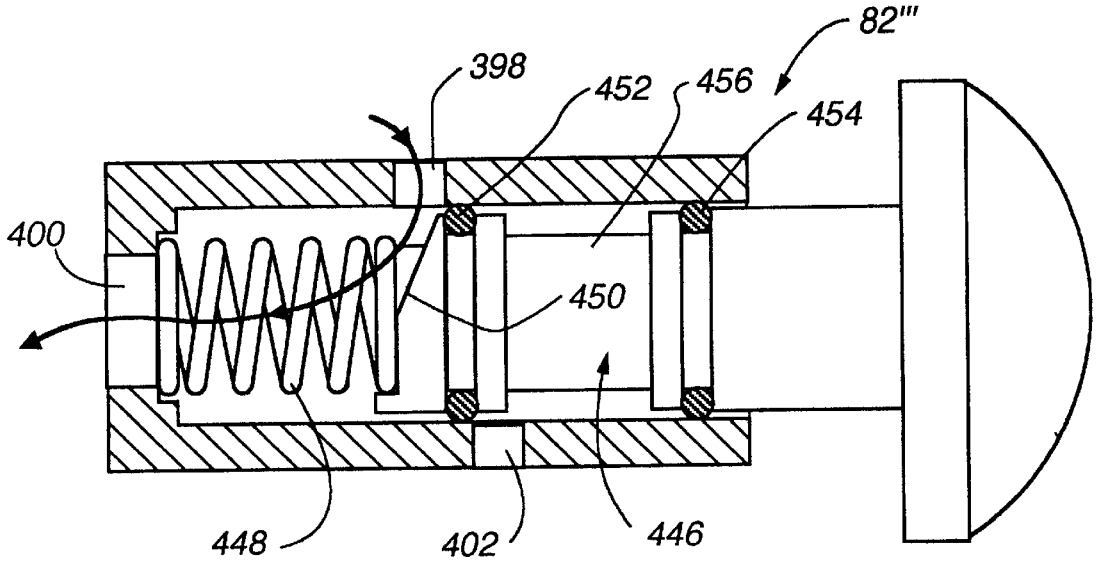
FIG. 50 is a representative section view of another alternative embodiment of the flow control valve, with the plunger and diverter in the outermost position and diverting water to the mode selector.
Figure 51:
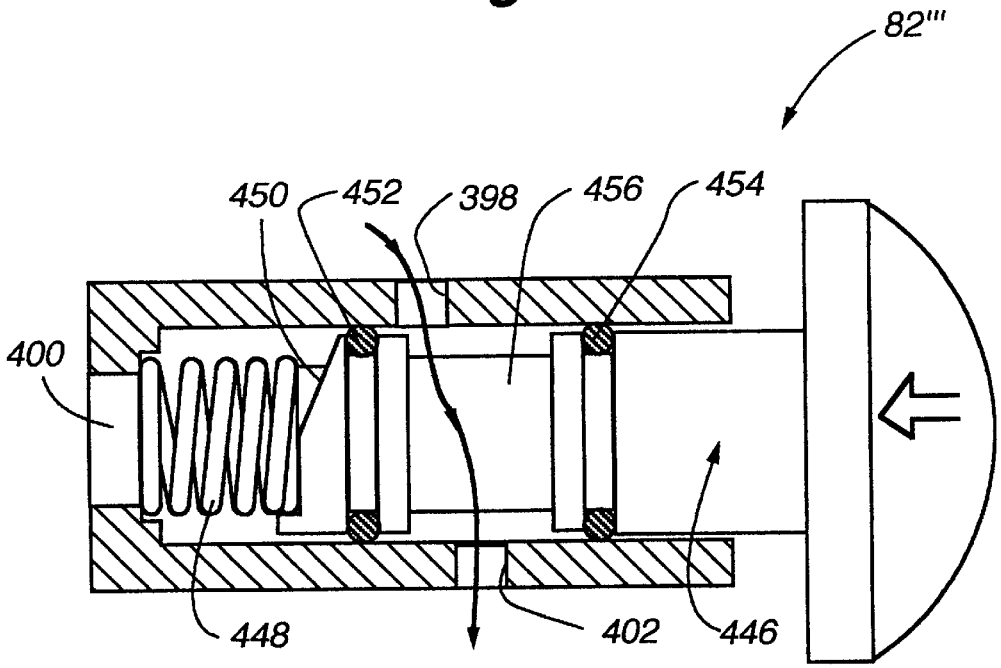
FIG. 51 is a representative section view of the alternative embodiment shown in FIG. 50, and specifically of the flow control valve, with the plunger and diverter in the innermost position and diverting water to the mist aperture outlet.

The fourth embodiment, shown in FIGS. 50 and 51, of the flow control valve 82'" is positioned in the chamber as described above, and includes the same inlet 398, outlet 400 and mist 402 apertures. This embodiment of the flow control valve 82'" incorporates a pressure-locking feature which makes it difficult for the user to switch out of the mist mode, once selected, while the water is flowing. The pressure-locking flow control valve is a plunger 446, or shuttle, slidably positioned in the chamber. The plunger 446 has a first, outer position (FIG. 50) and second, inner position (FIG. 51). The plunger 446 is biased into the outer position by a spring 448. A sloped surface 450 at the end of the plunger forms a flow restriction 450. A first O-ring 452 is positioned adjacent to and outwardly from the flow restrictor 450, and forms a seal with the wall of the chamber. This first O-ring 452 acts as a diverter, as described below. A second O-ring 454 is positioned near the outer end of the plunger 446, and forms a seal with the wall of the chamber. This second O-ring 454 keeps water from flowing past the plunger 446 and out of the spray head unit 138.

In the outer position, as shown on the top of FIG. 50, the water flows in the inlet aperture 398 and out of the mode selector outlet 400. The first O-ring 452 (the diverter) is to the right of the inlet aperture 398, thus diverting water through mode selector outlet 400 into the mode selector 80 to be diverted to all the spray modes except the mist mode. The plunger 446 is rotatable in the chamber, and can be turned when in the outer position to control the flow through the inlet 398. The flow restrictor 450 is a circumferential ramp that reduces the effective inlet area of inlet aperture 398, thus cutting off the inlet flow, and thus reducing the flow to the mode selector outlet 400. No water flows through mist mode aperture outlet 402 when the plunger 446 is in the outer position.

When the plunger 446 is in the inner position, as shown in FIG. 51, the diverter 452 is to the left of the inlet aperture 398, and diverts the water past the intermediate portion of the plunger 456 to the mist mode aperture outlet 402. No water flows to mode selector outlet 400, and the flow restrictor is thus inactive. The pressure on the plunger 446 developed by the flowing water overcomes the spring force, and keeps the plunger in the inner position until the water pressure is reduced sufficiently to allow the spring force to overcome the water pressure and move the plunger 446 to the outer position.

Figure 52:
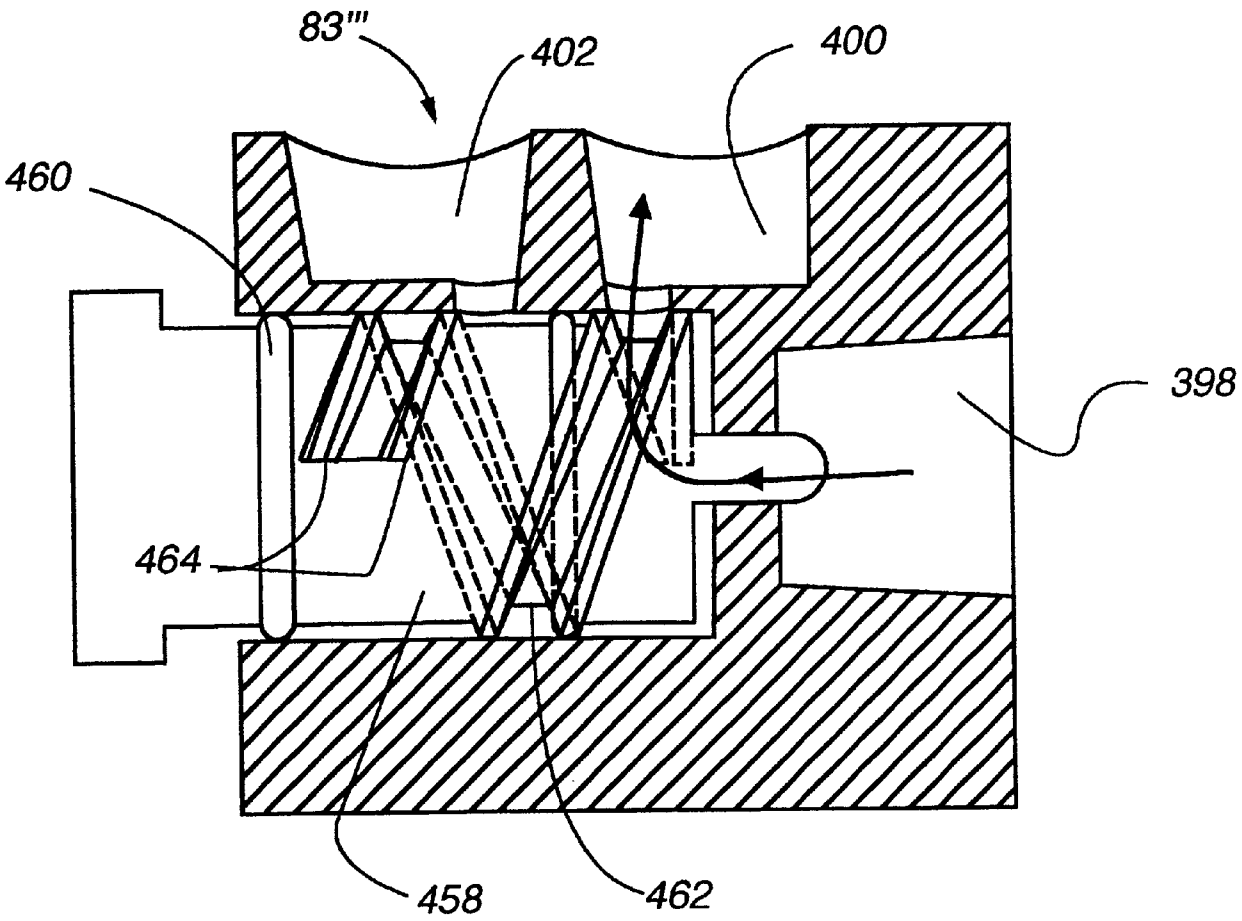
FIG. 52 is a representative section view of another alternative embodiment of the flow control valve, specifically showing a channel structure on the outer surface of the shuttle.

Another embodiment of the present invention, and particularly the flow control valve 82"", is shown in FIG. 52. The structure is a cylindrical body, or shuttle 458, rotatably received in the chamber, as described above. A portion of the shuttle 458 extends from the chamber for manipulation by the user. The chamber has an inlet aperture 398, and a mist mode aperture outlet 402 and a mode selector outlet 400. A seal 460 is formed around the outer end of the shuttle to seal with the wall of the chamber to keep water from flowing past the shuttle and out of the spray head unit 138.

The shuttle 458 has at least one helical channel 462 formed on its outside surface to channel water from the inlet aperture 398 to either of the two outlets 400, 402. FIG. 52 shows a shuttle 458 having a single helical channel on the outer surface of the shuttle. There are ridges 464 on either side of the channel that form a seal against the cavity walls. In FIG. 52, the channel 462 is aligned with the inlet aperture 398, and directs flow to the mode selector outlet 400. When the knob is turned, the channel moves out of alignment with the outlet 400 and thereby restricts the flow into the outlet 400. This controls the water pressure. As the knob is turned further, the channel aligns itself with the outlet 402 and out of alignment with the outlet 400 to divert water to the mist mode outlet 402 and not to the outlet 400. In between, water is diverted to both outlets 400 and 402. The shuttle having the channel formed in its outer surface is contemplated for use with more than two exit apertures.

In each of the above flow control valve embodiments, the flow control valves 82, 82', 82", 82'" include diverters, such as channels and O-rings, and are the means for diverting the water flow from one outlet flow path to the other outlet flow path, or for mixing the water flow between the two outlet flow paths.

The shape of the inlet aperture or apertures to the chamber containing the flow control valve is very important. The movement of the diverter past the inlet aperture or apertures affects the water flow into the chamber. The shape of the inlet aperture can change that affect as a result of its shape. If the inlet aperture is square, the effect would be analogous to a step function in that once the diverter passed the front edge of the aperture, the flow would be significant. If the inlet aperture was a diverging hole, such as a triangle starting narrow and widening, the flow would increase more gradually. In the preferred embodiment of the instant case, the flow rate is controlled mainly by the shuttle portion of the flow control valve, and the inlet apertures are made as large as possible. However, for instance, in the second embodiment of the flow control valve, the inlet aperture is actually a group of apertures: two symmetric, triangularly-shaped inlet apertures and a third smaller rectangularly-shaped inlet aperture (such as in apertures 398 in FIG. 44). This aperture combination has been found to provide somewhat desirable flow characteristics. The apertures could take on any of a variety of shapes, such as oval, circular, rectangular, square, or some non-geometric shape, to condition the inlet flow pressure as desired.

While the preferred embodiment of the mode selector 80 is set forth above, other alternative embodiments are capable of providing similar function and benefits. Each of these mode selectors are located in the shower head at the same location as the previously-described mode selector, and each allows the user to select the desired spray mode.

The second embodiment of the mode selector 80' or actuator is positioned in a reservoir having side walls 472, a lid 474, and a base 476. See FIGS. 54 and 55. The base 476 defines two rows of outlet apertures, with each aperture leading to a different channel or chamber for its respective spray mode. Water is diverted into the reservoir 478 from the flow control valve 82 as described above. Each outlet aperture 480 has a collar 482 (raised sealing surface) formed around it, and a shield 484 formed partially circumferentially around it. The shields 484 are to help align the sealing members 486 over the apertures, but are not required.

The wall at one end of the diverter reservoir 478 defines a circular aperture to receive the cam shaft 488, which is described in more detail below. Two cam shaft support bearings 490 are also formed to extend rearwardly from the bottom 476 of the reservoir to rotationally support the cam shaft 488.

The mode selector 80' is formed inside the diverter reservoir 478, and allows the user to select the desired spray mode. A valve sealing surface 494 surrounds the aperture 480 and includes the collar and an O-ring 496 positioned inside of the collar and outside of the aperture 480. The mode selector 80' includes the cam shaft 488 and the valve assembly 492, as shown in FIGS. 53–55A. Each valve sealing surface is positioned around an outlet aperture, the outlet apertures preferably aligned in one row of four and one row of three inside the reservoir 478. The rows of valve sealing surfaces 494 are substantially parallel to one another. There is one valve seal for selectively engaging and sealing with each valve sealing surface.

Each valve sealing member 486 is attached to a valve actuating arm 498 fixed at one end to the wall of the reservoir or the lid 474 of the reservoir 478 (as shown). The valve seal 486 is attached at the distal end of the valve actuating arm 498, and is positioned over the respective outlet aperture 480 and which will seal sealingly surface 494. The valve arm 498 fundamentally acts as a cantilever beam. Each valve arm has a first 500, second 502 and third 504 section. The first section 500 is relatively flat and extends at right angles from the wall of the reservoir 478. The second section 502 curves upwardly (see FIGS. 54 and 55) from the first section 500 and then extends over to the opposite side of the reservoir 478. The second section 502 defines cam surfaces 506 for engagement with the lobes on the cam shaft 488, as described in more detail below. The valve arm 498 acts as a spring to sealingly bias the valve seal against the valve sealing surface 494 (the raised sealing surface) in the diverter reservoir. The third section 504 defines the valve seal 486, which is spaced downwardly from the second section so as to be positioned over and in engagement with the raised sealing surface 494.

The valve seal 486 is circular, and has a protruded central portion to fit into the respective outlet aperture to center the seal over the aperture and improve the sealing qualities.

Figure 53A:
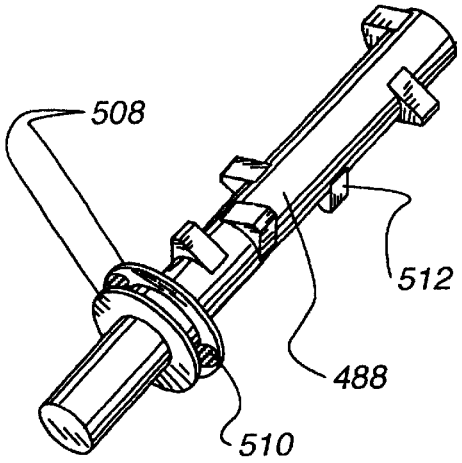
FIGS. 53A and B are perspective views of a cam shaft used in an alternative embodiment to the mode selector, showing triangular protrusions.
Figure 53B:
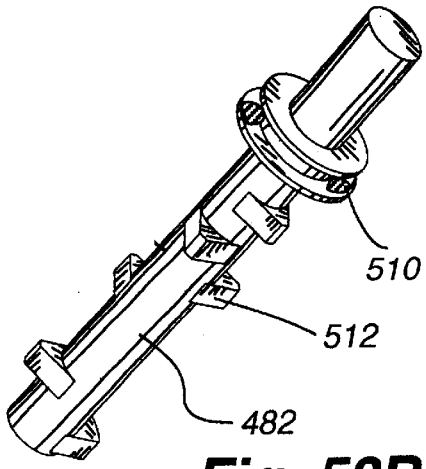
Figure 56A:
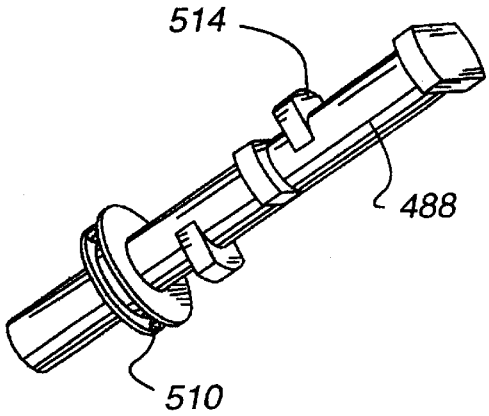
FIGS. 56A and B are perspective views of an alternative cam shaft.
Figure 56B:
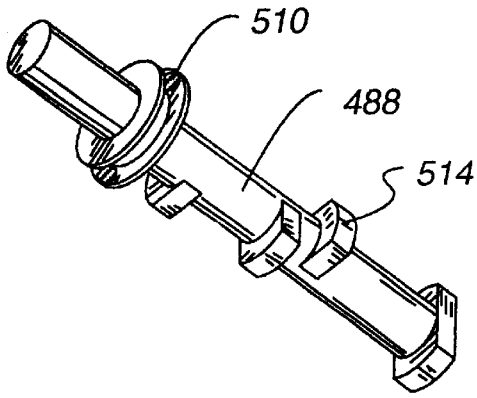

The cam shaft 488, as shown in FIGS. 53A and B extends into the diverter reservoir 478 in selective engagement with the valve assembly as part of the mode selector 80'. The cam shaft 488 is rotationally supported on two bearing posts 490. The cam shaft sealingly passes through the aperture in the reservoir wall. An O-ring 510 is positioned between two radially-extending flanges 508 at one end of the cam shaft 488, the O-ring 510 helping maintain a seal to keep water from escaping the reservoir. The end of the cam shaft 488 that extends out of the diverter reservoir 478 receives a knob to allow the user to easily and accurately actuate the cam shaft. The end of the cam shaft 488 inside the reservoir 478 defines lobes that extend substantially radially outwardly from the cam shaft. Two different shapes of lobes are disclosed. Generally triangular lobes 512 with flat tops are shown in FIGS. 53A and B. Generally rectangular lobes 514 having slightly arcuate tops are shown in FIGS. 56A and B. The triangularly shaped lobes allow more lobes to be placed on the cam shaft to actuate more valves if desired.

The lobes on the cam shaft are positioned so as to engage the valve arms to lift the valve seals 486 out of engagement with the valve sealing surface 494 of the desired spray mode. More than one outlet port can be uncovered at a time, depending on the placement of the lobes on the shaft.

Figure 54:
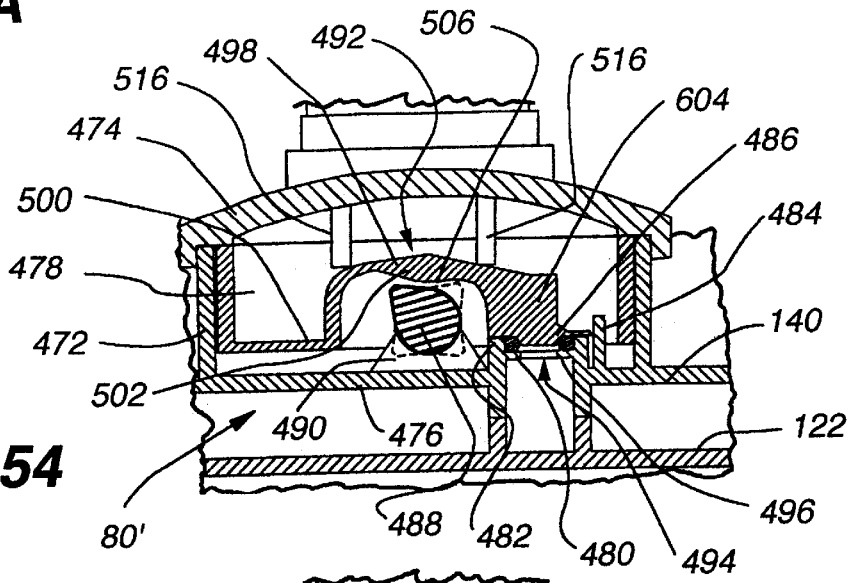
FIG. 54 is a representative section of the alternative embodiment of the mode selector using the cam shaft of FIGS. 53A and B, and showing, in part, the reservoir, valve arm, valve seal, and mode outlet in the sealed position.

The rotation of the cam shaft 488 acts to lift the valve seal 486, which allows water into the appropriate channel to flow to the desired spray mode apertures. Specifically, the lobe on the cam shaft engages the second section 502 of the valve actuation arm and lifts the seal 486 off the outlet aperture 480 and corresponding valve sealing surface 494. The valve arm 498 is resiliently biased against the lobe on the cam shaft, such that when the valve arm is disengaged from the cam shaft lobe, the valve arm biases the valve seal 494 against and into the valve outlet port 480 and valve sealing surface 494. The bias force on the arm is derived from its cantilever-style attachment to the lid 474 of the reservoir, as shown in FIG. 54. Water pressure on the back side of the valve seal 494 also helps maintain the water tight seal of the valve seal when engaged with the valve outlet port 480.

Figure 55:
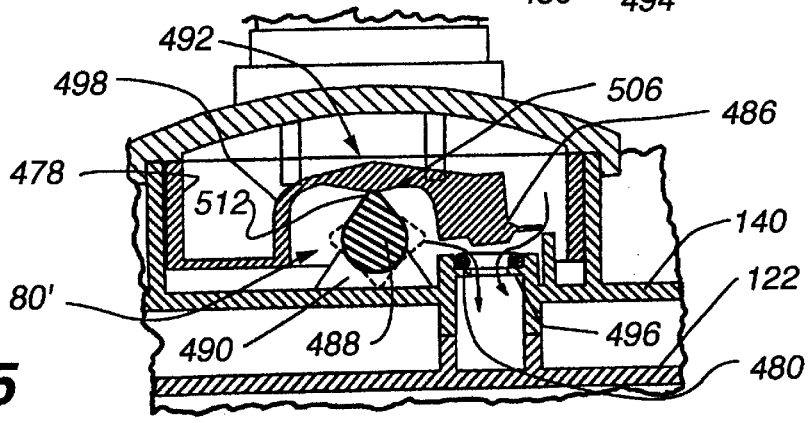
FIG. 55 is similar to FIG. 54 except the unsealed position is shown.

In more detail, as shown in FIGS. 54 and 55, the lobe on the cam rotates with the cam to engage a first cam surface 506 on the second portion 502 of the valve actuation arm 498. The cam shaft 488 is being rotated clockwise in FIGS. 54 and 55. As the cam shaft is rotated, the lobe 512 further engages the first sloped surface 506 and pushes the arm 498 up to lift the seal 486 from the aperture. When the top of the lobe (flat) engages the second engagement surface (also flat), the two surfaces align and engage firmly together, as is shown in FIG. 55. The downward force of the biased valve arm 498 is then directed through the axial center of the cam shaft 488 and does not create an appreciable rotational force on the cam shaft 488. In this position, the cam shaft resists rotation, and acts as a register that the cam is in the proper position to open and unseat the seal 486 (FIG. 55). When the seal 486 is unseated, water can flow therethrough to the appropriate spray mode as desired. Different valve arms are engaged by the different lobes to select the desired spray mode. When the aperture is to be closed, the cam is rotated either direction, and the lobe moves from the engagement with the second cam surface to engagement with the third or first cam surface and allows the seal to seat on the raised seal surface 494. Once the cam is rotated a little, the force of the valve arm acts to assist in turning the cam shaft. The cam shaft 488 can be turned to cause a lobe to engage the valve arm of another seal to open a different aperture. The order in which the apertures are uncovered depends on the positioning of the lobes on the cam shaft, which can be in any order. Two or more valves can be opened at the same time or closed at the same time, or alternatively, if desired.

A diverter reservoir lid 474, as shown in FIGS. 54 and 55, mounts to the top of the reservoir 478 diverter to form a chamber, in which is positioned the mode actuator 80' (valve assembly and cam shaft). Two rows of eight prongs 516 each extend from the front side of the reservoir lid and extend downwardly adjacent to the valve arms to keep the valve arms in alignment as they move up and down.

Figure 57:
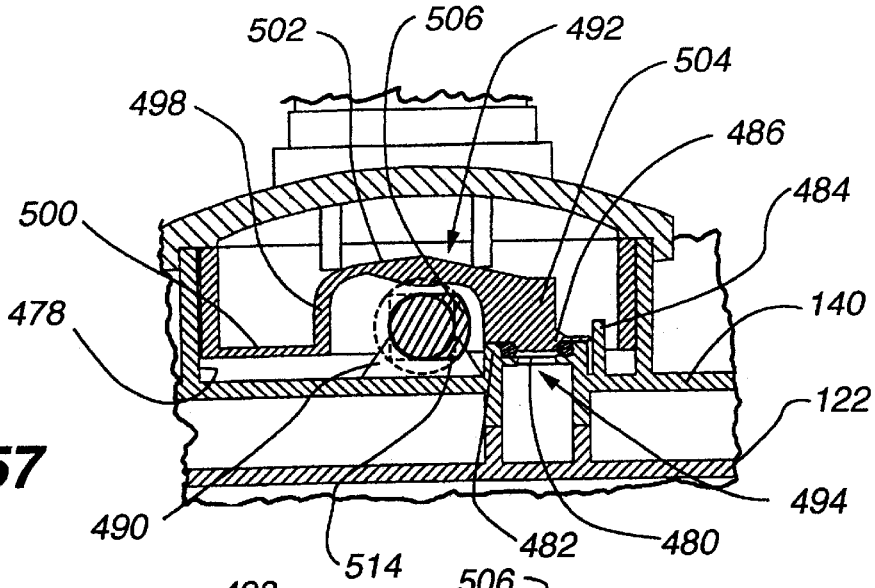
FIG. 57 is a representative section and shows the cam shaft of FIGS. 60A and B in use in the alternative embodiment of the mode selector, in the sealed position.
Figure 58:
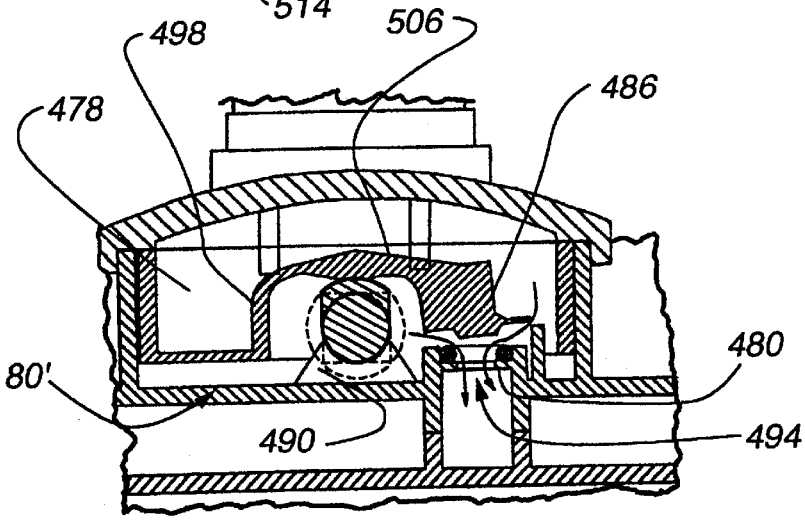
FIG. 58 is a representative section and shows the cam shaft of FIGS. 56A and B in use in the alternative embodiment of the mode selector, in the unsealed position.

FIGS. 57 and 58 show the actuation of the valve arm 498, similar to that shown by FIGS. 54 and 55, by a cam shaft 488 with the substantially rectangular lobes 514.

This embodiment of the mode selector structure allows a variety of modes to be selected, depending on the lobe structure on the cam shaft. Modes can be permanently de-activated by removing the corresponding lobe from the cam shaft, or multiple modes can be activated simultaneously by the proper positioning of the lobes. A variety of cam options can be used with a mode actuator to provide the user with the desired number of modes, A four-mode shower would have three lobes if mist mode was one of the modes (the mist mode does not depend on the mode actuator). A seven-mode shower would have six lobes if the mist mode was one of the modes. This provides an easy way to modify the level of modes available to the user without having to redesign the entire product.

Figure 59:
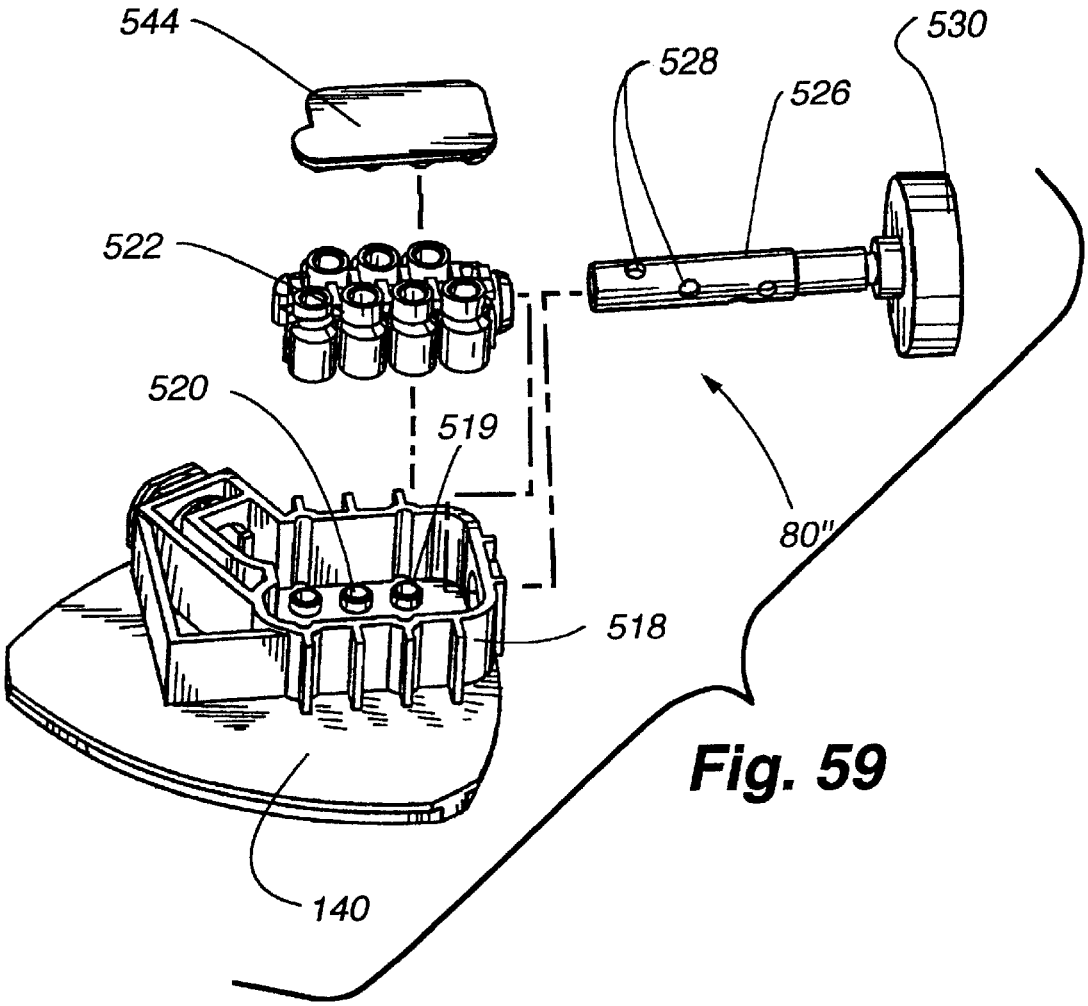
FIG. 59 shows an exploded view of another alternative embodiment of the mode selector.
Figure 60:
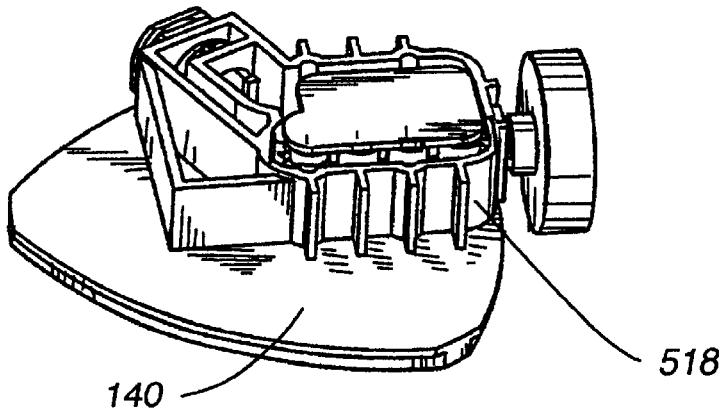
FIG. 60 shows an assembled view of the alternative embodiment of the mode selector shown in FIG. 59.
Figure 61:
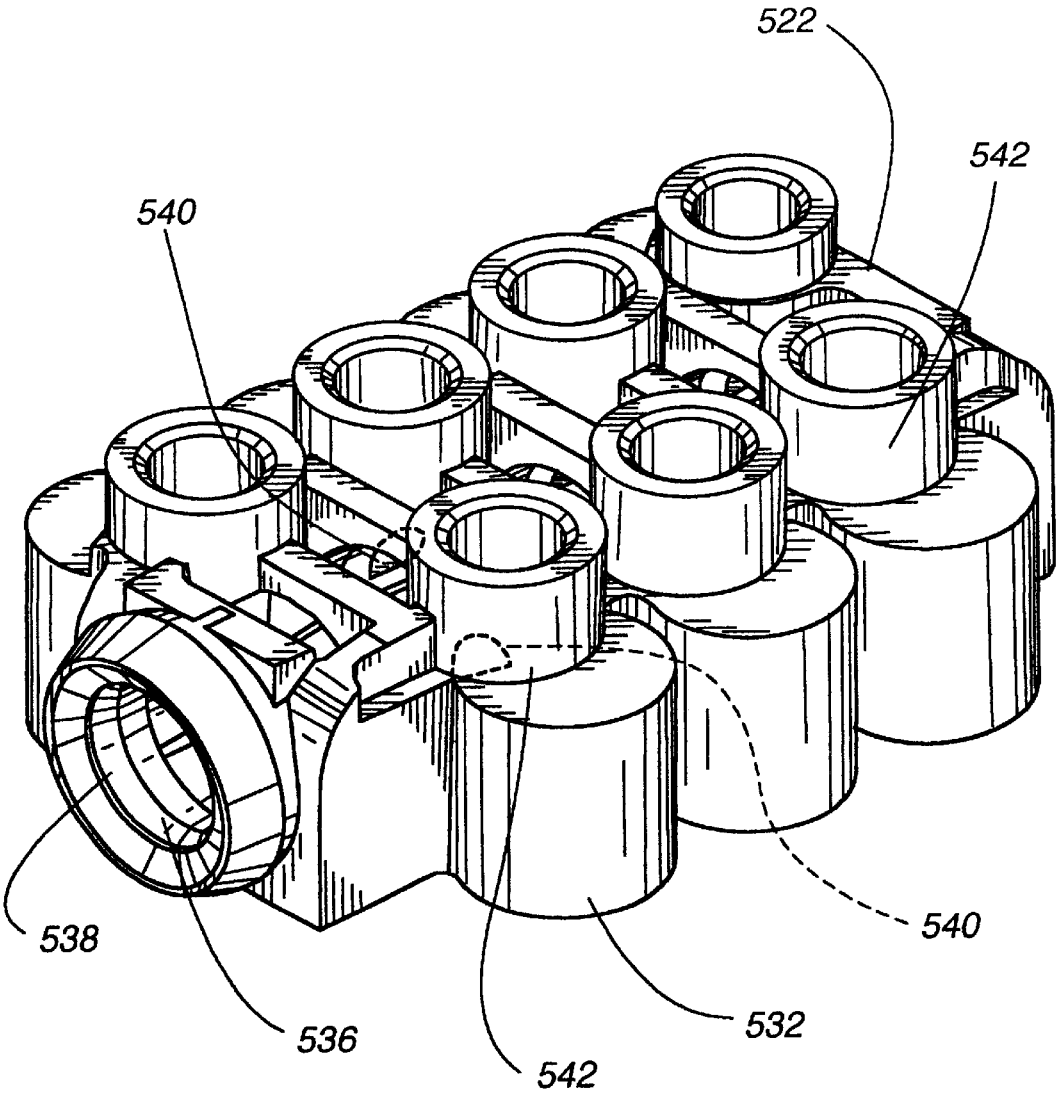
FIG. 61 is an enlarged perspective view of the manifold of the embodiment shown in FIGS. 59 and 60.
Figure 62:
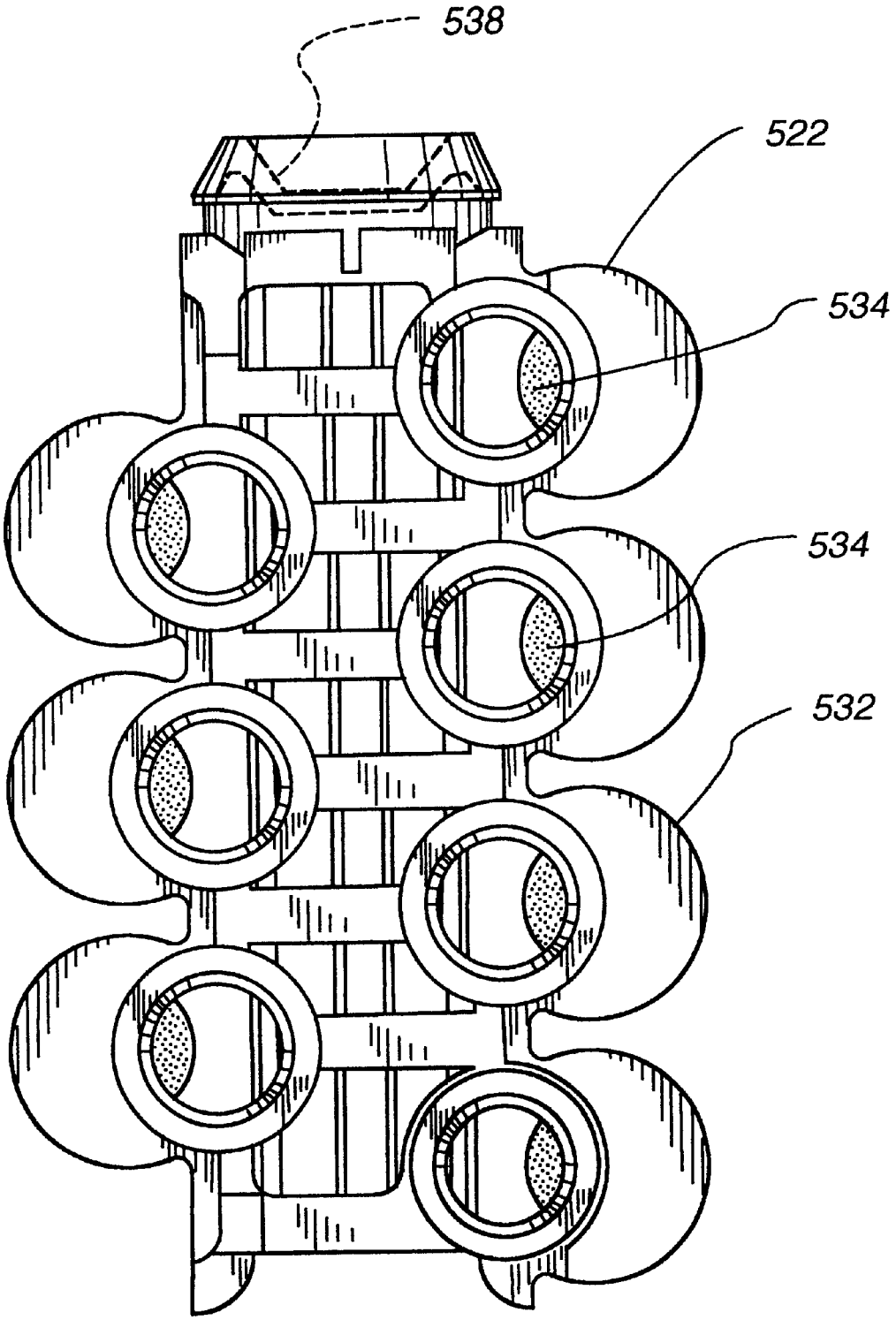
FIG. 62 is an enlarged top view of the manifold of the embodiment shown in FIGS. 60 and 61.
Figure 63:
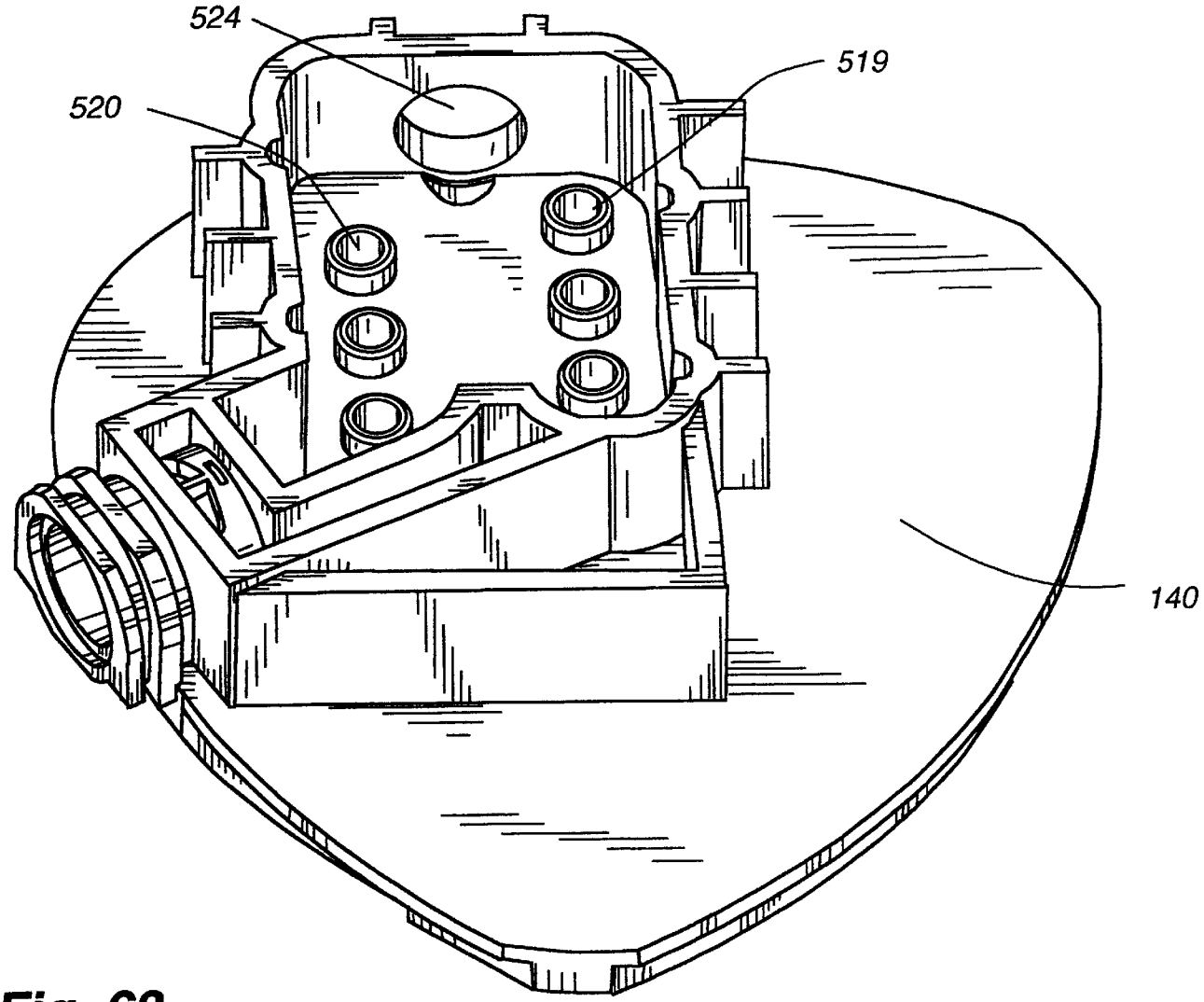
FIG. 63 is an enlarged perspective view of the reservoir of the alternative embodiment for the mode selector shown in FIGS. 59 and 60.

FIGS. 59–65 show a third embodiment of the mode selector 80". FIGS. 59, 60 and 63 show the back plate 140 of the spray head unit 138 with the engine housing 518, or reservoir, attached thereto. Apertures are shown formed through the plate 140 to the channels on the front face thereof, each of which lead to a different spray mode, as described earlier. Each of the apertures 519 has a collar 520. The collars 520 are approximately 0.030 to 0.050 inches in height. The collars 520 have a beveled top edge, and assist in sealing against the manifold 522, as described in greater detail below.

Referring to FIG. 59, an aperture 524 is formed through the end wall of the reservoir to receive the spool valve assembly 526. At one end of the reservoir extends the housing for the flow control valve 82 described earlier. The structure of that housing is substantially the same as described above.

FIG. 59 also shows the spool valve 526. The spool valve includes a hollow cylinder and a knob 530. The hollow cylinder is positioned in the reservoir and the knob 530 is positioned outside the reservoir for actuation by the user. The hollow cylinder 526 is closed at the end attached to the knob, and is open at the free end. The hollow cylinder has a channel formed at the end attached to the handle to receive a U-shaped clip that keeps the spool valve 526 from being extracted from the reservoir once inserted therein with the clip in place.

The hollow cylinder 526 defines a plurality of apertures 528 at different locations along its walls. The hollow cylinder 526 is made of a preferably rigid material such as plastic.

FIGS. 59–62 show the valve seat (or manifold) 522. The manifold 522 fits into the engine housing 518, with the hollow cylinder 526 received in the manifold 522. The manifold 522 is made of a flexible material, such as Santoprene™ or other type of plastic or rubber that can withstand the high temperatures of shower water and still maintain its shape. The manifold 522 has a main body made up of several vertically-oriented cylindrical lobes 532. Each lobe 532 is a pair of vertically-stacked, offset cylinders. The overlapping region between the upper and lower cylinders forms an opening 534 for water to flow through. See the oval-shaped shaded areas in FIG. 66. There is one lobe 532 for each aperture formed in the base wall of the engine housing 518. Each bottom cylinder of each lobe fits in sealing engagement around the collar 520 formed around the corresponding aperture 519 in the floor of the engine housing 518.

The manifold 522 defines a longitudinally-extending axial cylindrical chamber 536 for receiving the cylindrical portion of the spool 526. The curved walls of the chamber 536 match the curved cylindrical wall of the spool valve 526 in a tight fit. An aperture is formed at one end of the manifold to be positioned in alignment with the aperture formed in the wall of the engine housing 518. The spool valve 526 inserts through both apertures and in to the manifold 522. The aperture in the manifold 522 defines an end seal that extends radially inwardly and is curved toward the inside of the manifold 522. The seal 538 helps center the spool valve 526 relative to the manifold 522, not the engine housing 518, for the alignment of the outlet apertures 528 in the spool valve 526 to the internal water inlet apertures 540 formed in the manifold, as described below.

Figure 64:
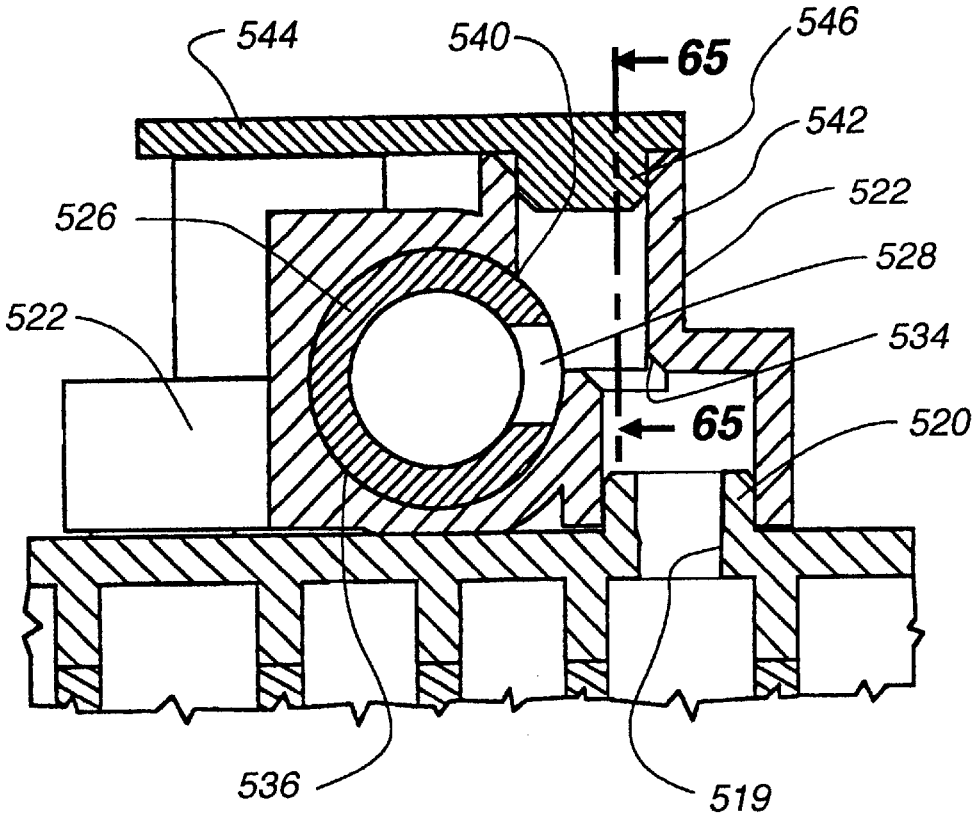
FIG. 64 is a representative section of the alternative embodiment of the mode selector shown in FIGS. 59 and 60, and shows the spool aperture in alignment with the mode aperture to allow water to flow to selected spray mode.
Figure 65:
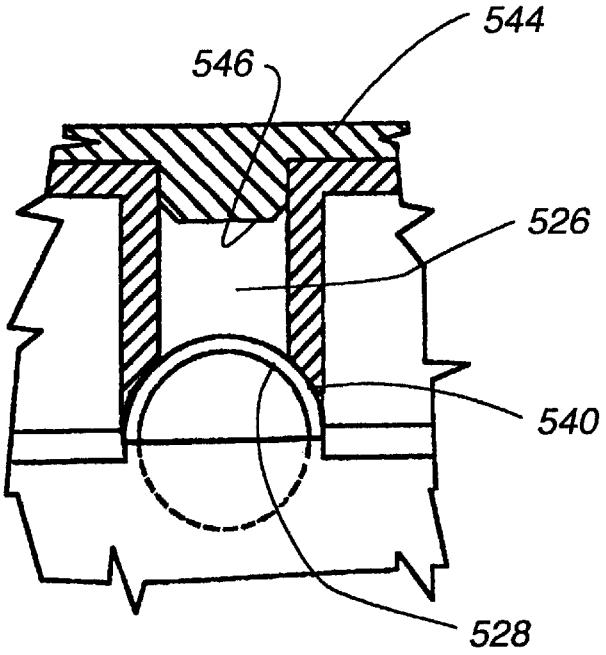
FIG. 65 is a view taken from line 65—65 of FIG. 64, and shows the alignment of the mode aperture and the spool aperture.

The chamber 536 in the manifold 522 defines water inlet apertures 540 in each top cylinder 542 of each lobe. See FIG. 61. The inlet apertures 540 are preferably half-circle shaped, and are each positioned to align with a water outlet aperture 528 formed on the cylindrical portion of the spool valve 526. An example of this alignment is shown in FIGS. 64 and 65. More than one outlet aperture 528 can mate with an inlet aperture 540 at a time to effect actuation of more than one mode at a time, as desired by the manufacturer. The outside wall of the reservoir helps position the lobes with respect to one another, and portions of the outside wall span the open top of the cylindrical chamber between lobes for reinforcement.

FIGS. 59 and 64 show a manifold lid 544 that includes plugs 546 for each open-ended lobe 522. The water in each lobe thus flows only to the aperture 519 formed in the floor of the engine housing 518 and on to the corresponding spray mode.

In operation, the water flows into the reservoir 518, and surrounds the manifold 522. The water flows into the open end of the spool 526. The water flows from inside the spool 526, through the outlet apertures 528 in the spool, into the associated inlet aperture 540 in the lobe aligned with the outlet aperture in the spool, through the overlap-aperture 534 between the top and bottom portion of the lobe, and through the aligned aperture 519 formed in the floor of the engine housing 5 18 to the channel for the desired spray mode. If more than one pair of apertures is aligned, then the water flows from the spool into the lobe having aligned apertures. The spool seals over the lobe inlet apertures 540 not aligned with apertures on the spool so that water does not flow from inside the spool to those lobes. The water pressure on the outside of the manifold 522 helps seal the manifold against the apertures 526 on the spool and on the floor of the engine housing.

The apertures 528 in the spool 526 are preferably positioned so that one mode is always at least partially selected. In other words, the water flow is not "dead-headed" in the engine housing. Water does not leak out from the engine housing around the handle because of a seal formed between the handle and the engine housing aperture through which the spool is positioned. As the spool is rotated, different modes are selected by the alignment of spool apertures 528 and lobe apertures 540.

A presently preferred embodiment of the present invention and many of its improvements have been described with a degree of particularity. It should be understood that this description has been made by way of example, and that the invention is defined by the scope of the following claims.

What is claimed is:

1. A shower head having a plurality of spray modes for exiting water, said shower head comprising:

a housing having a flow path for incoming water, a mode selector, and a plurality of outlet flow paths, each of said outlet flow paths leading to a particular spray mode;

said flow path for incoming water in fluid communications with said mode selector, and said plurality of outlet flow paths in fluid communications with said mode selector;

said mode selector comprising:

a spool valve having a hollow inner core and defining a plurality of outlet apertures;

a manifold defining a tubular recess, having a side wall, for rotatably receiving said spool valve, a plurality of mode apertures formed in said side wall of said recess, each of said apertures in fluid communication with at least one of said outlet flow paths and spray modes;

said spool valve rotatable in said manifold to align at least one outlet aperture with one of said mode apertures to allow water flow from said mode selector through said spool to said outlet flow path associated with said aligned outlet and mode apertures.

2. A shower head as defined in claim 1, wherein:

each of said outlet apertures aligns with at least one of said mode apertures to form pairs of aligned apertures.

3. A shower head as defined in claim 1, wherein:

said spool seals with said wall of said recess to prevent leaks between adjacent apertures.

4. A shower head as defined in claim 1, wherein:

said housing defines a reservoir;

said manifold is positioned in said reservoir.

5. A shower head as defined in claim 4, wherein:

said manifold defines a separate lobe for each aperture formed in the side wall of said recess.

6. A shower head as defined in claim 1, wherein:

said spool can be rotated to align different pairs of aligned apertures.

7. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

wherein said housing is a spray head unit including a front channel plate and a rear channel plate, said front and rear channel plates sealingly attached together, said mode channels formed between said front and rear channel plates.

8. A shower head as defined in claim 7, wherein said flow control valve and said mode selector are positioned on the back of said rear channel plate.

9. A shower head as defined in claim 7, wherein said spray head unit is encased in a front housing portion and a rear housing portion.

10. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

said spray mode apertures include groups of apertures for separate spray modes, including at least champagne mode, wide-band normal spray mode, and pulsating mode.

11. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels; and an outlet mode slot formed in said housing for emitting a waterfall spray mode.

12. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

said flow control valve comprises:

a shuttle portion and a knob portion, said shuttle portion positioned in said chamber and said knob portion extending from said chamber, said shuttle portion and said knob portion operably connected such that selective actuation of said knob portion moves said shuttle portion in said chamber, and said shuttle portion defining a restrictor; and wherein upon actuation of said knob portion, said shuttle portion moves in said chamber and causes said restrictor to at least partially cover said inlet flow path at said chamber to restrict the flow of water into the outlet flow path; and said flow restrictor is a circumferential ramp formed on said shuttle.

13. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

said flow control valve comprises:

a shuttle portion and a knob portion, said shuttle portion positioned in said chamber and said knob portion extending from said chamber, said shuttle portion and said knob portion operably connected such that selective actuation of said knob portion moves said shuttle portion in said chamber, and said shuttle portion defining a restrictor; and wherein upon actuation of said knob portion, said shuttle portion moves in said chamber and causes said restrictor to at least partially cover said inlet flow path at said chamber to restrict the flow of water into the outlet flow path;

said flow restrictor extends from the end of the shuttle and has a middle section with opposing edges, each of said opposing edges having laterally extending flanges to form an I-shaped cross section;

upon actuation of said knob portion, one of said lateral flanges at least partially covers said inlet flow path to restrict the flow of water into said chamber.

14. The shower head as defined in claim 13, wherein:

said middle section defines an aperture.

15. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

said flow control valve comprises:

a shuttle portion and a knob portion, said shuttle portion positioned in said chamber and said knob portion extending from said chamber, said shuttle portion and said knob portion operably connected such that selective actuation of said knob portion moves said shuttle portion in said chamber, and said shuttle portion defining a restrictor; and wherein upon actuation of said knob portion, said shuttle portion moves in said chamber and causes said restrictor to at least partially cover said inlet flow path at said chamber to restrict the flow of water into the outlet flow path;

said shuttle and said knob portion are operably connected together by a threaded means;

said knob portion is rotatably received in the shower head;

said shuttle is rotationally restrained in said chamber and can translate along said chamber; and upon rotation of said knob portion, said threaded means causes said shuttle to translate along said chamber.

16. The shower head as defined in claim 15, wherein:

said knob portion defines an internally-threaded cavity;

said shuttle portion defines an externally-threaded post; and wherein said post is received in said cavity.

17. The shower head as defined in claim 13, wherein:

said knob portion defines an externally-threaded post;

said shuttle portion defines an internally-threaded cavity; and wherein said post is received in said cavity.

18. The shower head as defined in claim 17, wherein:

said shuttle is movable to a position between said first and second positions where said diverter portion diverts water to both of said first and second outlet ports.

19. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

wherein said mode selector comprises:

a spool valve having a hollow inner core and defining a plurality of outlet apertures;

a manifold defining a tubular recess, having a side wall, for rotatably receiving said spool valve, a plurality of mode apertures formed in said side wall of said recess, each of said apertures in fluid communication with at least one of said outlet flow paths and spray modes;

said spool valve rotatable in said manifold to align at least one outlet aperture with one of said mode apertures to allow water flow from said mode selector through said spool to said outlet flow path associated with said aligned outlet and mode apertures.

20. A shower head as defined in claim 19, wherein:

each of said outlet apertures aligns with at least one of said mode apertures to form pairs of aligned apertures.

21. A shower head as defined in claim 19, wherein:

said spool seals with said wall of said recess to prevent leaks between adjacent apertures.

22. A shower head as defined in claim 19, wherein:

said housing defines a reservoir;

said manifold is positioned in said reservoir.

23. A shower head as defined in claim 22, wherein:

said manifold defines a separate lobe for each aperture formed in the side wall of said recess.

24. A shower head as defined in claim 19, wherein:

said spool can be rotated to align different pairs of aligned apertures.

25. A shower head for directing the flow of water to a plurality of spray modes, said shower head comprising:

a housing having an inlet flow path, a chamber, and a first outlet flow path and a second outlet flow path, a mode selector, a plurality of mode channels, and a plurality of outlet spray mode apertures;

said inlet flow path, said first outlet flow path, and said second outlet flow path each being in fluid communication with said chamber, said first outlet flow path also being in fluid communications with said mode selector, said plurality of mode channels each being in fluid communications with said mode selector and said outlet mode apertures; said second outlet flow path in fluid communication with a unique spray mode aperture;

a flow control valve positioned in said chamber and actuable to control the pressure of the water flow therethrough to said first outlet mode path, and including a diverter portion for diverting water flow to either the first outlet flow path or the second outlet flow path, or a combination of both said first and second outlet flow paths;

said mode selector actuable to select at least one of said mode channels;

said mode selector comprising:

a reservoir defining a plurality of mode apertures, each of said apertures in fluid communication with at least one of said outlet flow paths and spray modes;

a valve assembly defining at least one valve arm, said at least one valve arm having a valve seal and being movable between a first position in sealing engagement with said respective mode aperture and a second position disengaged from said respective mode aperture, said valve arm biasing said valve seal in engagement with said respective mode aperture;

a cam shaft rotatably mounted in said reservoir and defining at least one cam protrusion aligned along said cam shaft to engage said at least one valve arm, wherein said rotation of said cam shaft causes said at least one cam protrusion to engage said at least one valve arm and move said at least one valve arm from said first position to said second position to allow fluid flow through said outlet aperture.

26. A shower head as defined in claim 25, wherein:

said cam shaft defines a plurality of protrusions;

said valve assembly defines a plurality of valve arms; and each of said protrusions is positioned to engage a particular valve arm upon rotation of said spool.

27. A shower head as defined in claim 26, wherein:

more than one protrusion can be positioned on said cam to engage more than one valve arm simultaneously.

28. A shower head as defined in claim 25, wherein:

said at least one valve arm is a cantilever beam attached at one end to said reservoir.

29. A shower head as defined in claim 28, wherein:

said reservoir has a floor;

said mode apertures are formed in said floor; and a collar is positioned around each of said mode apertures for engagement with said valve seal.

30. A shower head as defined in claim 28, wherein:

said reservoir has a floor; and said mode apertures are formed in said floor in two rows.

* * * * *